US009370075B2

(12) United States Patent
Chaji et al.

(10) Patent No.: US 9,370,075 B2
(45) Date of Patent: Jun. 14, 2016

(54) SYSTEM AND METHOD FOR FAST COMPENSATION PROGRAMMING OF PIXELS IN A DISPLAY

(75) Inventors: Gholamreza Chaji, Waterloo (CA); Jackson Chi Sun Lai, Mississauga (CA); Yaser Azizi, Waterloo (CA); Maran Ran Ma, Waterloo (CA); Arokia Nathan, Cambridge (GB)

(73) Assignee: Ignis Innovation Inc., Waterloo (CA)

( * ) Notice: Subject to any disclaimer, the term of this patent is extended or adjusted under 35 U.S.C. 154(b) by 810 days.

(21) Appl. No.: 13/481,789

(22) Filed: May 26, 2012

(65) Prior Publication Data

US 2013/0099692 A1 Apr. 25, 2013

Related U.S. Application Data

(63) Continuation-in-part of application No. 12/633,209, filed on Dec. 8, 2009, now Pat. No. 8,358,299.

(60) Provisional application No. 61/491,165, filed on May 28, 2011, provisional application No. 61/600,316, filed on Feb. 17, 2012.

(30) Foreign Application Priority Data

Dec. 9, 2008 (CA) ..... 2647112
Dec. 19, 2008 (CA) ..... 2654409

(51) Int. Cl.
*H05B 37/02* (2006.01)
*G09G 3/32* (2016.01)

(52) U.S. Cl.
CPC ..... *H05B 37/02* (2013.01); *G09G 3/3233* (2013.01); *G09G 3/3283* (2013.01);

(Continued)

(58) Field of Classification Search
CPC ..... G09G 2300/0842; G09G 2320/043; G09G 3/3233
USPC ..... 345/204, 76, 78, 82, 211, 690
See application file for complete search history.

(56) References Cited

U.S. PATENT DOCUMENTS 3,506,851 A 4/1970 Polkinghorn et al.
3,750,987 A 8/1973 Gobel (Continued)

FOREIGN PATENT DOCUMENTS

AU 729652 12/1998
AU 764896 12/2001

(Continued)

OTHER PUBLICATIONS

Chapter 3: Color Spaces Keith Jack: Video Demystified: "A Handbook for the Digital Engineer" 2001, Referex ORD-0000-00-00, USA EP040425529, ISBN: 1-878707-56-6, pp. 32-33.

(Continued)

*Primary Examiner* — Fred Tzeng
(74) *Attorney, Agent, or Firm* — Nixon Peabody LLP

(57) ABSTRACT

Circuits for programming a circuit with decreased programming time are provided. Such circuits include a storage device such as a capacitor for storing display information and for ensuring a driving device such as a driving transistor drives a light emitting device according to the display information. To increase programming time, the pixel circuits may be precharged or a biasing current may be applied to charge and/or discharge a data line and/or the driving device. Aspects of the present disclosure allow for the biasing current to drain partially through the storage device to allow the portion of the biasing current applied to the driving device to remain small while the data line discharges. Furthermore, the present disclosure provides display architectures and operation schemes for display arranged in segments each including a plurality of pixel circuits.

51 Claims, 48 Drawing Sheets

(52) U.S. Cl.
CPC ..... *G09G 3/3291* (2013.01); *G09G 2300/0465* (2013.01); *G09G 2300/0819* (2013.01); *G09G 2300/0842* (2013.01); *G09G 2300/0852* (2013.01); *G09G 2310/027* (2013.01); *G09G 2310/0259* (2013.01); *G09G 2310/0262* (2013.01); *G09G 2310/066* (2013.01); *G09G 2320/0233* (2013.01); *G09G 2320/043* (2013.01); *G09G 2330/021* (2013.01); *G09G 2330/023* (2013.01)

(56) References Cited

U.S. PATENT DOCUMENTS 3,774,055 A 11/1973 Bapat
4,090,096 A 5/1978 Nagami
4,354,162 A 10/1982 Wright
4,996,523 A 2/1991 Bell et al.
5,134,387 A 7/1992 Smith et al.
5,153,420 A 10/1992 Hack et al.
5,170,158 A 12/1992 Shinya
5,204,661 A 4/1993 Hack et al.
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,744,824 A 4/1998 Kousai et al.
5,745,660 A 4/1998 Kolpatzik et al.
5,748,160 A 5/1998 Shieh et al.
5,758,129 A 5/1998 Gray
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,100,868 A 8/2000 Jeong et al.
6,144,222 A 11/2000 Ho
6,150,854 A * 11/2000 Rosahl ..... 327/110
6,229,506 B1 5/2001 Dawson et al.
6,229,508 B1 5/2001 Kane
6,246,180 B1 6/2001 Nishigaki
6,252,248 B1 6/2001 Sano et al.
6,268,841 B1 7/2001 Cairns et al.
6,288,696 B1 9/2001 Holloman
6,307,322 B1 10/2001 Dawson et al.
6,310,962 B1 10/2001 Chung et al.
6,323,631 B1 11/2001 Juang
6,333,729 B1 12/2001 Ha
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,473,065 B1 10/2002 Fan
6,475,845 B2 11/2002 Kimura
6,501,098 B2 12/2002 Yamazaki
6,501,466 B1 12/2002 Yamagishi et al.
6,522,315 B2 2/2003 Ozawa et al.
6,535,185 B2 3/2003 Kim et al.
6,542,138 B1 4/2003 Shannon et al.
6,580,408 B1 6/2003 Bae et al.
6,583,398 B2 6/2003 Harkin
6,618,030 B2 9/2003 Kane et al.
6,639,244 B1 10/2003 Yamazaki et al.
6,680,580 B1 1/2004 Sung
6,686,699 B2 2/2004 Yumoto
6,690,000 B1 2/2004 Muramatsu et al.
6,693,610 B2 2/2004 Shannon et al.
6,694,248 B2 2/2004 Edwards et al.
6,697,057 B2 2/2004 Koyama et al.
6,724,151 B2 4/2004 Yoo
6,734,636 B2 5/2004 Sanford et al.
6,753,655 B2 6/2004 Chen et al.
6,753,834 B2 6/2004 Mikami et al.
6,756,741 B2 6/2004 Li
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai et al.
6,900,485 B2 5/2005 Lee
6,903,734 B2 6/2005 Eu
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,220 B2 8/2005 Kitaura et al.
6,940,214 B1 9/2005 Komiya et al.
6,954,194 B2 10/2005 Matsumoto et al.
6,970,149 B2 11/2005 Chung et al.
6,975,142 B2 12/2005 Azami et al.
6,975,332 B2 12/2005 Arnold et al.
6,995,519 B2 2/2006 Arnold et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,106,285 B2 9/2006 Naugler
7,112,820 B2 9/2006 Chang et al.
7,113,864 B2 9/2006 Smith et al.
7,122,835 B1 10/2006 Ikeda et al.
7,129,914 B2 10/2006 Knapp et al.
7,164,417 B2 1/2007 Cok
7,224,332 B2 5/2007 Cok
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,466,166 B2 12/2008 Date et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.

(56) References Cited

U.S. PATENT DOCUMENTS 7,688,289 B2 3/2010 Abe et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,144,081 B2 3/2012 Miyazawa
8,159,007 B2 4/2012 Barna et al.
8,242,979 B2 8/2012 Anzai et al.
8,319,712 B2 11/2012 Nathan et al.
8,736,525 B2 * 5/2014 Kawabe ..... 345/78
2001/0002703 A1 6/2001 Koyama
2001/0009283 A1 7/2001 Arao et al.
2001/0026257 A1 10/2001 Kimura
2001/0030323 A1 10/2001 Ikeda
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2003/0001828 A1 1/2003 Asano
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch et al.
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0179626 A1 9/2003 Sanford et al.
2003/0189535 A1 10/2003 Matsumoto et al.
2003/0197663 A1 10/2003 Lee et al.
2003/0214465 A1 11/2003 Kimura
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0129933 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0160516 A1 8/2004 Ford
2004/0174349 A1 9/2004 Libsch et al.
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0285825 A1 12/2005 Eom et al.
2006/0012311 A1 1/2006 Ogawa
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0092185 A1 5/2006 Jo et al.
2006/0114196 A1 6/2006 Shin et al.
2006/0125408 A1 6/2006 Nathan et al.
2006/0139253 A1 6/2006 Choi et al.
2006/0145964 A1 7/2006 Park et al.
2006/0191178 A1 8/2006 Sempel et al.
2006/0209012 A1 9/2006 Hagood, IV
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0290614 A1 12/2006 Nathan et al.
2007/0001939 A1 1/2007 Hashimoto et al.
2007/0001945 A1 1/2007 Yoshida et al.
2007/0008297 A1 1/2007 Bassetti
2007/0035489 A1 2/2007 Lee
2007/0035707 A1 2/2007 Margulis
2007/0040773 A1 2/2007 Lee et al.
2007/0057873 A1 * 3/2007 Uchino et al. ..... 345/76
2007/0063932 A1 3/2007 Nathan et al.
2007/0080908 A1 4/2007 Nathan et al.
2007/0085801 A1 4/2007 Park et al.
2007/0109232 A1 5/2007 Yamamoto et al.
2007/0128583 A1 6/2007 Miyazawa
2007/0164941 A1 7/2007 Park et al.
2007/0182671 A1 8/2007 Nathan et al.
2007/0236430 A1 10/2007 Fish
2007/0241999 A1 10/2007 Lin
2007/0242008 A1 10/2007 Cummings

(56) References Cited

U.S. PATENT DOCUMENTS

| | | | | |
|---|---|---|---|---|
| 2008/0001544 | A1 | 1/2008 | Murakami et al. | |
| 2008/0043044 | A1 | 2/2008 | Woo et al. | |
| 2008/0048951 | A1 | 2/2008 | Naugler et al. | |
| 2008/0055134 | A1 | 3/2008 | Li et al. | |
| 2008/0074360 | A1 | 3/2008 | Lu et al. | |
| 2008/0088549 | A1 | 4/2008 | Nathan et al. | |
| 2008/0094426 | A1 | 4/2008 | Kimpe | |
| 2008/0122819 | A1 | 5/2008 | Cho et al. | |
| 2008/0228562 | A1 | 9/2008 | Smith et al. | |
| 2008/0231641 | A1 | 9/2008 | Miyashita | |
| 2008/0290805 | A1 | 11/2008 | Yamada et al. | |
| 2009/0009459 | A1 | 1/2009 | Miyashita | |
| 2009/0015532 | A1 | 1/2009 | Katayama et al. | |
| 2009/0102759 | A1* | 4/2009 | Kawabe | 345/76 |
| 2009/0121988 | A1 | 5/2009 | Amo et al. | |
| 2009/0146926 | A1 | 6/2009 | Sung et al. | |
| 2009/0153448 | A1* | 6/2009 | Tomida et al. | 345/82 |
| 2009/0153459 | A9 | 6/2009 | Han et al. | |
| 2009/0174628 | A1 | 7/2009 | Wang et al. | |
| 2009/0201281 | A1 | 8/2009 | Routley et al. | |
| 2009/0244046 | A1* | 10/2009 | Seto | 345/211 |
| 2009/0251486 | A1 | 10/2009 | Sakakibara et al. | |
| 2009/0278777 | A1 | 11/2009 | Wang et al. | |
| 2010/0039451 | A1 | 2/2010 | Jung | |
| 2010/0039453 | A1 | 2/2010 | Nathan et al. | |
| 2010/0079419 | A1* | 4/2010 | Shibusawa | 345/204 |
| 2010/0207920 | A1 | 8/2010 | Chaji et al. | |
| 2010/0225634 | A1 | 9/2010 | Levey et al. | |
| 2010/0269889 | A1 | 10/2010 | Reinhold et al. | |
| 2010/0277400 | A1 | 11/2010 | Jeong | |
| 2010/0315319 | A1 | 12/2010 | Cok et al. | |
| 2011/0069089 | A1 | 3/2011 | Kopf et al. | |
| 2012/0169793 | A1* | 7/2012 | Nathan et al. | 345/690 |
| 2012/0299976 | A1* | 11/2012 | Chen et al. | 345/690 |
| 2013/0100173 | A1* | 4/2013 | Chaji et al. | 345/690 |
| 2013/0300724 | A1* | 11/2013 | Chaji | 345/212 |

FOREIGN PATENT DOCUMENTS

| | | | |
|---|---|---|---|
| CA | 1 294 034 | | 1/1992 |
| CA | 2 249 592 | | 7/1998 |
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2507276 | | 8/2002 |
| CA | 2463653 | | 1/2004 |
| CA | 2 498 136 | | 3/2004 |
| CA | 2 522 396 | | 11/2004 |
| CA | 2 438 363 | | 2/2005 |
| CA | 2443206 | | 3/2005 |
| CA | 2519097 | | 3/2005 |
| CA | 2 472 671 | | 12/2005 |
| CA | 2 567 076 | | 1/2006 |
| CA | 2523841 | | 1/2006 |
| CA | 2 526 782 | C | 4/2006 |
| CA | 2 495 726 | | 7/2006 |
| CA | 2557713 | | 11/2006 |
| CA | 2 651 893 | | 11/2007 |
| CA | 2 672 590 | | 10/2009 |
| DE | 202006007613 | | 8/2006 |
| EP | 0 478 186 | | 4/1992 |
| EP | 1 028 471 | A | 8/2000 |
| EP | 1 130 565 | A1 | 9/2001 |
| EP | 1 194 013 | | 4/2002 |
| EP | 1321922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| GB | 2 399 935 | | 9/2004 |
| GB | 2460018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-271095 | | 9/2003 |
| JP | 2003-308046 | | 10/2003 |
| JP | 2004-054188 | | 2/2004 |
| JP | 2005-099715 | | 4/2005 |
| JP | 2005-338819 | | 12/2005 |
| TW | 569173 | | 1/2004 |
| TW | 200526065 | | 8/2005 |
| TW | 1239501 | | 9/2005 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2009/059028 | | 5/2009 |
| WO | 2009/127065 | | 10/2009 |
| WO | 2010/066030 | | 6/2010 |
| WO | 2010/120733 | | 10/2010 |

OTHER PUBLICATIONS

Chapter 8: Alternative Flat Panel Display 1-25 Technologies; Willem den Boer: "Active Matrix Liquid Crystal Display: Fundamentals and Applications" 2005, Referex ORD-0000-00-00 U.K.; XP040426102 ISBN: 0-7506-7813-5, pp. 206-209, p. 208.

European Partial Search Report corresponding to European Patent Application Serial No. 12156251.6, European Patent Office, dated May 30, 2012 (7 pages).

European Patent Office Communication in European Application No. 05821114 dated Jan. 11, 2013 (9 pages).

European Patent Office Communication with Supplemental European Search Report for EP Application No. 07701644.2, dated Aug. 18, 2009 (12 pages).

European Search Report corresponding to Application EP 10175764, dated Oct. 18, 2010 (2 pages).

European Search Report corresponding to European Patent Application Serial No. 12156251.6, European Patent Office, dated Oct. 12, 2012 (18 pages).

European Search Report corresponding to European Patent Application No. 10829593.2, European Patent Office, dated May 17, 2013 (7 pages).

European Search Report for Application No. 11175225.9 dated Nov. 4, 2011 (9 pages).

European Search Report for European Application No. EP 05 80 7905 dated Apr. 2, 2009 (5 pages).

European Search Report for European Application No. EP 05 82 1114 dated Mar. 27, 2009 (2 pages).

European Search Report for European Application No. EP 07 70 1644 dated Aug. 5, 2009.

European Search Report, Application No. 10834294.0-1903, dated Apr. 8, 2013 (9 pages).

European Supplementary Search Report for EP 09 80 2309, dated May 8, 2011 (14 pages).

European Supplementary Search Report for European Application No. 09831339.8 dated Mar. 26, 2012 (11 pages).

(56) References Cited

OTHER PUBLICATIONS

Extended European Search Report corresponding to European Patent Application No. 12174465.0, European Patent Office, dated Sep. 7, 2012 (9 pages).
Extended European Search Report mailed Nov. 8, 2011 issued in European Patent Application No. 11175223.4 (8 pages).
Extended European Search Report, Application No. 06752777.0, dated Dec. 6, 2010 (21 pages).
Extended European Search Report, Application No. 09732338.0, dated May 24, 2011 (8 pages).
International Search Report corresponding to International Patent Application No. PCT/IB2010/002898 Canadian Intellectual Property Office, dated Jul. 28, 2009 (5 pages).
International Search Report for International Application No. PCT/CA2005/001844 dated Mar. 28, 2006 (2 pages).
International Search Report for International Application No. PCT/CA2007/000013 dated May 7, 2007.
International Search Report for International Application No. PCT/CA2006/000941 dated Oct. 3, 2006 (2 pages).
International Search Report for International Application No. PCT/CA2009/001769 dated Apr. 8, 2010.
International Search Report issued in International Application No. PCT/CA2009/001049, mailed Dec. 7, 2009 (4 pages).
International Search Report, International Application PCT/IB2012/052651, 5 pages, dated Sep. 11, 2012.
International Search Report, PCT/IB2011/051103, dated Jul. 8, 2011, 3 pages.
International Searching Authority Search Report, PCT/IB2010/055481, dated Apr. 7, 2011 (3 pages).
International Searching Authority Written Opinion, PCT/IB2010/055481, dated Apr. 7, 2011 (6 pages ).
International Written Opinion, International Application PCT/IB2012/052651, 6 pages, dated Sep. 11, 2012.
International Written Opinion, PCT/IB2011/051103, dated Jul. 8, 2011, 6 pages.
Ono et al., "Shared Pixel Compensation Circuit for AM-OLED Displays," Proceedings of the 9$^{th}$ Asian Symposium on Information Display (ASID), pp. 462-465, New Delhi, dated Oct. 8-12, 2006 (4 pages).
Written Opinion corresponding to International Patent Application No. PCT/IB2010/002898, Canadian Intellectual Property Office, dated Mar. 30, 2011 (8 pages).
Written Opinion for International Application No. PCT/CA2009/001769 dated Apr. 8, 2010 (8 pages).
Ahnood et al.: "Effect of threshold voltage instability on field effect mobility in thin film transistors deduced from constant current measurements"; dated Aug. 2009.
Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Arokia Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
Jafarabadiashtiani et al.: "A New Driving Method for a-Si AMOLED Displays Based on Voltage Feedback"; dated 2005 (4 pages).
Joon-Chul Goh et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
Lee et al.: "Ambipolar Thin-Film Transistors Fabricated by PECVD Nanocrystalline Silicon"; dated 2006 (6 pages).
Ma E Y et al.: "organic light emitting diode/thin film transistor integration for foldable displays" dated Sep. 15, 1997(4 pages).
Matsueda y et al.: "35.1: 2.5-in. AMOLED with Integrated 6-bit Gamma Compensated Digital Data Driver"; dated May 2004.
Nathan A. et al., "Thin Film imaging technology on glass and plastic" ICM 2000, proceedings of the 12 international conference on microelectronics, dated Oct. 31, 2001 (4 pages).
Nathan et al.: "Backplane Requirements for Active Matrix Organic Light Emitting Diode Displays"; dated 2006 (16 pages).
Nathan et al.: "Call for papers second international workshop on compact thin-film transistor (TFT) modeling for circuit simulation"; dated Sep. 2009 (1 page).

(56) References Cited

OTHER PUBLICATIONS

Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Stewart M. et al., "Polysilicon TFT technology for active matrix oled displays" IEEE transactions on electron devices, vol. 48, No. 5, dated May 2001 (7 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Ching-Lin Fan et al. "LTPS_TFT Pixel Circuit Compensation for TFT Threshold Voltage Shift and IR-Drop on the Power Line for Amolded Displays" 5 pages copyright 2012.
Extended European Search Report corresponding to co-pending European Patent Application Serial No. 15173106.4, European Patent Office, dated Oct. 13, 2015; (7 pages).

* cited by examiner

FIG. 15A
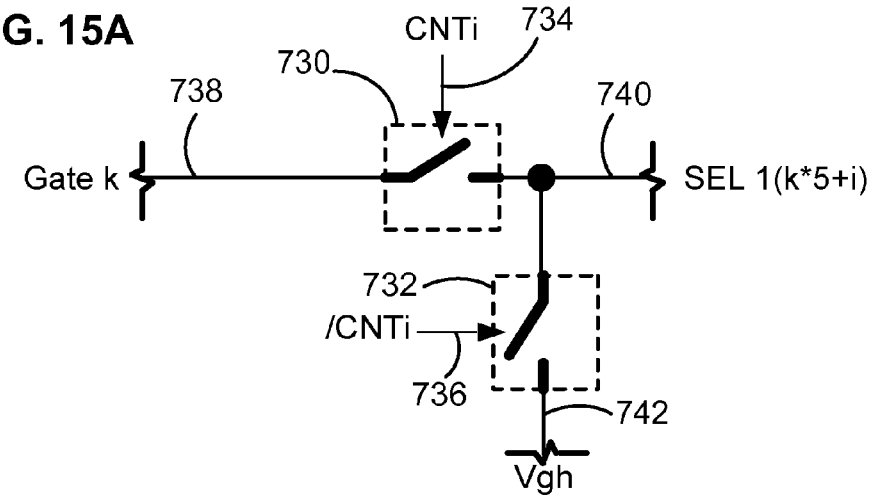
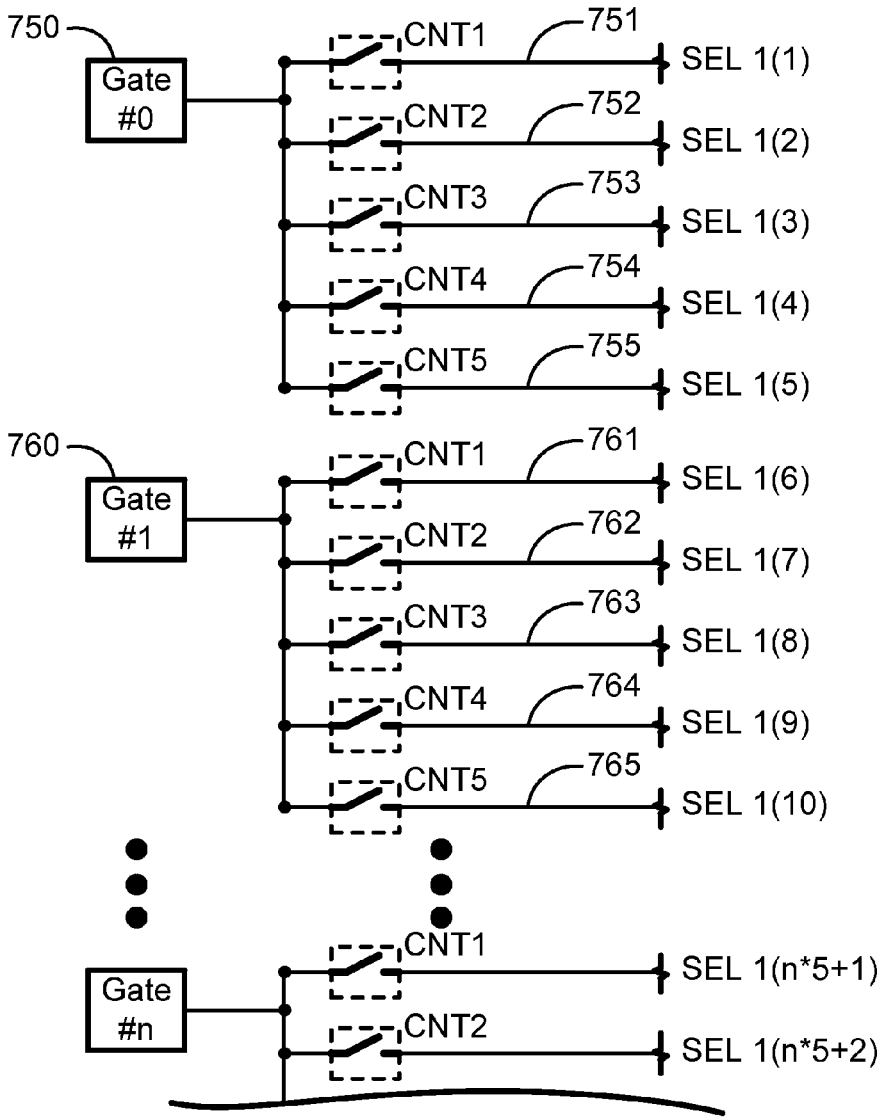
FIG. 15B

SYSTEM AND METHOD FOR FAST COMPENSATION PROGRAMMING OF PIXELS IN A DISPLAY

CROSS REFERENCE TO RELATED APPLICATIONS

This application is a continuation-in-part of U.S. patent application Ser. No. 12/633,209, filed Dec. 8, 2009, and which claims priority to Canadian Application 2,647,112, filed Dec. 9, 2008, and to Canadian Patent Application 2,654,409, filed Dec. 19, 2008; this application also claims the benefit of, and priority to, U.S. Provisional Patent Application No. 61/491,165, filed May 28, 2011, and to U.S. Provisional Patent Application No. 61/600,316, filed Feb. 17, 2012, the contents of each of these applications being incorporated entirely herein by reference.

FIELD OF THE INVENTION

The present disclosure generally relates to circuits and methods of driving, calibrating, and programming displays, particularly displays such as active matrix organic light emitting diode displays.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs fabricated on poly-silicon tend to demonstrate non-uniform behavior across display panels and over time. Some displays therefore utilize compensation techniques to achieve image uniformity in poly-silicon TFT panels.

Compensated pixel circuits generally have shortcomings when pushing speed, pixel-pitch ("pixel density"), and uniformity to the limit, which leads to design trade-offs to balance competing demands amongst programming speed, pixel-pitch, and uniformity. For example, additional lines and transistors associated with each pixel circuit may allow for additional compensation leading to greater uniformity, yet undesirably decrease pixel-pitch. In another example, programming speed may be increased by biasing or pre-charging each pixel circuit with a relatively high biasing current or initial charge, however, uniformity is enhanced by utilizing a relatively low biasing current or initial charge. Thus, a display designer is forced to make trade-offs between competing demands for programming speed, pixel-pitch, and uniformity.

Displays configured to display a video feed of moving images typically refresh the display at a regular frequency for each frame of the video feed being displayed. Displays incorporating an active matrix can allow individual pixel circuits to be programmed with display information during a program phase and then emit light according to the display information during an emission phase. Thus, displays operate with a duty cycle characterized by the relative durations of the program phase and the emission phase. In addition, the displays operate with a frequency that is characterized by the refresh rate of the display. The refresh rate of the display can also be influenced by the frame rate of the video stream. In such displays, the display can be darkened during program phases while the pixel circuits are receiving programming information. Thus, in some displays, the display is repeatedly darkened and brightened at the refresh rate of the display. A viewer of the display can undesirably perceive that the display is flickering depending on the frequency of the refresh rate.

BRIEF SUMMARY

Aspects of the present disclosure provide systems and methods for utilizing a current divider created by a storage capacitor within a pixel circuit and a capacitance associated with a data line coupled to the pixel circuit to divide a reference current applied to the data line. The divided current simultaneously calibrates the pixel circuit and discharges the data line prior to a driving interval. Advantageously, the portion of the reference current that discharges the data line can be of a greater magnitude than the portion of the reference current that calibrates the pixel circuit. The reference current is divided according to the relative capacitance of the storage capacitor and the capacitance of the data line. In implementations where the capacitance of the data line is much greater than the capacitance of the storage capacitor, the data line is discharged quickly by a large current, while the current through a driving transistor within the pixel circuit remains small. Dividing the current in this manner simultaneously ensures that the data line is rapidly discharged and thus the pixel circuit is able to be programmed swiftly, while the current through the driving transistor is kept small to prevent the uniformity of the display from being adversely affected by the enhanced settling time.

Aspects of the present disclosure also advantageously allow for applying a reference current ("biasing current") through a data programming line rather than a separate line. Utilizing the same line for multiple purposes thus allows the pixel density to be increased and thereby increase display resolution by decreasing pixel size.

Particular pixel circuit configurations suitable for implementation are provided, but it is recognized that the present disclosure applies to current programmed pixel circuits, pixel circuits with n-type or p-type transistors, and pixel circuits in a variety of possible configurations that allow for a storage capacitor to divide a reference current that is applied to a data line to simultaneously discharge the data line while calibrating the pixel circuit. Other suitable configurations may include storage capacitors having one terminal coupled to a data line, with another terminal of the storage capacitor coupled to a current path of a driving transistor.

Aspects of the present disclosure further provide for methods of driving a display to decrease, or even eliminate, a perception of flickering in the display by increasing the refresh rate of the display. For a video stream, each frame in the video stream may be displayed more than once in order to increase the refresh rate of the display beyond the frame rate of the video stream and thereby decrease the perception of flickering experienced at the frame rate of the video. Aspects provide for implementations of the increased refresh rate in overlapping configurations where distinct portions of a display are updated sequentially during different refresh events, but all spanning a single frame time. The distinct portions can be odd and even rows of the display, or halves, thirds, etc. of the display (e.g., top and bottom halves, left and right halves, etc.).

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

FIG. 15A is a circuit diagram showing a portion of the gate driver including control lines ("CNTi") to regulate the first select lines for each segment.

FIG. 15B is a diagram of the first two gate outputs which are used to provide the first select lines for the first two segments.

Figure 1:
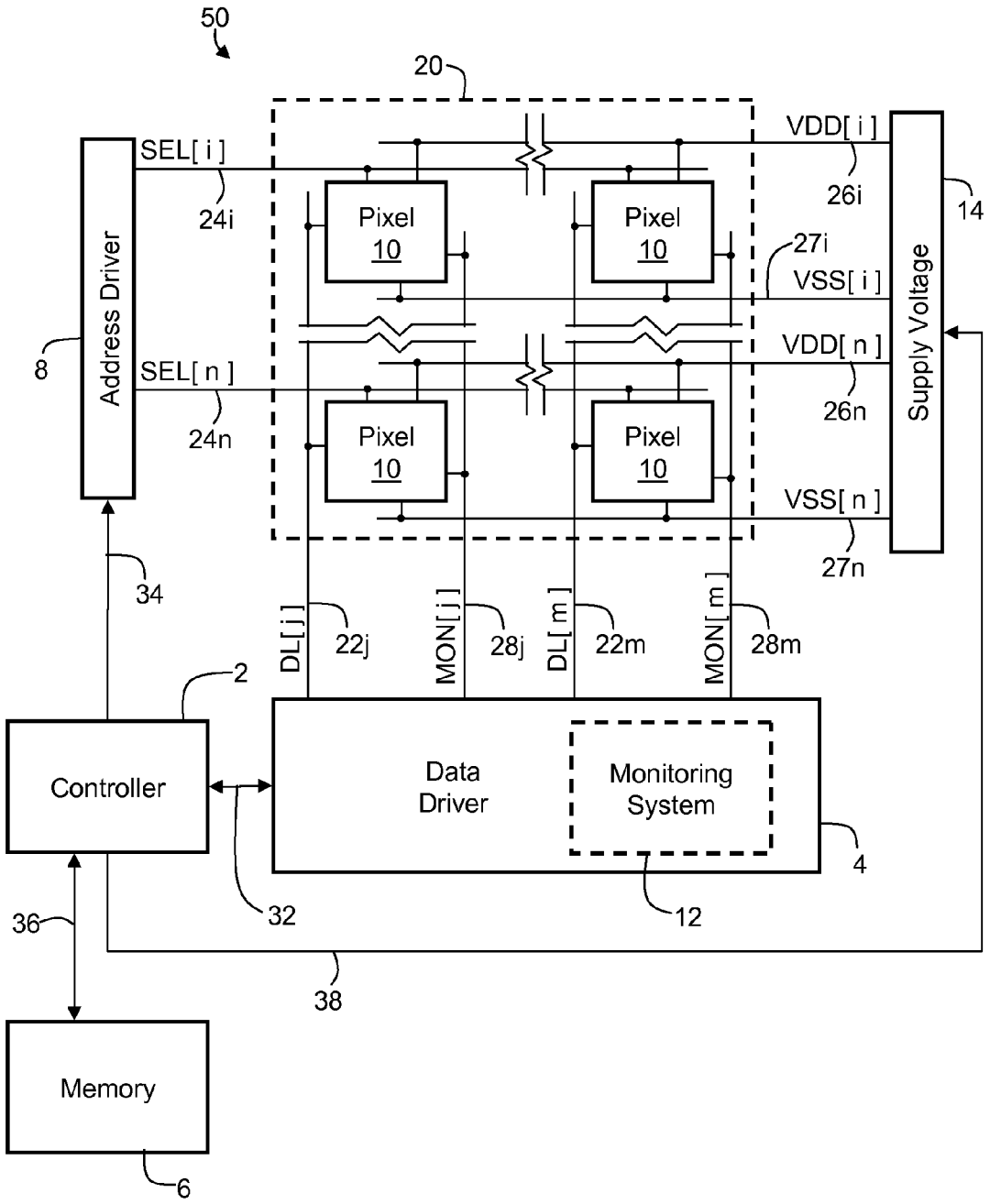
FIG. 1 is a diagram of an exemplary display system including includes an address driver, a data driver, a controller, a memory storage, and display panel.

While the present disclosure is susceptible to various modifications and alternative forms, specific embodiments and implementations have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the inventions as defined by the appended claims.

DETAILED DESCRIPTION

One or more currently preferred embodiments have been described by way of example. It will be apparent to persons skilled in the art that a number of variations and modifications can be made without departing from the scope of the invention as defined in the claims.

Embodiments of the present invention are described using a display system that may be fabricated using different fabrication technologies including, for example, but not limited to, amorphous silicon, poly silicon, metal oxide, conventional CMOS, organic, anon/micro crystalline semiconductors or combinations thereof. The display system includes a pixel that may have a transistor, a capacitor and a light emitting device. The transistor may be implemented in a variety of materials systems technologies including, amorphous Si, micro/nano-crystalline Si, poly-crystalline Si, organic/polymer materials and related nanocomposites, semiconducting oxides or combinations thereof. The capacitor can have different structure including metal-insulator-metal and metal-insulator-semiconductor. The light emitting device may be, for example, but not limited to, an OLED. The display system may be, but not limited to, an AMOLED display system.

In the description, "pixel circuit" and "pixel" may be used interchangeably. Each transistor may have a gate terminal and two other terminals (first and second terminals). In the description, one of the terminals or "first terminal" (the other terminal or "second terminal") of a transistor may correspond to, but not limited to, a drain terminal (a source terminal) or a source terminal (a drain terminal).

FIG. 1 is a diagram of an exemplary display system 50. The display system 50 includes an address driver 8, a data driver 4, a controller 2, a memory storage 6, and a display panel 20. The display panel 20 includes an array of pixels 10 arranged in rows and columns. Each of the pixels 10 are individually programmable to emit light with individually programmable luminance values. The controller 2 receives digital data indicative of information to be displayed on the display panel 20 (such as a video stream). The controller 2 sends signals 32 to the data driver 4 and scheduling signals 34 to the address driver 8 to drive the pixels 10 in the display panel 20 to display the information indicated. The plurality of pixels 10 associated with the display panel 20 thus comprise a display array ("display screen") adapted to dynamically display information according to the input digital data received by the controller 2. The display screen can display, for example, video information from a stream of video data received by the controller 2. The supply voltage 14 can provide constant power voltage(s) or can be an adjustable voltage supply that is controlled by signals 38 from the controller 2. The display system 50 can also incorporate features from a current source or sink (e.g., the current source 134 in FIG. 2B or the current source 234 in FIG. 4C) to provide biasing currents to the pixels 10 in the display panel 20 to thereby decrease programming time for the pixels 10.

For illustrative purposes, the display system 50 in FIG. 1 is illustrated with only four pixels 10 in the display panel 20. It is understood that the display system 50 can be implemented with a display screen that includes an array of similar pixels, such as the pixels 10, and that the display screen is not limited to a particular number of rows and columns of pixels. For example, the display system 50 can be implemented with a display screen with a number of rows and columns of pixels commonly available in displays for mobile devices, monitor-based devices, and/or projection-devices.

The pixel 10 is operated by a driving circuit ("pixel circuit") that generally includes a driving transistor and a light emitting device. Hereinafter the pixel 10 may refer to the pixel circuit. The light emitting device can optionally be an organic light emitting diode, but implementations of the present disclosure apply to pixel circuits having other electroluminescence devices, including current-driven light emitting devices. The driving transistor in the pixel 10 can include thin film transistors ("TFTs"), which an optionally be n-type or p-type amorphous silicon TFTs or poly-silicon TFTs. However, implementations of the present disclosure are not limited to pixel circuits having a particular polarity or material of transistor or only to pixel circuits having TFTs. The pixel circuit 10 can also include a storage capacitor for storing programming information and allowing the pixel circuit 10 to drive the light emitting device after being addressed. Thus, the display panel 20 can be an active matrix display array.

As illustrated in FIG. 1, the pixel 10 illustrated as the top-left pixel in the display panel 20 is coupled to a select line 24*i*, supply line 26*i*, 27*i*, a data line 22*j*, and a monitor line 28*j*. The first supply line 26*i* can be charged with VDD and the second supply line 27*i* can be charged with VSS. The pixel circuits 10 can be situated between the first and second supply lines to allow driving currents to flow between the two supply lines 26*i*, 27*i* during an emission cycle of the pixel circuit. The top-left pixel 10 in the display panel 20 can correspond to a pixel in the display panel in a "ith" row and "jth" column of the display panel 20. Similarly, the top-right pixel 10 in the display panel 20 represents a "ith" row and "mth" column; the bottom-left pixel 10 represents an "nth" row and "jth" column; and the bottom-right pixel 10 represents an "nth" row and "mth" column. Each of the pixels 10 is coupled to appropriate select lines (e.g., the select lines 24*i* and 24*n*), supply lines (e.g., the supply lines 26*i*, 26*n*, and 27*i*, 27*n*), data lines (e.g., the data lines 22*j* and 22*m*), and monitor lines (e.g., the monitor lines 28*j* and 28*m*). It is noted that aspects of the present disclosure apply to pixels having additional connections, such as connections to additional select lines, including global select lines, and to pixels having fewer connections, such as pixels lacking a connection to a monitoring line.

With reference to the top-left pixel 10 shown in the display panel 20, the select line 24*i* is provided by the address driver 8, and can be utilized to enable, for example, a programming operation of the pixel 10 by activating a switch or transistor to allow the data line 22*j* to program the pixel 10. The data line 22*j* conveys programming information from the data driver 4 to the pixel 10. For example, the data line 22*j* can be utilized to apply a programming voltage or a programming current to the pixel 10 in order to program the pixel 10 to emit a desired amount of luminance. The programming voltage (or programming current) supplied by the data driver 4 via the data line 22*j* is a voltage (or current) appropriate to cause the pixel 10 to emit light with a desired amount of luminance according to the digital data received by the controller 2. The programming voltage (or programming current) can be applied to the pixel 10 during a programming operation of the pixel 10 so as to charge a storage device within the pixel 10, such as a storage capacitor, thereby enabling the pixel 10 to emit light with the desired amount of luminance during an emission operation following the programming operation. For example, the storage device in the pixel 10 can be charged during the programming operation to apply a voltage to one or more of a gate or a source terminal of the driving transistor during the emission operation, thereby causing the driving transistor to convey the driving current through the light emitting device according to the voltage stored on the storage device.

Generally, in the pixel 10, the driving current that is conveyed through the light emitting device by the driving transistor during the emission operation of the pixel 10 is a current that is supplied by the first supply line 26*i* and is drained to the second supply line 27*i*. The first supply line 26*i* and the second supply line 27*i* are coupled to the voltage supply 14. The first supply line 26*i* can provide a positive supply voltage (e.g., the voltage commonly referred to in circuit design as "Vdd") and the second supply line 27*i* can provide a negative supply voltage (e.g., the voltage commonly referred to in circuit design as "Vss"). Implementations of the present disclosure can be realized where one or the other of the supply lines (e.g., the supply lines 26*i*, 27*i*) are fixed at a ground voltage or at another reference voltage. Implementations of the present disclosure also apply to systems where the voltage supply 14 is implemented to adjustably control the voltage levels provided on one or both of the supply lines (e.g., the supply lines 26*i*, 27*i*). The output voltages of the voltage supply 14 can be dynamically adjusted according to control signals 38 from the controller 2. Implementations of the present disclosure also apply to systems where one or both of the voltage supply lines 26*i*, 27*i* are shared by more than one row of pixels in the display panel 20.

The display system 50 also includes a monitoring system 12. With reference again to the top left pixel 10 in the display panel 20, the monitor line 28*j* connects the pixel 10 to the monitoring system 12. The monitoring system 12 can be integrated with the data driver 4, or can be a separate stand-alone system. Furthermore, the monitoring system 12 can optionally be implemented by monitoring the current and/or voltage of the data line 22*j* during a monitoring operation of the pixel 10, and the monitor line 28*j* can be entirely omitted. Additionally, the display system 50 can be implemented without the monitoring system 12 or the monitor line 28*j*. The monitor line 28*j* allows the monitoring system 12 to measure a current and/or voltage associated with the pixel 10 and thereby extract information indicative of a degradation of the pixel 10. For example, the monitoring system 12 can extract, via the monitor line 28*j*, a current flowing through the driving transistor within the pixel 10 and thereby determine, based on the measured current and based on the voltages applied to the driving transistor during the measurement, a threshold voltage of the driving transistor or a shift thereof. Furthermore, a voltage extracted via the monitoring lines 28*j*, 28*m* can be indicative of a degradation in the respective pixels 10 due to changes in the current-voltage characteristics of the pixels 10 or due to shifts in the operating voltages of light emitting devices situated within the pixels 10.

The monitoring system 12 can also extract an operating voltage of the light emitting device (e.g., a voltage drop across the light emitting device while the light emitting device is operating to emit light). The monitoring system 12 can then communicate the signals 32 to the controller 2 and/or the memory 6 to allow the display system 50 to store the extracted degradation information in the memory 6. During subsequent programming and/or emission operations of the pixel 10, the degradation information is retrieved from the memory 6 by the controller 2 via the memory signals 36, and the controller 2 then compensates for the extracted degradation information in subsequent programming and/or emission operations of the pixel 10. For example, once the degradation information is extracted, the programming information conveyed to the pixel 10 during a subsequent programming operation can be appropriately adjusted such that the pixel 10 emits light with a desired amount of luminance that is independent of the degradation of the pixel 10. For example, an increase in the threshold voltage of the driving transistor within the pixel 10 can be compensated for by appropriately increasing the programming voltage applied to the pixel 10.

As will be described further herein, implementations of the current disclosure apply to systems that do not include separate monitor lines for each column of the display panel 20, such as where monitoring feedback is provided via a line used for another purpose (e.g., the data line 22*j*), or where compensation is accomplished within each pixel 10 without the use of an external compensation system, or to combinations thereof.

Figure 2A:
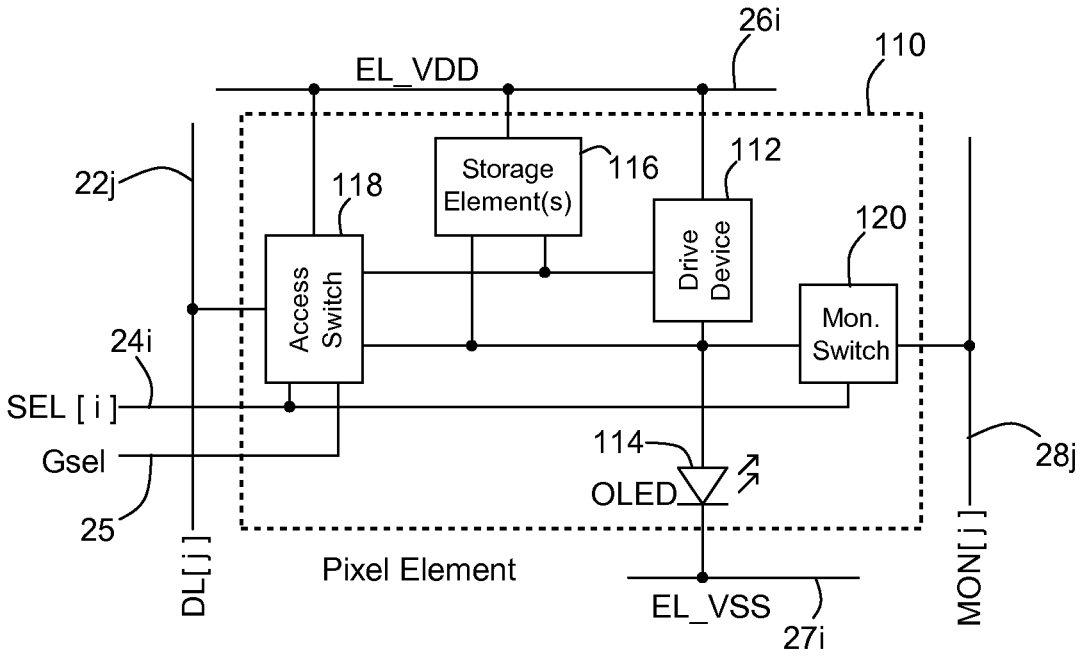
FIG. 2A is a block diagram of an example pixel circuit configuration for a display that incorporates a monitoring line.

FIG. 2A is a block diagram of an example pixel circuit configuration 110 for the display system 50 that incorporates the monitoring line 28*j*. As discussed above, TFTs fabricated in poly-silicon tend to demonstrate non-uniform behavior across a display panel (e.g., the display panel 20) and over time (e.g., over a display's operating life time). Compensation techniques to achieve image uniformity in poly-silicon TFT panels, as well as other TFT materials (e.g., amorphous silicon, etc.), are provided herein.

In some display systems, the general functionality of compensation techniques relies on the application of a uniform reference current to the pixel circuit. The reference current is used to develop a gate-to-source voltage on the TFT drive device. This voltage is a function of threshold, mobility, and other parameters across panel, time and temperature variations. The developed voltage is stored on the storage element which is then used as a calibration factor to provide programming to the pixel. During the programming of the pixel in each frame, programming data is modified according to the calibration factor stored in the storage element. As a result, real-time compensation for parameter variations in the TFT drive device can be achieved, but each programming operation must be preceded by the compensation operation to first generate the calibration factor and store it in the storage element. Such compensated pixel circuits thus have some shortcoming when pushing the programming speed, pixel density, and uniformity to their respective limits, and a display designer is therefore required to make design choices. Modified techniques and driving schemes are presented in this disclosure to tackle the challenges of compensation method(s) requiring such design trade-offs.

The pixel circuit 110 of FIG. 2A features a dedicated monitor line 28*j* and a monitor switch 120 to apply the reference current to the selected pixel out of a vertical column of pixels (e.g., the pixels in the "jth" column) on the panel 20. The voltage on the voltage supply line 26*i* ("$V_{DD}$") is toggled low to $V_{DDL}$ by the voltage supply 14 during the programming cycle to avoid interference from the light emitting device 114 ("OLED"). For example, by setting $V_{DDL}$ to a level sufficient to turn off the OLED 114, the programming operation can be carried out without emitting light from the OLED 114.

FIG. 2A illustrates a block diagram of a pixel circuit 110, which can be implemented as the pixel 10 in the display system 50 shown in FIG. 1. The pixel circuit 110 includes a drive device 112, which can be a drive transistor, a storage element 116, which can be a storage capacitor, an access switch 118, which can be a switch transistor, and a monitor switch 122. The drive transistor 112 conveys a driving current to the light emitting device 114 ("OLED") according to a programming voltage stored on the storage capacitor 116 and applied to the gate and/or source terminals of the drive transistor 112. The programming voltage is developed on the storage capacitor 116 by selectively connecting one and/or both terminals of the storage capacitor 116 to the data line 22*j* via the switch transistor 118. The switch transistor 118 is operated according to the select line 24*i* and/or the emission line 25, which can be a global select line that is shared by pixels in more than one row of the display array 20.

Figure 2B:
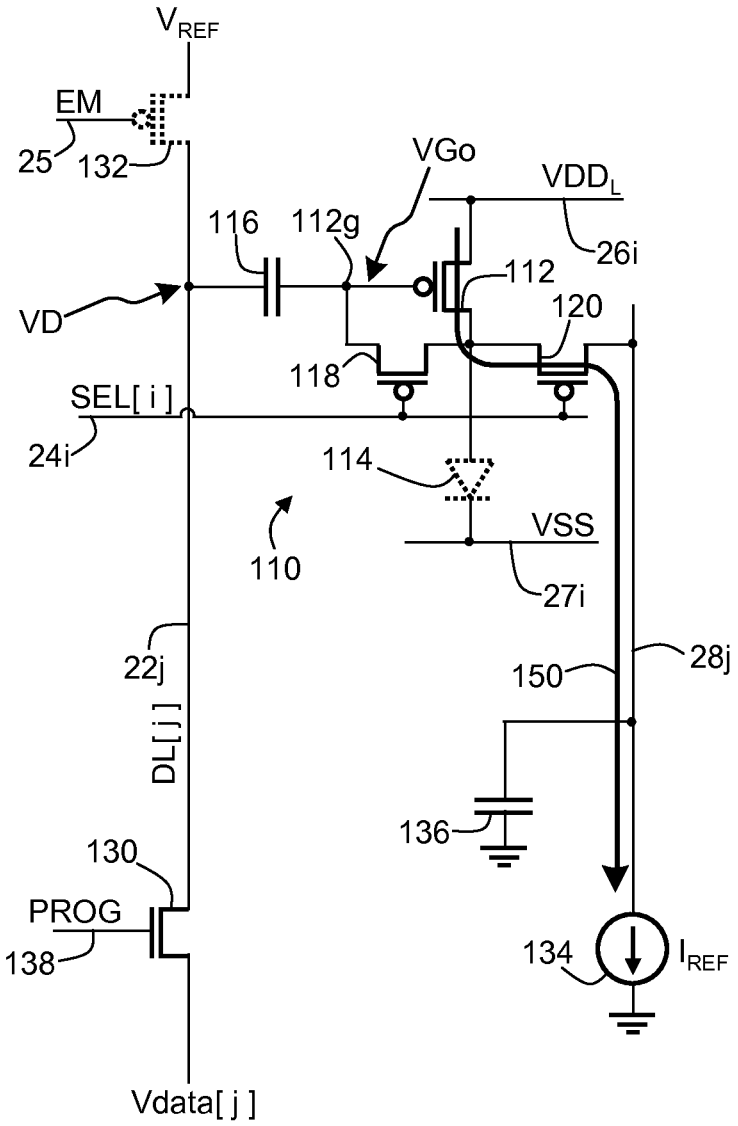
FIG. 2B is a circuit diagram including a pixel circuit for a display that is labeled to illustrate a current path during a program phase of the pixel circuit.

FIG. 2B is a circuit diagram including an exemplary implementation of the pixel circuit 110 represented by the block diagram in FIG. 2A. The circuit diagram in FIG. 2B is labeled with an arrow 150 to illustrate a current path through the pixel circuit 110 during a programming cycle 160. Similarly, the circuit diagram in FIB. 2C is labeled with an arrow 154 to illustrate a current path through the pixel circuit 110 during an emission cycle 164. Transistors illustrated in the circuit diagrams in FIGS. 2B and 2C which are turned off during the respectively illustrated operation cycles are illustrated with hashed marks to indicate they are turned off. A timing diagram illustrating the programming cycle 150 and emission cycle 160 is provided in FIG. 2D. The pixel circuit 110 illustrated in FIGS. 2B and 2C will thus be described in connection with the timing diagram in FIG. 2D.

As shown by the arrow 150 in FIG. 2B, the reference current "($I_{REF}$") flows directly through the drive device 112 ("drive transistor") which can be, for example, a poly-silicon TFT. As a result of the application of the reference current $I_{REF}$, a voltage is developed on the gate terminal of the drive transistor 112 given by equation 1:

$$V_{Go} = V_{DDL} - V_{th} - \sqrt{\frac{I_{ref}}{K}} \tag{1}$$

where K is the current factor of the drive TFT 112 which is a function of mobility (μ), unit gate oxide ($C_{ox}$), and the aspect ratio of the device (W/L), as shown in equation 2:

$$K = \frac{1}{2}\mu C_{ox}\frac{W}{L} \tag{2}$$

The voltage on the gate terminal (i.e., the gate voltage) on the drive transistor 112 also sets the voltage on one side of the storage element 116 ("storage capacitor $C_S$"). As shown in FIG. 2B, the gate node 112*g*, which is directly connected to both the gate terminal of the drive transistor 112 and one terminal of the storage capacitor 116, is labeled as having $V_{Go}$. Meanwhile, during the programming cycle 150, the other side ("second terminal") of the storage capacitor 116 is set to the desired data voltage, $V_D$, which is a representative of the grayscale luminance level to be programmed. The data voltage $V_D$ is programmed through the data line 22*j* by an output channel of the source driver 4. At the end of the programming cycle 150, the voltage stored on the storage capacitor 116 is given by equation 3:

$$V_C = V_D - V_{Go} \tag{3}$$

Figure 2C:
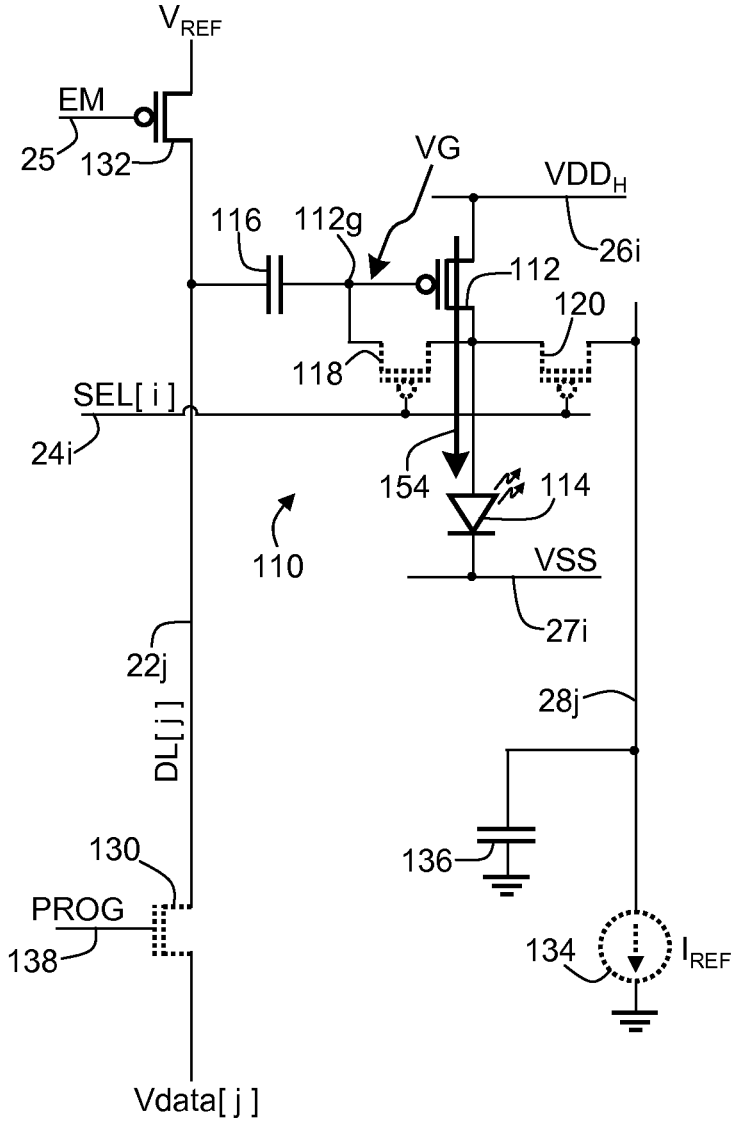
FIG. 2C is a circuit diagram of the circuit shown in FIG. 2A, which is labeled to illustrate a current path during an emission phase of the pixel circuit.
Figure 2D:
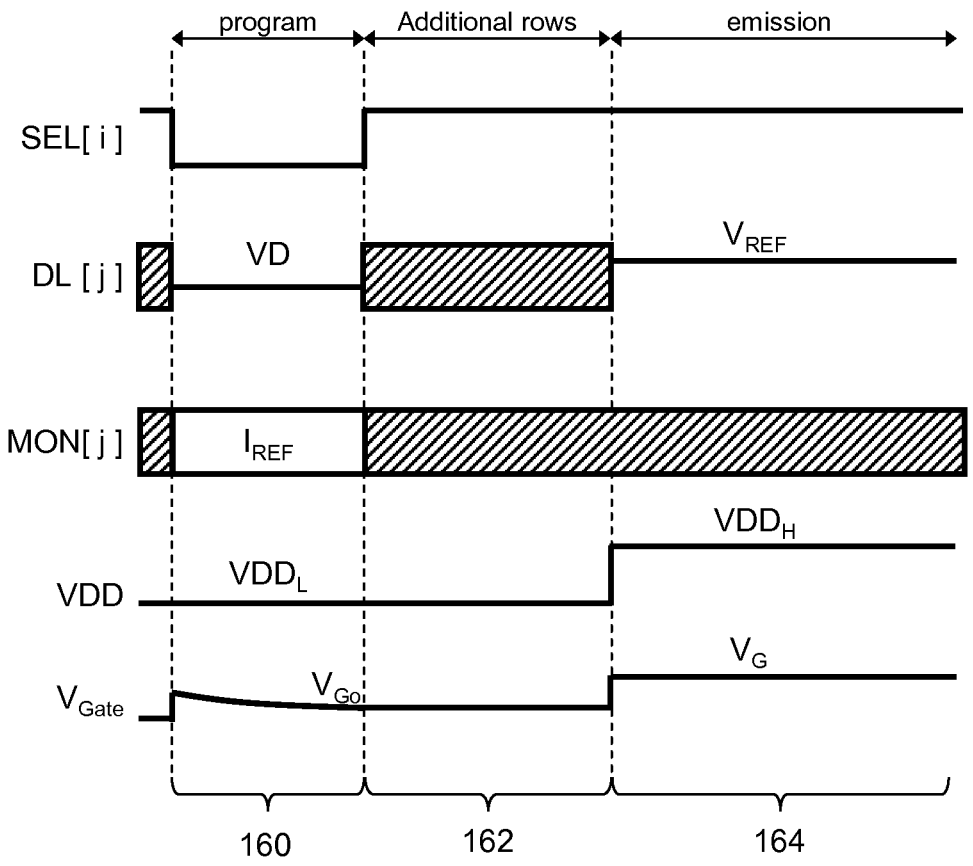
FIG. 2D is a timing diagram illustrating a programming and emission operation of the pixel circuit shown in FIGS. 2B and 2C.

Once the programming cycle 150 is completed the select transistor 118 and the monitor switch transistor 120 are deactivated by setting the select line 24*i* to a high level. An additional period 152 can then elapse while other rows (e.g., the "nth" row selected by the select line 24*n*) in the display panel 20 are programmed. An emission cycle 154 can then be commenced once all rows are programmed. Additionally or alternatively, the emission cycle 154 can be commenced once each individual row is programmed without waiting for other rows to be programmed during the period 152. In the emission phase 154 the data line 22*j* is isolated from the source driver 6 and connected to a reference voltage $V_{REF}$. As shown in FIGS. 2B and 2C, isolating the data line 22*j* can be accomplished by coupling the data line 22*j* to the source driver 6 via a programming switch 130 operated according to a programming signal ("Prog") conveyed on a programming line 138. The reference voltage $V_{REF}$ can then be supplied to the data line 22*j* via a switch transistor 132 operated according to an emission signal ("EM") conveyed on an emission control line 25. One or both of the emission control line 25 and the programming line 138 can be implemented as global signals to simultaneously control the connections to the data line 22*j* across the entire display panel 20, or to portions thereof. Upon coupling the data line 22*j* to the reference voltage $V_{REF}$, the new gate voltage of the drive transistor 112 during the emission phase 154 is given by equation 4:

$$V_G = V_{REF} - V_C \tag{4}$$

Also, the voltage on the supply voltage line 26*i* is toggled to $V_{DDH}$, which can be considered an operating voltage of the supply voltage line 26*i* which is sufficient to turn the OLED 114 on. Accordingly, the gate-source voltage of the drive transistor 112 is given by equation 5:

$$|V_{GS}| = V_{DDH} - V_G = V_{DDH} - V_{REF} + V_D - V_{DDL} + V_{th} + \sqrt{\frac{I_{ref}}{K}} \tag{5}$$

By defining a program voltage $V_P$ as follows in equation 6:

$$V_P \triangleq V_D + V_{DDH} - V_{DDL} - V_{REF} \tag{6}$$

the equation for gate-source voltage of the drive TFT 112 is simplified, as shown in equation 7:

$$|V_{GS}| = V_P + V_{th} + \sqrt{\frac{I_{ref}}{K}} \tag{7}$$

Accordingly, the pixel drive current is given by equation 8:

$$I_d = K(V_{GS} - V_{th})^2 = K \cdot \left(V_P + \sqrt{\frac{I_{ref}}{K}}\right)^2 \tag{8}$$

Equation 8 confirms that the above described compensation technique eliminates the first order effects of the threshold voltage variations from the drive current.

Figure 3A:
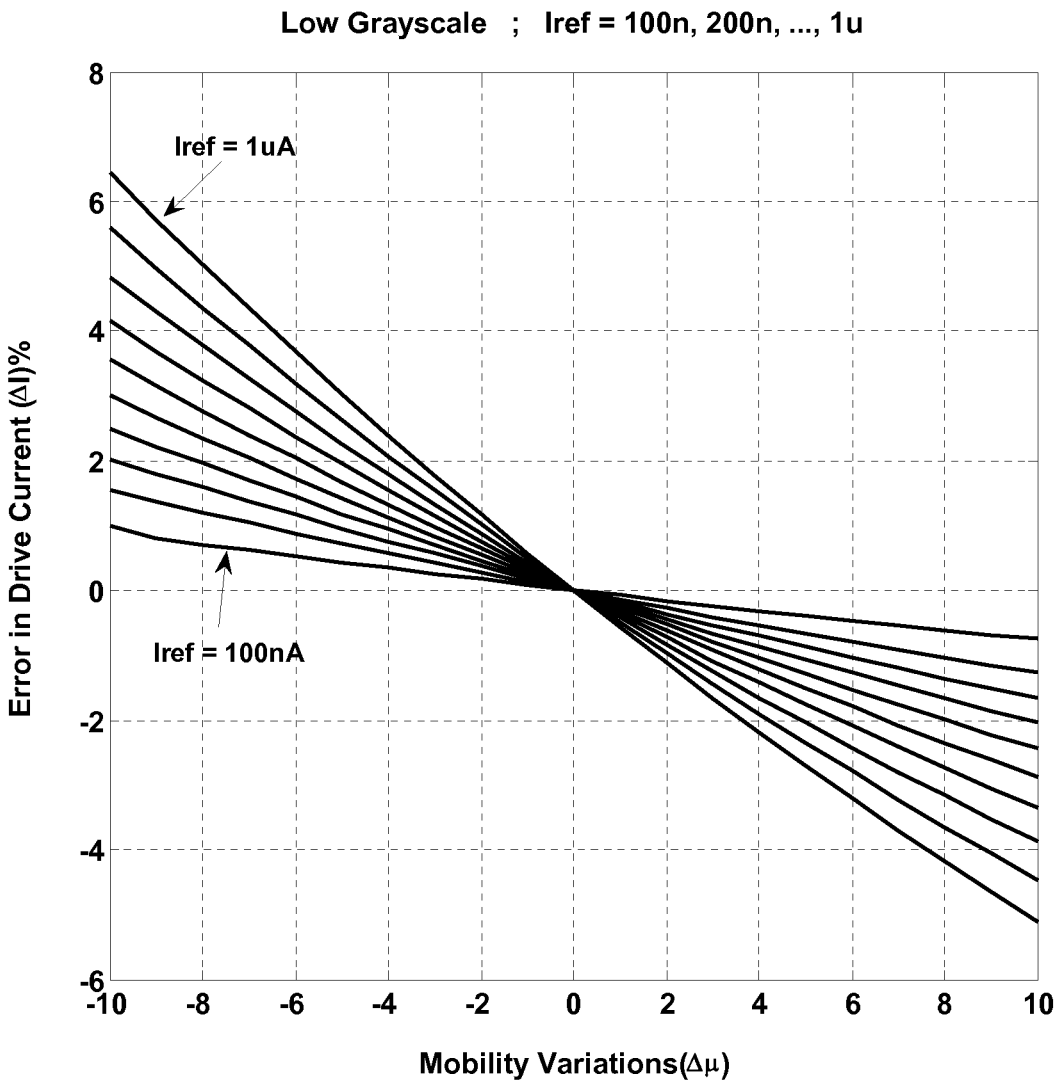
FIG. 3A illustrates a graph of simulation results for drive current error versus mobility variations at low grayscale programming values.
Figure 3B:
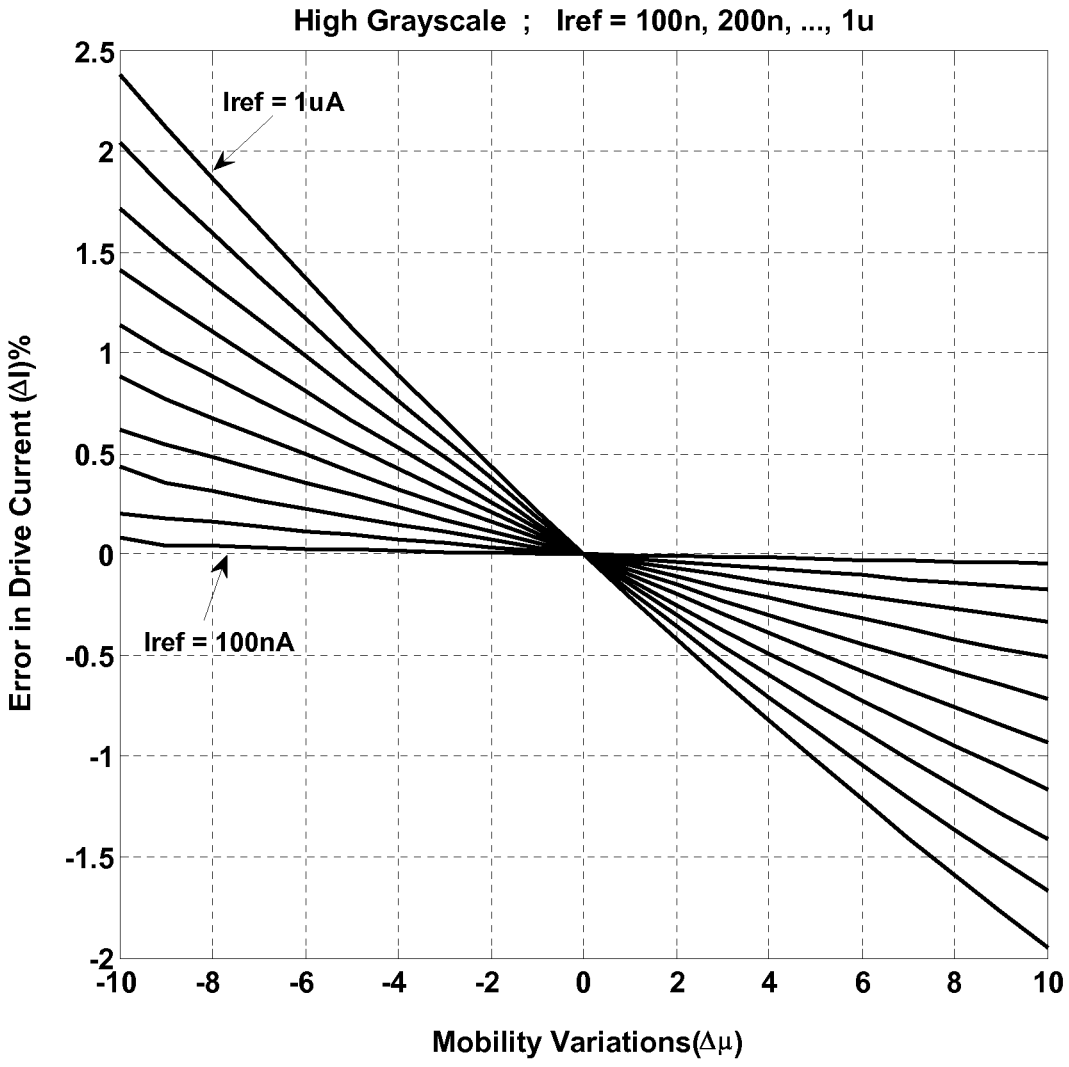
FIG. 3B illustrates a graph of simulation results for drive current error versus mobility variations at high grayscale programming values.

FIG. 3A illustrates a graph of simulation results for drive current error versus mobility variations at low grayscale programming values. FIG. 3B illustrates a graph of simulation results for drive current error versus mobility variations at high grayscale programming values. The effectiveness of the compensation for mobility variations is affected by the amount of the reference current $I_{REF}$. The compensation in both low and high grayscale levels, as shown in FIG. 3A and FIG. 3B, respectively, is more effective when a lower value of the reference current is utilized. Accordingly, to realize effective compensation across the display panel 20, a low reference current is preferred.

With reference to FIGS. 2B and 2C, the monitor line 28*j* introduces a significant parasitic capacitance 136 to the signal path of the reference current $I_{REF}$. Accordingly, a large value of the reference current $I_{REF}$ is sought so as to achieve fast settling time. Therefore, in the compensation techniques described in reference to FIGS. 2A-2D, there is a trade-off between achievable uniformity and settling time when designing for a particular value of the reference current $I_{REF}$. When the pixel circuit is pushed towards very high PPI (pixel per inch) applications, tackling this design trade-off becomes more challenging because of the very tight area restrictions. A two cycle programming including a precharging cycle 160*a*, 161*a* and an adjustment cycle 160*b*, 161*b* is discussed below which can improve the effectiveness of compensation. The two cycle programming techniques are illustrated by the timing diagrams in FIGS. 2E and 2F, respectively. The modified compensation techniques disclosed next break the speed-uniformity trade-off and are fully compatible with available industry standards and driver components. These techniques therefore offer a significant performance improvement which can be implemented without substantial fabrication modifications that require extensive capital investments.

Figure 2E:
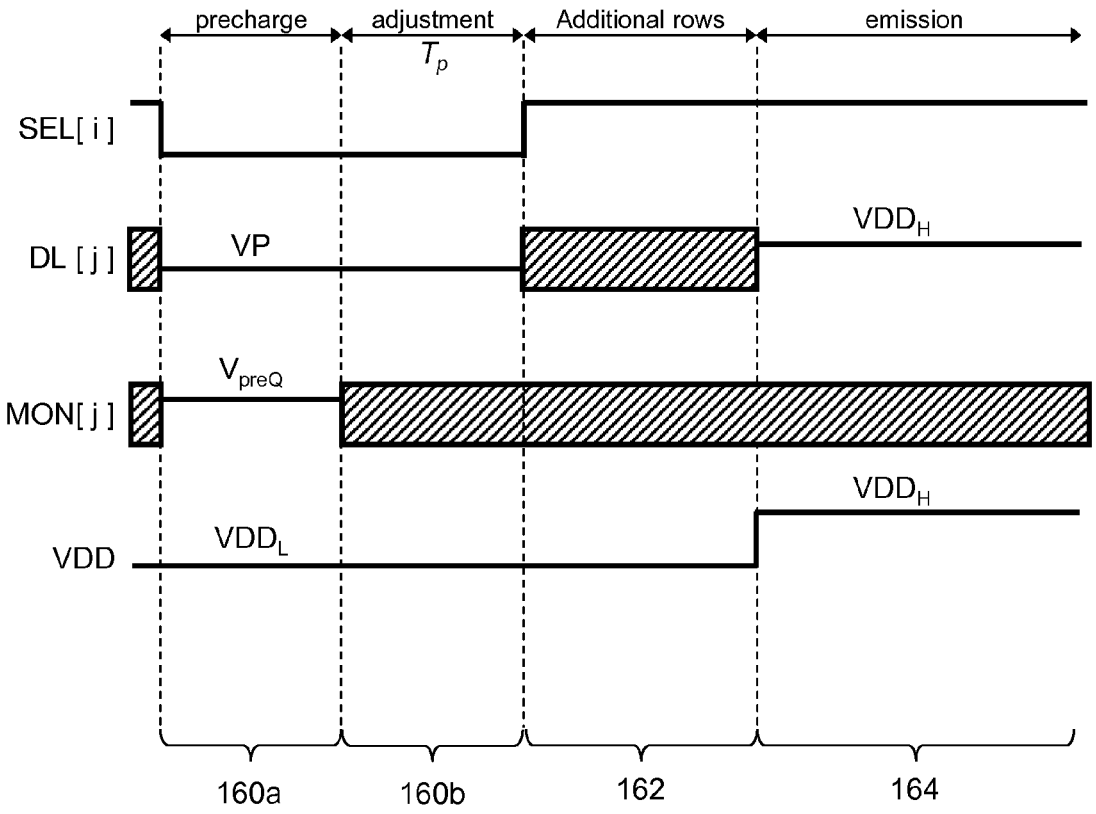
FIG. 2E is an alternate timing diagram for the pixel circuit in FIGS. 2B and 2C which includes a voltage pre-charge cycle.
Figure 2F:
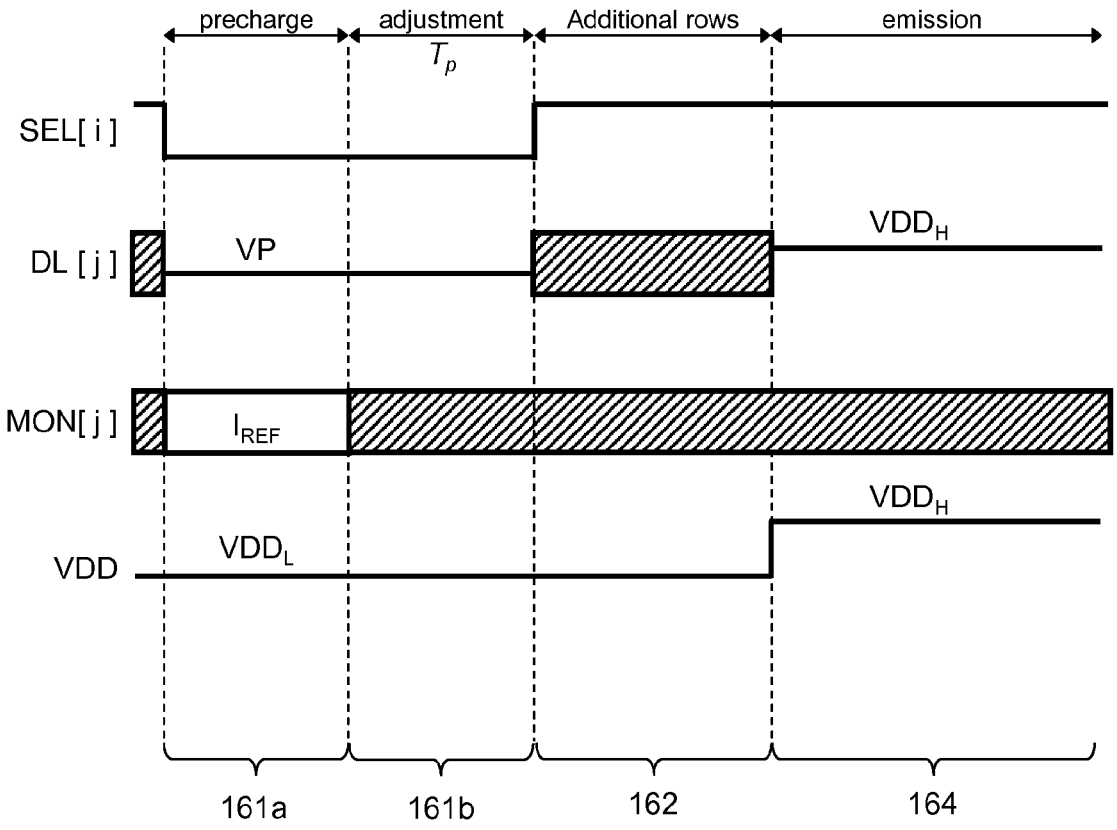
FIG. 2F is another alternate timing diagram for the pixel circuit in FIGS. 2B and 2C which includes a current pre-charge cycle.

One approach of implementing a two-phase compensation technique is to precharge the capacitance 136 of the monitor line 28*j* during a pre-charging cycle 150*a* and then allow some time ($T_p$) for the drive transistor 112 to adjust the voltage on the data line 22*j* during an adjustment cycle 160*b*. The monitor switch transistor 120 can disconnect the monitor line 28*j* from the pixel circuit 110 during the adjustment cycle 160*b*. The timing diagram in FIG. 2E illustrates the voltage precharging approach to pre-charge the capacitance 136. The precharging can be accomplished by setting the voltage on the monitor line 28*j* to a constant value $V_{PreQ}$. In this case, it can be shown that the drive current is given by equation 9:

$$I_D = K \cdot \left(V_P + \frac{V_{DD} - V_{th} - V_{preQ}}{1 + \frac{T_p}{\tau}}\right)^2 \tag{9}$$

where $T_p$ is the adjustment time, $V_P$ is the program voltage and $\tau$ is the time constant of the charge path through the drive device. The time constant $\tau$ is given by equation 10:

$$\tau = \frac{2C_L}{g_{mo}} \tag{10}$$

in which $g_{mo}$ is the transconductance of the drive transistor 112 given by equation 11:

$$g_{mo} = 2K \cdot (V_{DD} - V_{preQ} - V_{th})$$

The design flexibility introduced by this technique to precharge the monitor line 28*j* with a voltage $V_{preQ}$ provides an extra degree of freedom for designers that can be used to at least partially offset the effect of variations in $V_{th}$. However, unlike the drive current described by equation 8, the drive current according to equation 9 is still a function of both the threshold voltage $V_{th}$ and mobility $\mu$ which undesirably decreases the effectiveness of the compensation.

Another alternative is to precharge the monitor line 28*j* by applying a relatively high reference current $I_{REF}$ to the monitor line 28*j* such that the settling requirement is achieved in spite of the parasitic capacitance 136 of the monitor line 28*j*. As illustrated by the timing diagram in FIG. 2F, which illustrates the current pre-charging technique, the reference current $I_{REF}$ can be applied during a pre-charging cycle 161*a*. Then, the reference current $I_{REF}$ is removed from the monitor line 28*j* and the drive device 112 is allowed to adjust the voltage on the data line 22*j* during an adjustment cycle 161*b*.

In an implementation, the monitor switch transistor 120 can disconnect the monitor line 28*j* from the pixel circuit 110 during the adjustment cycle 151*b*. In this case, it can be shown that the drive current is given by equation 12:

$$I_D = K \cdot \left( V_P + \frac{\sqrt{\frac{I_{REF}}{K}}}{1 + \frac{T_p}{\tau}} \right)^2 \tag{12}$$

where τ is defined similar to equation 10, but with the tranconductance $g_m$ of the drive transistor 112 given by equation 13:

$$g_m = \sqrt{K \cdot I_{REF}} \tag{13}$$

Accordingly, it is evident that utilizing a reference current $I_{REF}$ to precharge the parasitic capacitance 136 of the monitor line 28*j* makes the pixel drive current independent of the threshold voltage. Therefore, design challenges are reduced to optimizing for compensation of mobility variations only.

Figure 4A:
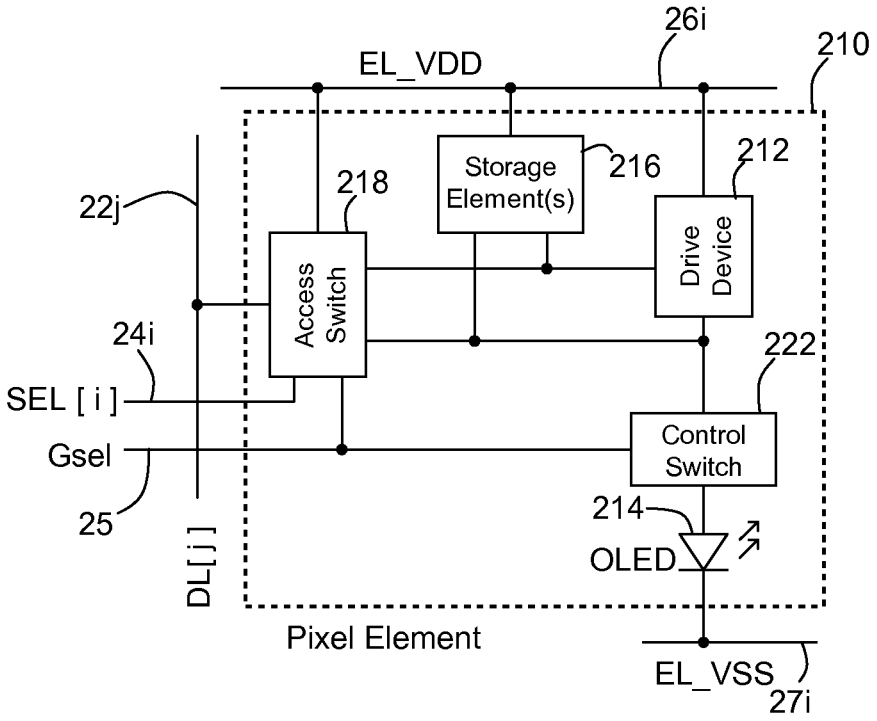
FIG. 4A is a block diagram of another example pixel circuit for a display.

FIG. 4A illustrates a block diagram of a pixel circuit 210, which can be implemented as the pixel 10 in the display system 50 shown in FIG. 1. The pixel circuit 210 includes a drive device 212, which can be a drive transistor, a storage element 216, which can be a storage capacitor, an access switch 218, which can be a switch transistor, and a control switch 222. The drive transistor 212 conveys a driving current to the light emitting device 214 ("OLED") according to a programming voltage stored on the storage capacitor 216. The programming voltage is applied to the gate and/or source terminals of the drive transistor 212 to control the driving current. The programming voltage is developed on the storage capacitor 216 by selectively coupling a first terminal of the storage capacitor 216 to a second terminal of the drive transistor 212 via the switch transistor 218. The second terminal of the storage capacitor 216 is coupled to a data line 22*j*. A gate terminal of the drive transistor 212 is coupled to the first terminal of the storage capacitor 216 at a gate node 212*g*, and the first terminal of the drive transistor 212 is connected to the voltage supply line 26*i*. The switch transistor 218 is operated according to the select line 24*i* and/or the emission line 25, which can be a global select line that is shared by pixels in more than one row of the display array 20. The emission transistor 222 is controlled by the emission line 25 to be turned on during an emission cycle 266 of the pixel circuit 210, and to disconnect the light emitting device 214 from the drive transistor 212 during periods other than the emission cycle 266.

Figure 4B:
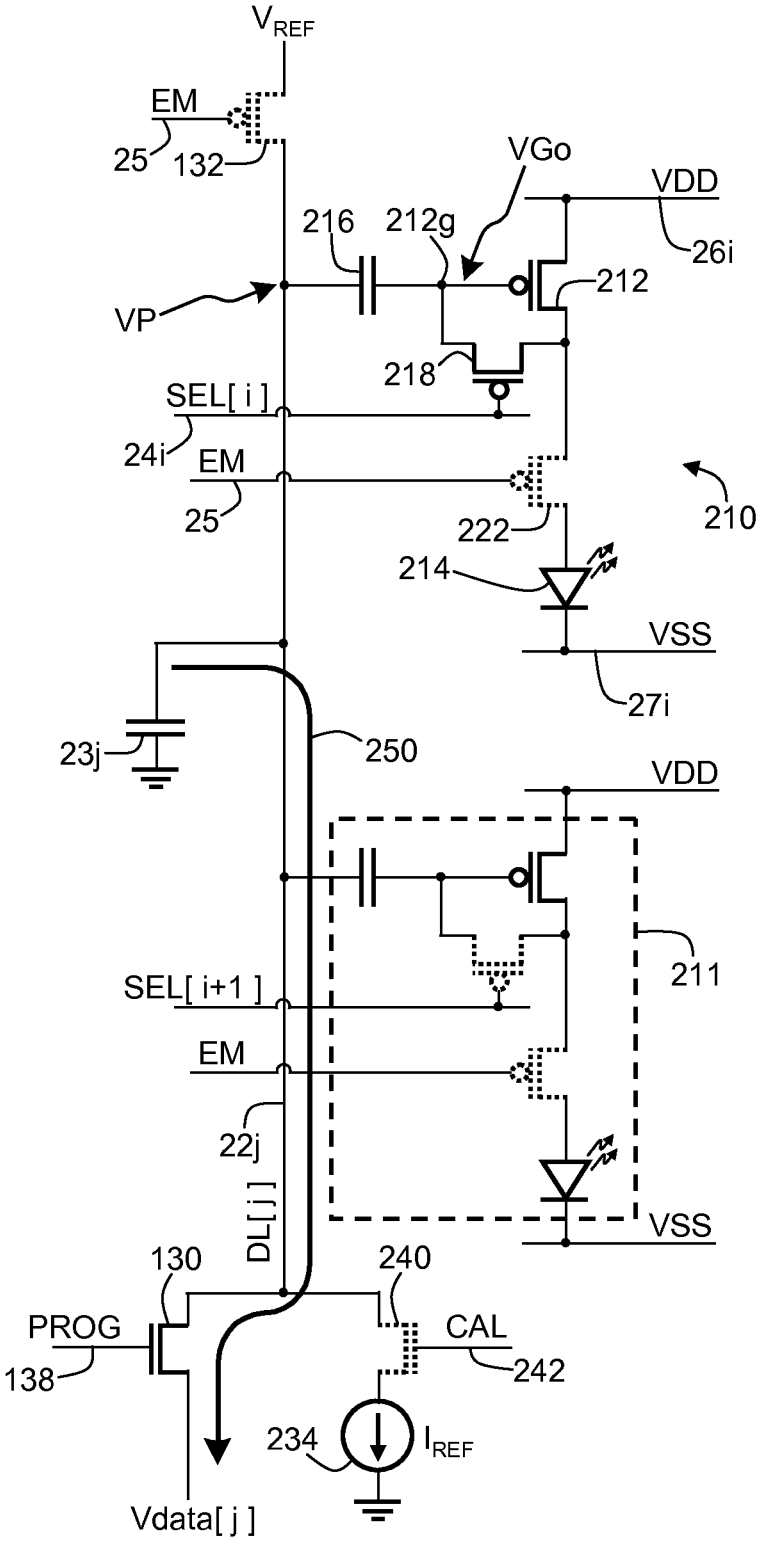
FIG. 4B is a circuit diagram including a pixel circuit for a display that is labeled to illustrate a current path during a pre-charge phase of the pixel circuit.
Figure 4C:
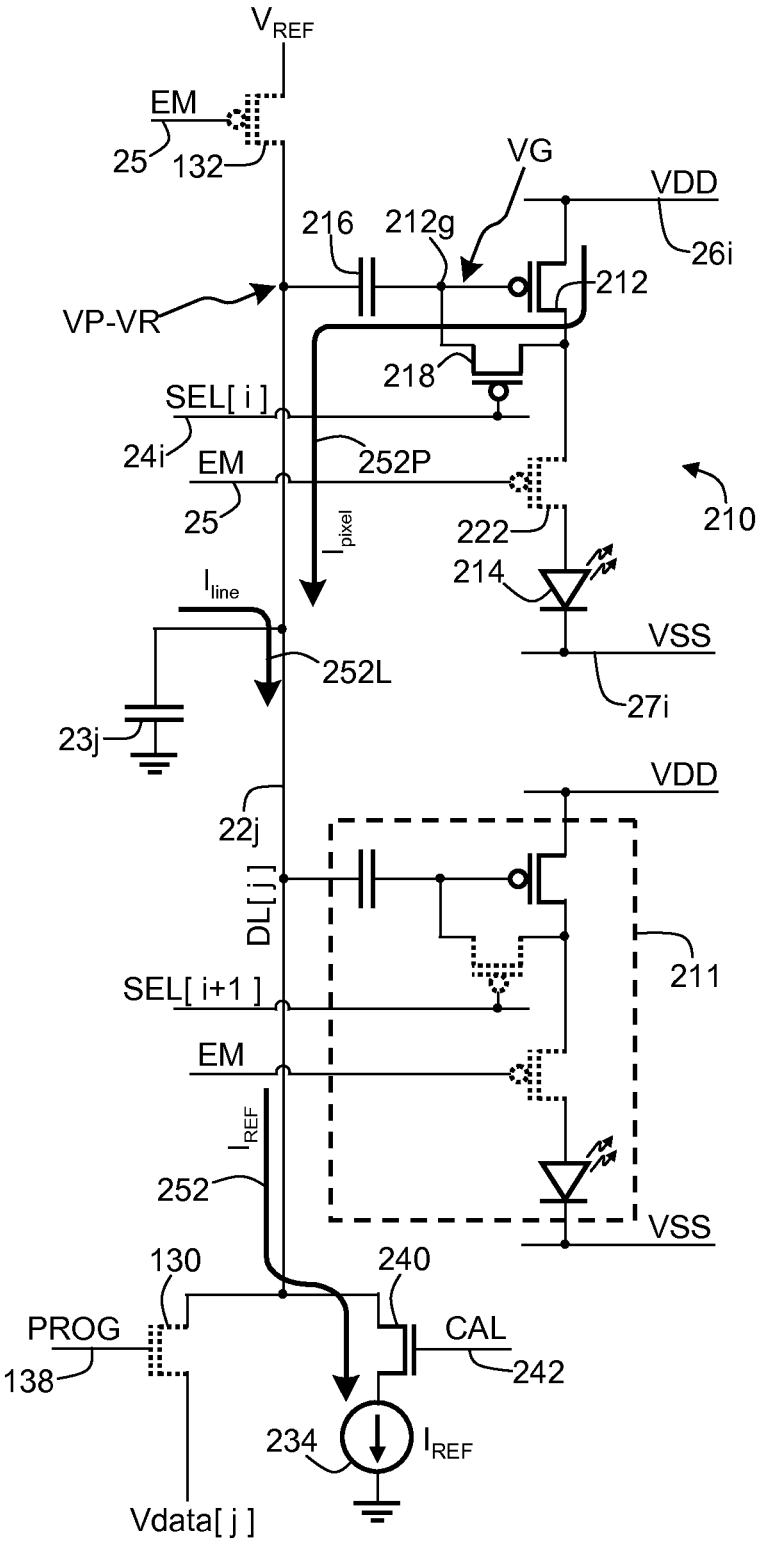
FIG. 4C is a circuit diagram of the circuit shown in FIG. 4B, which is labeled to illustrate a current path during a program phase of the pixel circuit.
Figure 4D:
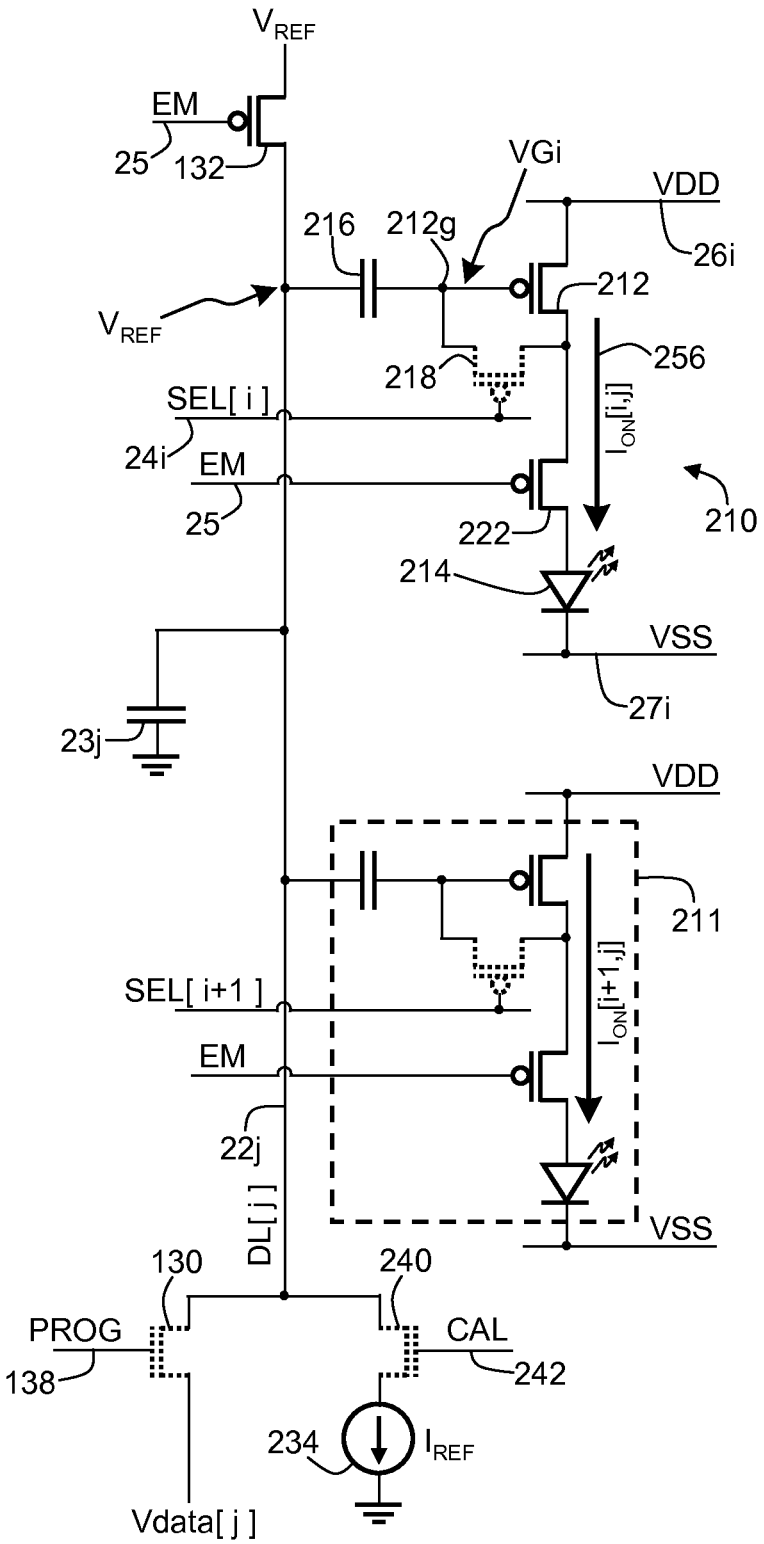
FIG. 4D is a circuit diagram of the circuit shown in FIG. 4B, which is labeled to illustrate a current path during an emission phase of the pixel circuit.
Figure 4E:
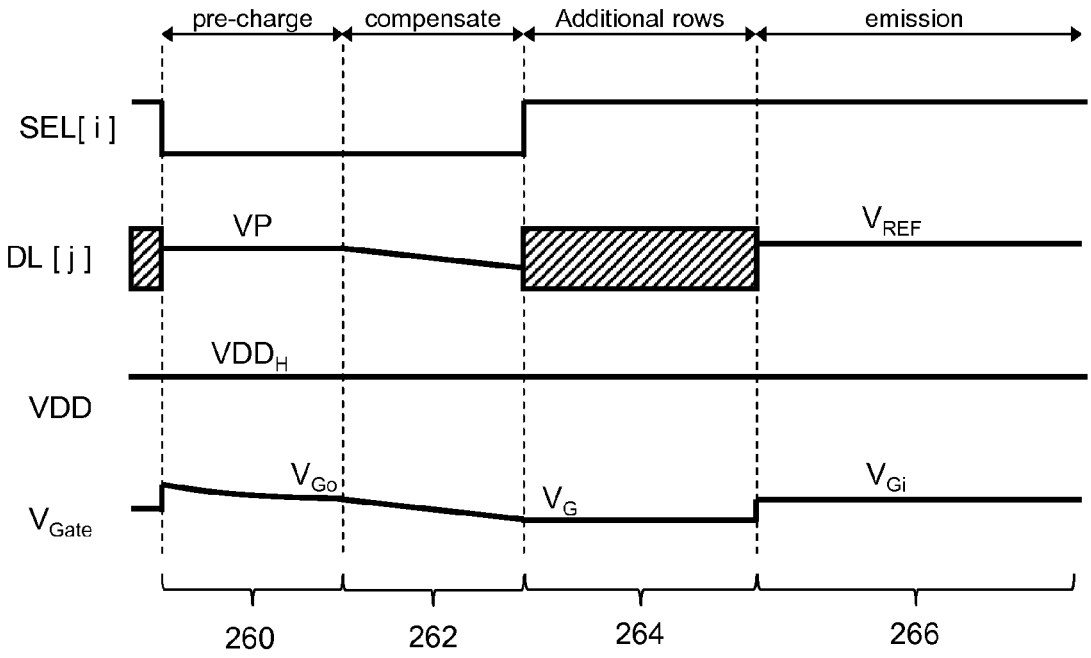
FIG. 4E is a timing diagram illustrating pre-charging, compensation, and emission cycles of the pixel shown in FIGS. 4B-4D.
Figure 4F:
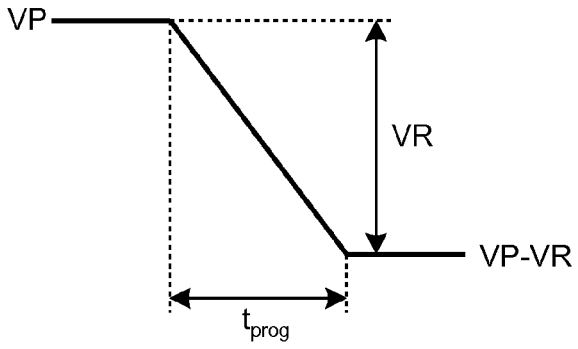
FIG. 4F is a timing diagram illustrating the change in voltage on the data line during the compensation phase shown schematically in FIG. 4C.

FIG. 4B illustrates an exemplary circuit diagram for the pixel circuit 210, which is labeled with an arrow 250 to show the current path through the pixel during a pre-charging cycle 260 of the pixel circuit. FIG. 4C illustrates the pixel circuit 210 shown in FIG. 4B, but labeled with arrows 252, 252L, and 252P to show the current path through the pixel during a compensation cycle 262 following the pre-charging cycle 260. FIG. 4D illustrates the pixel circuit 210 shown in FIG. 4A, but labeled with an arrow 256 to show the current path through the pixel during an emission cycle 266. Transistors illustrated in the circuit diagrams in FIGS. 4B to 4D which are turned off during the respectively illustrated operation cycles are illustrated with hashed marks to indicate they are turned off. FIG. 4E illustrates a timing diagram illustrating the operation of the pixel 210 during the pre-charging, compensation, and emission cycles 260, 262, 266. FIG. 4F provides an enhanced view of the voltage level on the data line 22*j* during the compensation cycle 262. Accordingly, the features illustrated by FIGS. 4A-4F will be described jointly below.

In the pixel circuit 210 shown in FIG. 4A, a reference current $I_{REF}$ is applied through the data line 22*j* which introduces several advantages relative to the pixel circuit 110 shown in FIG. 2A. In particular, in comparing the pixel circuit 210 of FIG. 4A, with the pixel circuit 110 of FIG. 2A, it is evident that the dedicated monitor line 28*j* and monitor switch 120 are eliminated in the pixel circuit 210. Hence, a considerable amount of area is freed up on the display panel 20 which enables very high density pixel layout. Also, in the pixel circuit 210, a control switch 222 is placed in series with the OLED 214 to eliminate the need for toggling the voltage of the supply voltage line 26*i* during the programming phase. In the pixel circuit 110 shown in FIG. 2A, which lacks the additional control switch, the voltage of the supply voltage line 26*i* (or the supply voltage line 27*i*) is toggled to a low voltage (or high voltage) during the programming cycle 150 to prevent the OLED 114 from emitting light during programming.

In the exemplary pixel circuit 210 illustrated in FIGS. 4B to 4D, the gate terminal of the drive transistor 212 is directly coupled to a first terminal of the storage capacitor 216 at a gate node 212*g*. The second terminal of the storage capacitor 216 is coupled to the data line 22*j*. The switch transistor 218 is connected between the gate node 212*g* and a second terminal (e.g., a drain terminal) of the drive transistor 212 while the first terminal (e.g., a source terminal) of the drive transistor 212 is coupled to the voltage supply line 26*i*.

The three-cycle operation of the compensation technique is illustrated in FIGS. 4B through 4D, which are labeled with arrows to show current paths in each cycle, and transistors are shown hashed to indicate they are turned off. In this example, an emission transistor 222 situated in series with the OLED 214 turns the OLED 214 off during the pre-charging and compensation cycles 260, 262. In an example frame, operation begins with a precharge cycle 260. The emission line 25 is set high to keep the emission transistor 222 turned off. The emission line 25 is also coupled to a switch transistor 132 to keep the data line 22*j* disconnected from a reference voltage source during the pre-charging and programming cycles 260, 262. A desired row, such as the "ith" row is selected by setting the select line 24*i* low, which turns on the switch transistor 218, and the data line 22*j* is precharged to the given program voltage, $V_p$. The arrow 250 illustrates the current flow during the pre-charging cycle 260 to charge the capacitance 23*j* of the data line 22*j*. Simultaneously, because the select transistor 218 is turned on, current flows through the drive transistor 212 until the gate-source voltage of the drive transistor 212 settles at a level sufficient to turn off the drive transistor 212. At the end of the pre-charging cycle 260, the voltage that is developed on the gate terminal of the drive transistor 212 (i.e., at the gate node 212*g*) is given by equation 14:

$$VGo \approx VDD - |Vth| \tag{14}$$

During the compensation cycle 262, a reference current $I_{REF}$ is applied to the data line 22*j*. The pixel circuit 210 advantageously allows the reference current $I_{REF}$ to not flow directly through the drive transistor 212 of the pixel circuit 210. Instead, as will be described in reference to FIG. 4C, only a small portion ($I_{pixel}$) of the reference current $I_{REF}$ passes through the storage capacitor 216 and the drive transistor 212. A larger portion ($I_{line}$) of the reference current $I_{REF}$ is utilized to charge/discharge the capacitance 23*j* of the data line 22*j*. Accordingly, a pixel circuit is realized providing both good compensation and fast settling concurrently ("simultaneously"). The reference current $I_{REF}$ is thus divided between the data line 22*j* and the driving transistor 212 by the configuration of the respective capacitances of the storage capacitor 216 and the capacitance 23*j* associated with the data line 22*j*.

FIG. 4C is labeled with arrows 252, 252L, 252P to illustrate a current path during the compensation cycle 262 of the pixel circuit 210. In the compensation cycle 262, the data switch transistor 130 is turned off by the program signal ("Prog") conveyed on the program line 138 and the reference current $I_{REF}$ is applied to the data line 22*j* by the current source 234. $I_{REF}$ is divided into two components: $I_{line}$ which discharges the capacitance 23*j* of the data line 22*j*, and $I_{pixel}$ which flows through the drive transistor 212 and across the storage capacitor 216. The current path of $I_{pixel}$ is illustrated by the arrow 252P and the current path of $I_{line}$ is illustrated by the arrow 252L. The currents $I_{line}$ and $I_{pixel}$ join in at the data line 22*j* to cumulatively form the reference current $I_{REF}$, which is illustrated by the arrow 252. The capacitance 23*j* of the data line 22*j* and the storage capacitor 216 thus act as a current divider for the reference current $I_{REF}$. These components are constant portions of the reference current $I_{REF}$ as given by equations 15 and 16:

$$I_{line} = \frac{C_L}{C_L + C_S} \cdot I_{REF} \tag{15}$$

$$I_{pixel} = \frac{C_S}{C_L + C_S} \cdot I_{REF} \tag{16}$$

Accordingly, $I_{line}$ discharges the data line 22*j* at a constant rate during the compensation cycle 262. This creates a declining voltage on the data line 22*j* as shown in FIGS. 4E and 4F. FIG. 4F is an enhanced view of the voltage on the data line 22*j* during the compensation cycle 262 to better illustrate the declining voltage ramp. The total change in voltage on the data line 22*j* during the compensation cycle 22*j* is given by equation 17:

$$VR = I_{REF} \cdot \frac{t_{prog}}{C_L + C_S} \tag{17}$$

where $t_{prog}$ is the length of the compensation cycle 262. The $I_{pixel}$ component of the reference current $I_{REF}$ develops a voltage across the gate-source terminals of the drive transistor 212 which is a function of its threshold voltage, mobility, oxide-thickness, and other second-order parameters (e.g. drain and source resistance). The resulting gate-source voltage on the drive transistor 212 is given by equation 18:

$$|V_{GS}| = |V_t| + \sqrt{\frac{2I_{pixel}}{\mu C_{ox}\frac{W}{L}}} \tag{18}$$

Therefore, the gate voltage of the drive transistor 212 (i.e., the voltage at the gate node 212*g*) is given by equation 19:

$$VG = VDD - |V_t| - \sqrt{\frac{2I_{pixel}}{\mu C_{ox}\frac{W}{L}}} \tag{19}$$

At the end of the compensation cycle 262, the voltage stored on the storage capacitor 216 is equal to VP−VR−VG which is a function of both the pixel program voltage (VP) and the characteristics of the drive transistor 212 (e.g., due to the contribution of VG). The pre-charging cycle 260 and the compensation cycle 262 are repeated for every row of the panel 20 during the period 264.

FIG. 4D is labeled with an arrow 256 to illustrate a current path during an emission cycle 266 of the pixel circuit 210. For example, once the entire panel 20 is programmed, the emission cycle 266 begins by turning the switch transistor 132 on to set the data line 22*j* at the reference voltage $V_{REF}$. Setting the data line 22*j* at the reference voltage $V_{REF}$ references the second terminal of the storage capacitor 216 to the reference voltage $V_{REF}$. The reference voltage $V_{REF}$ can be chosen to be equal to VDD. The emission transistor 222 is also turned on during the emission cycle 266. As illustrated by FIG. 4D, both the switch transistor 132 and the emission transistor 222 can be controlled by an emission control line 25 conveying a global emission control signal. As a consequence, the gate-to-source over-drive voltage of the drive transistor 212 is $V_{OV}$, as given by equation 20:

$$V_{OV} = VP - VR - V_{REF} + \sqrt{\frac{2I_{pixel}}{\mu C_{ox}\frac{W}{L}}} \tag{20}$$

The over-drive voltage $V_{OV}$ is thus independent of the threshold voltage of the drive transistor 212. The effective drive current of the pixel circuit 210 can hence be designed to be minimally affected by the variations of mobility, oxide thickness, and other varying TFT device parameters.

Figure 5:
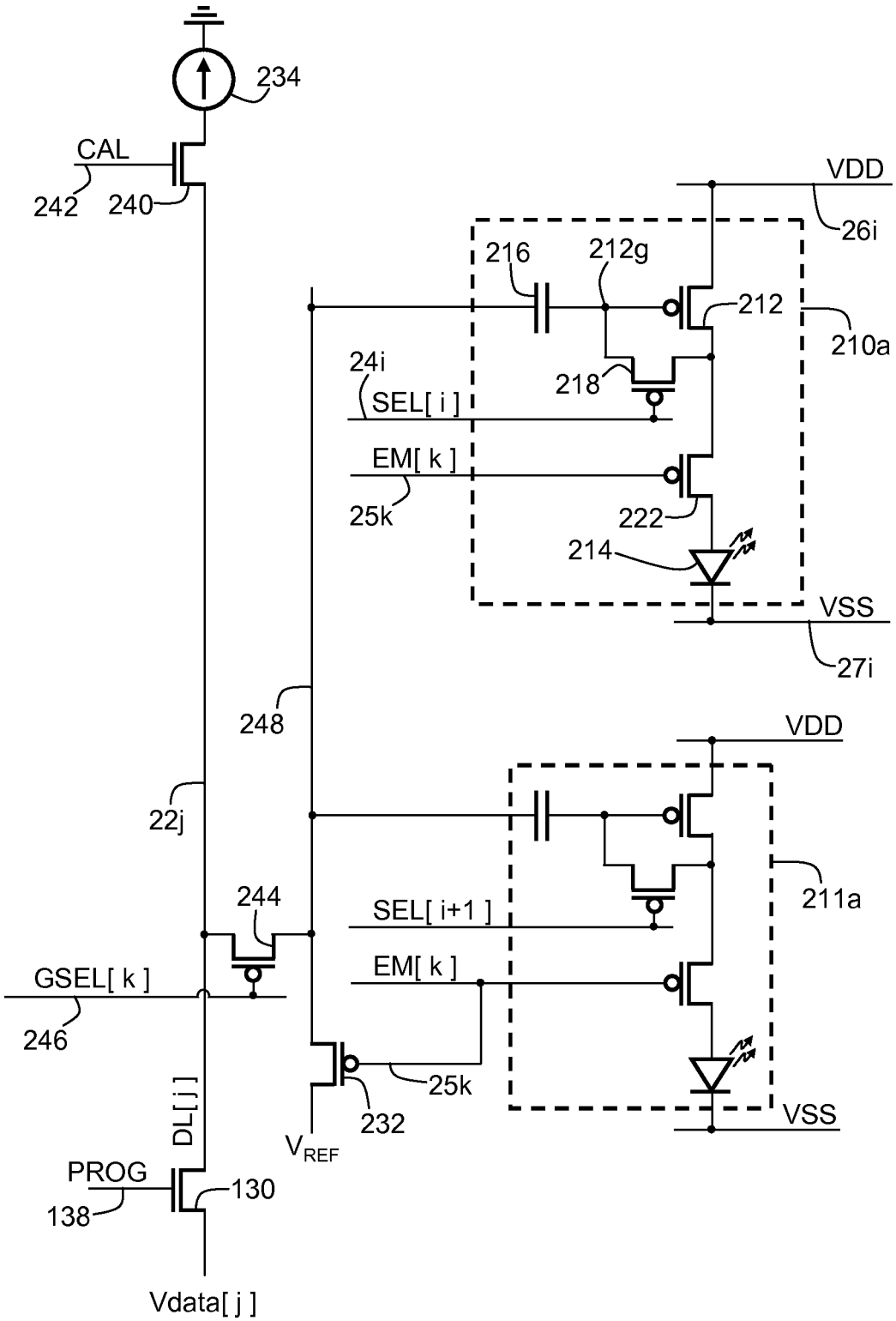
FIG. 5 illustrates a circuit diagram for a portion of a display showing two pixel circuits in an example configuration suited to providing enhanced settling time.

The two-phase pre-charging and compensation operation utilizing a pixel's data line can be implemented in a variety of particular pixel architectures, which are described next in FIGS. 5-7. FIG. 5 illustrates an exemplary circuit diagram for a portion of a display 20 showing two pixel circuits 210*a*, 211*a* in an example configuration that can implement the two-cycle compensation technique described in connection with FIG. 4E. The pixel architecture of FIG. 5 also offers a display designer the option of segmenting the display panel 20 into multiple segments that can be separately programmed or driven according to global select lines (e.g., the global select line 246) ("GSEL[k]"). In the circuit diagram shown in FIG. 5, the pixel circuit 210*a* is in the "ith" row and "jth" column of the display panel 20. Also illustrated is the pixel circuit 211*a*, which is in the next (i.e., "(i+1)th") row and the "jth" column. Both of the pixel circuits 210*a* and 211*a* are also in the "kth" segment of the display panel 20. Accordingly, the segmented data line 248 which is shared by the pixel circuits 210*a*, 211*a* is coupled to the data line 22*j* via the segment transistor 244. While the segment transistor 244 is turned on, the segment data line 248 receives voltages and currents applied to the data line 22*j*. However, while the segment transistor 244 is turned off (e.g., by setting the segment control line 246 high) the segment data line 248 is not connected to the data line 22*j*.

This segmented feature illustrated by the configuration in FIG. 5 can allow the data line 22*j* to be utilized to program other segments of the display array 20 (which are selectively coupled to the data line 22*j* by their own respective segment transistors) while the "kth" segment is driven to emit light during an emission cycle for the "kth" segment. Thus, separate segments can be controlled to implement different operations simultaneously (i.e., in parallel) and thereby either increase the time available for pre-charging, programming, and/or compensating each row of the display array 20. Additionally or alternatively, the segmented driving scheme can allow the effective refresh rate of the display system 50 to be increased. That is, rather than programming the entire display panel 20, row by row, during a first programming period, and then driving the entire display panel 20 during a second emission period while the source driver 4 is effectively idle, the segmented arrangement allows parallel operations. In one example implementation, half of the display panel 20 can be programmed during a first period while the other half is operated in an emission cycle, and then the second half of the display panel 20 can be programmed during a second period while the first half is operated in an emission cycle. In another example, the display array can be divided into segments consisting of two rows of pixels each such that each segmented data line (e.g., 248) can be used for two rows. In such an arrangement the "ith" row of the display can be the "(2k)th" row and "(i+1)th" row of the display can be the "(2k+1)th" row, with k an integer between 0 and N/2 where N is the number of rows in the display panel 20. Thus, the display can be divided into a plurality of segments each including two or more rows of the display panel 20, and each of the segments having a respective segment transistor to selectively connect to the data line 22*j*. Such a segmented display panel 20 can then operated such that each segment is connected to the data line 22*j*, while the data line 22*j* conveys programming and/or compensation signals to the pixels in the segment, and then the respective segment can be disconnected while the data line 22*j* is fixed at a reference voltage $V_{REF}$.

Figure 6:
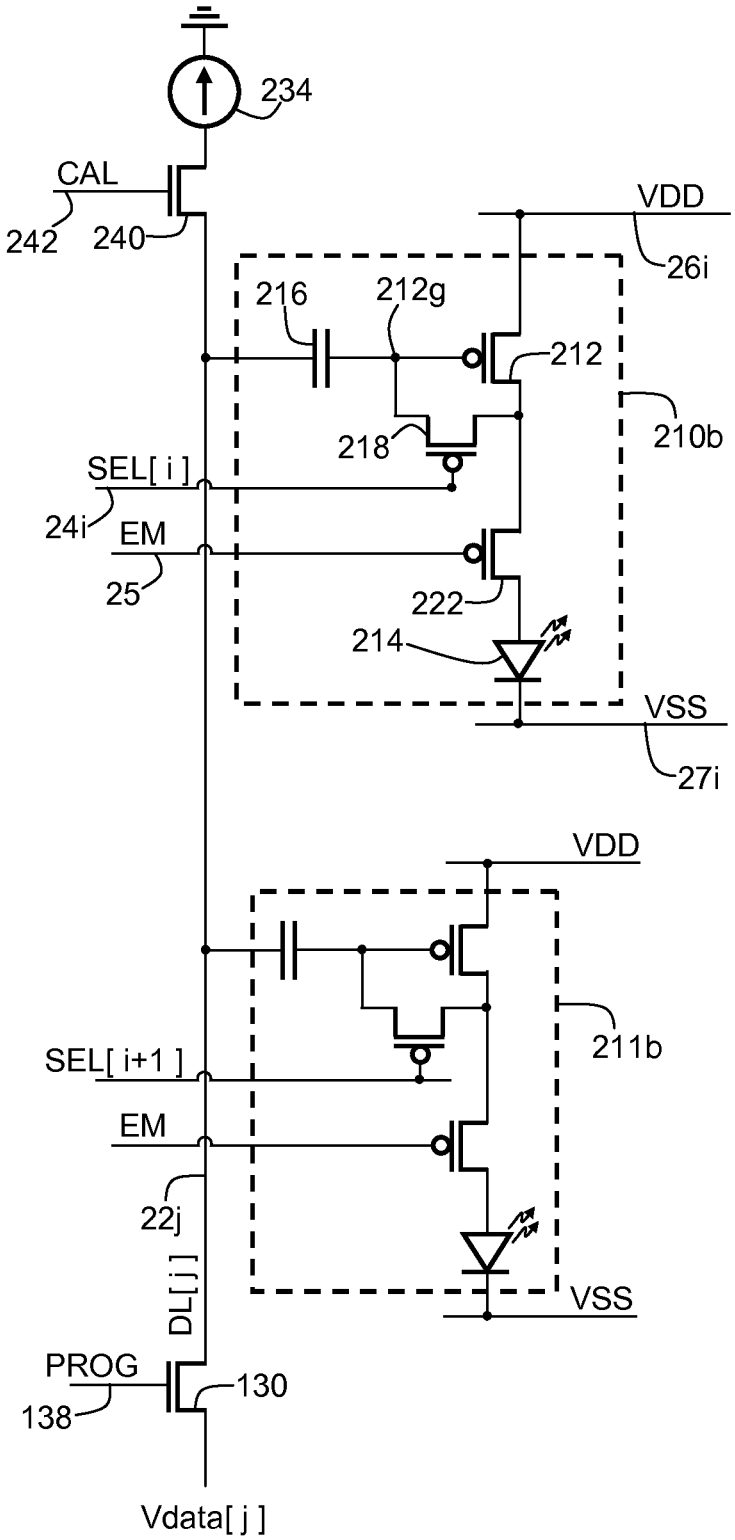
FIG. 6 illustrates a circuit diagram for a portion of a display showing two other pixel circuits in an example configuration also suited to providing enhanced settling time.

FIG. 6 illustrates another circuit diagram for a portion of a display showing a first and second pixel circuit 210*b* and 211*b* configured suitably to implement the two-cycle pre-charging and compensation cycles 260, 262 described in connection with FIG. 4E. The pixel circuits 210*b*, 211*b* are arranged similarly to the pixel circuit 210 described in FIGS. 4B to 4D. However, as shown in the circuit diagram of FIG. 6, the reference current source 234 can be arranged at one side (e.g., the top side) of the display panel 20 while the source driver 4 can be arranged at the other side (e.g., the bottom side) of the display panel. Each of the source driver 4 and the reference current source 234 are selectively connected to the data line 22*j* via respective calibration switch transistor 240 (operated by the calibration control line 242) and the programming switch transistor 130 (operated by the programming control line 138).

Figure 7:
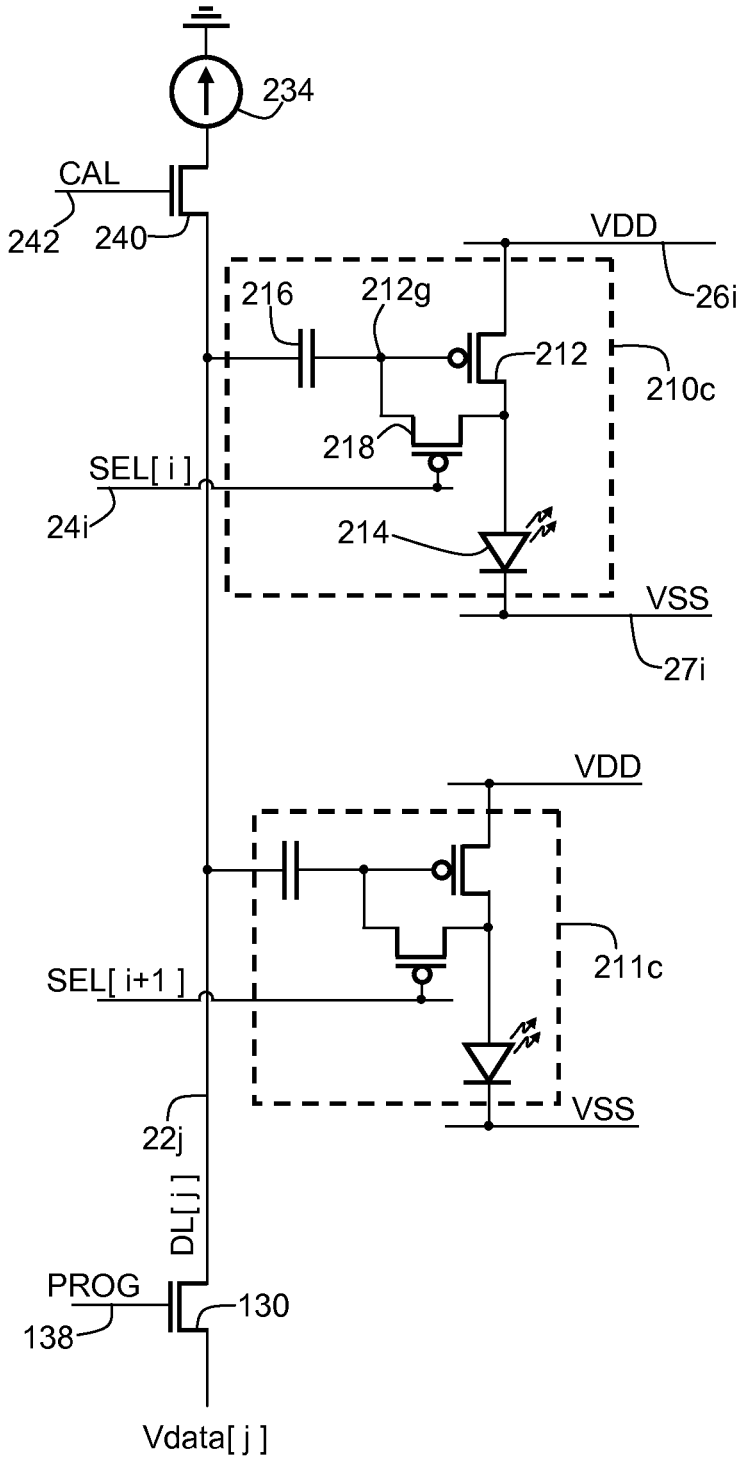
FIG. 7 illustrates a circuit diagram for a portion of a display showing still two more pixel circuits in an example configuration also suited to providing enhanced settling time.

FIG. 7 illustrates a circuit diagram for a portion of a display showing still two more pixel circuits 210*c*, 211*c* in an example configuration also suited to provide enhanced settling time via the two-cycle pre-charging and compensation scheme described in connection with FIG. 4E. For the circuit arrangement shown in FIG. 7, there is no emission control transistor, and thus the voltage of the voltage supply line 26*i* is toggled to prevent emission during the pre-charging and compensation cycles 260, 262. Toggling the voltage supply line 26*i* is not implemented for the pixel circuits shown in FIGS. 5 and 6, which incorporate emission control transistors 222. However, all three circuit configurations 210*a-c* are fully compatible with available source-driver and gate-driver microchips. Implementing the two-cycle programming technique may require modifications to timing controllers, such as the controller 2, the address driver 8, and/or the source driver 4 described in connection with the display system 50 of FIG. 1 in order to provide the functions described in connection with FIGS. 4A through 7.

Figure 8A:
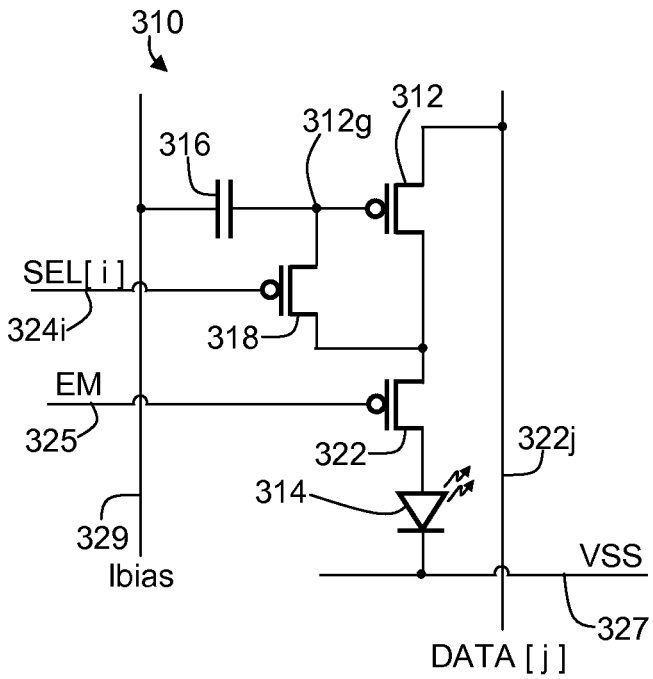
FIG. 8A is a circuit diagram of a pixel circuit configured to provide the pre-charging and compensation cycle simultaneously.

FIG. 8A illustrates an additional configuration of a pixel circuit 310 providing power supply voltage $V_{DD}$ via the data line 322*j*. The pixel circuit 310 can be implemented in the display system 50 described above in connection with FIG. 1. However, as shown, the pixel circuit 310 does not utilize a separate monitoring line. Furthermore, the pixel circuit 310 does not utilize a separate voltage supply line 26*i*. The pixel circuit 310 is configured to allow compensation for pixel aging to occur simultaneously with programming, and thereby increase the time available for programming and/or compensation in the pixel circuit 310, as well as decrease the requirements for switching speed of the transistors. The pixel circuit 310 includes a drive transistor 312 coupled in series with a light emitting device 314, which can be an organic light emitting diode ("OLED") or another current-driven light emissive device. The pixel circuit 310 also includes a storage capacitor 316 having a first terminal coupled to a gate terminal of the drive transistor 312. The first terminal of the storage capacitor 316 and the gate terminal of the drive transistor 312 are thus electrically connected to a common node 312*g*, which is referred to for convenience as a gate node 312*g*. A switch transistor 318 operated by the select line 24*i* selectively couples the gate node 312*g* (and thus the first terminal of the storage capacitor 316 and the gate terminal of the drive transistor 312) to a second terminal of the drive transistor 312, which can be a drain terminal.

The second terminal of the storage capacitor 316 is connected to a bias line 329, which provides a bias current $I_{bias}$ to provide compensation to the pixel circuit 310. The pixel circuits 210, 210*a-c* described above implement compensation and programming in a two-phase operation to first pre-charge the data line (in the pre-charging cycle 260) and then apply the bias current (e.g., the reference current $I_{REF}$) to provide compensation while simultaneously discharging the data line (during the compensation cycle 262). However, the pixel circuit 310 provides data programming via the data line 322*j* while simultaneously applying the bias current via the bias line 329 during a programming cycle 360. The data line 322*j* is also utilized to provide a power supply voltage $V_{DD}$ during the emission cycle 364 of the pixel circuit 210.

The pixel circuit 310 also includes an emission control transistor 322 operated according to an emission control line 25. The emission control transistor 322 is arranged between the drain terminal of the drive transistor 312 and the light emitting device 314 so as to selectively connect the light emitting device 314 to the drive transistor 312. For example, the emission control transistor 322 can be turned on during an emission cycle 364 of the pixel circuit 310 to allow the pixel circuit 310 to drive the light emitting device 314 to emit light according to programming information. By contrast, the emission control transistor 322 can be turned off during cycles of the pixel circuit 310 other than an emission cycle 366, such as, for example, the programming cycle 360. The emission control transistor 322 is selectively turned on and off according to the emission control signal conveyed via the emission control line 25. It is specifically noted that the pixel circuit 310 can be implemented without the emission control transistor 322 by selectively adjusting the voltage of the supply line 27*i* to increase VSS during the programming cycle 360 so as to turn off the light emitting device 314.

Figure 8B:
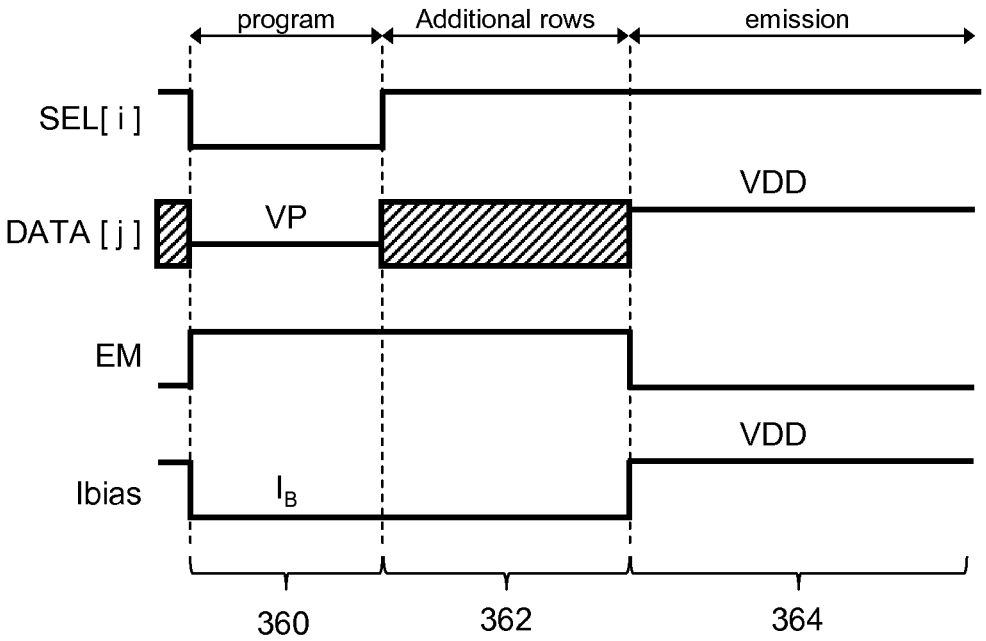
FIG. 8B is a timing diagram illustrating the operation of the simultaneous pre-charge and compensation cycle.

FIG. 8B is a timing diagram illustrating an exemplary operation of the pixel circuit 310 shown in FIG. 8A. As shown in FIG. 8B, operation of the pixel circuit 310 includes two phases for each pixel: a programming and compensation cycle 360 and an emission cycle 364. In the timing diagram shown in FIG. 8B, the programming and compensation phase 360 is a time period during which a single row of a pixel array is programmed and compensated. The programming and compensation of other rows of the display panel 20 can be carried out during the time period 362. During the programming and compensation cycle 362 the select line 24*i* is set low to turn on the switch transistor 318 and the data line 322*j* is set to a programming voltage VP appropriate for the "ith" row. During the programming and compensation cycle 360, the emission control line 25 is maintained at a high level to keep the emission control transistor 322 turned off. It is specifically noted that the emission control line 25 can convey an emission control signal that is shared by multiple pixels in a pixel array. For example, the emission control signal may be simultaneously conveyed to emission control lines in pixels in more than one row of the display panel 20 or to all pixels in a pixel array of a display.

During the programming and compensation cycle 360, the application of the programming voltage VP to the data line 322*j* causes a voltage to develop at the gate node 312*g* approximately equal to VP−Vth. That is, during the programming and compensation cycle 360, current flows from the data line 322*j* through the drive transistor 312 and the switch transistor 318 (which is turned on by the select line 24*i*) and develop a charge at the gate node 312*g*. The current continues to flow until the gate-source voltage of the drive transistor 312 is roughly equal to Vth, at which point the drive transistor 312 turns off and the current ceases flowing, leaving the voltage at the gate node 312*g* approximately equal to VP−Vth. Thus, the pixel circuit 310 is configured to allow a programming voltage VP to be applied to the pixel circuit 310 through the drive transistor 312. This arrangement ensures that the voltage developed on the gate node 312*g* of the drive transistor 312 and stored in the storage capacitor 316 automatically compensates for the threshold voltage Vth of the drive transistor 312.

The above described automatic compensation feature is advantageous because the threshold voltage Vth of the drive transistor 312 can vary across the panel 20 and over time due to variations in the usage of each pixel (i.e., the gate-source and drain-source voltage applied to each individual drive transistor over their lifetimes), temperature variations applied to each pixel, manufacturing variations in the developing of each pixel in a pixel array, etc.

In addition, the pixel circuit 310 further accounts for degradation in the pixel 310 by applying the biasing current Ibias via the bias line 329 to the second terminal of the storage capacitor 316 while the programming voltage VP is applied through the drive transistor 312 to the first terminal of the storage capacitor 316. Thus, the bias current Ibias drains a small current through the drive transistor 312 (via the switch transistor 318 and the storage capacitor 316) to allow the gate-source voltage of the drive transistor 312 to be further adjusted. This further adjustment due to the bias current Ibias can account for variations (e.g., shifts, non-uniformities, etc.) in the voltage-current behavior of the drive transistor 312 (e.g., due to mobility, gate oxide, etc.).

Following the programming and compensation cycle 360, the select line 24*i* is set high to turn off the switch transistor 318 and the storage capacitor 316 is thus allowed to float between the bias line 329 and the gate node 312*g*. Following the additional programming and compensation cycles 362 for additional rows of the display, the emission cycle 364 is commenced by setting the bias line 329 to a high supply voltage VDD, setting the data line 322*j* to the high supply voltage VDD, and setting the emission control line 25 low to turn on the emission control transistor 322. The bias line 329 thereby references the second terminal of the storage capacitor 316 to the high supply voltage VDD while the first terminal of the storage capacitor 316 sets the gate voltage of the drive transistor 312. By combining the programming and compensation operations in the single programming and compensation phase 360, the pixel circuit 310 advantageously allows the length of the time period reserved for programming to be increased relative to pixel circuits utilizing separate, sequentially implemented programming and compensation operations.

Figure 9A:
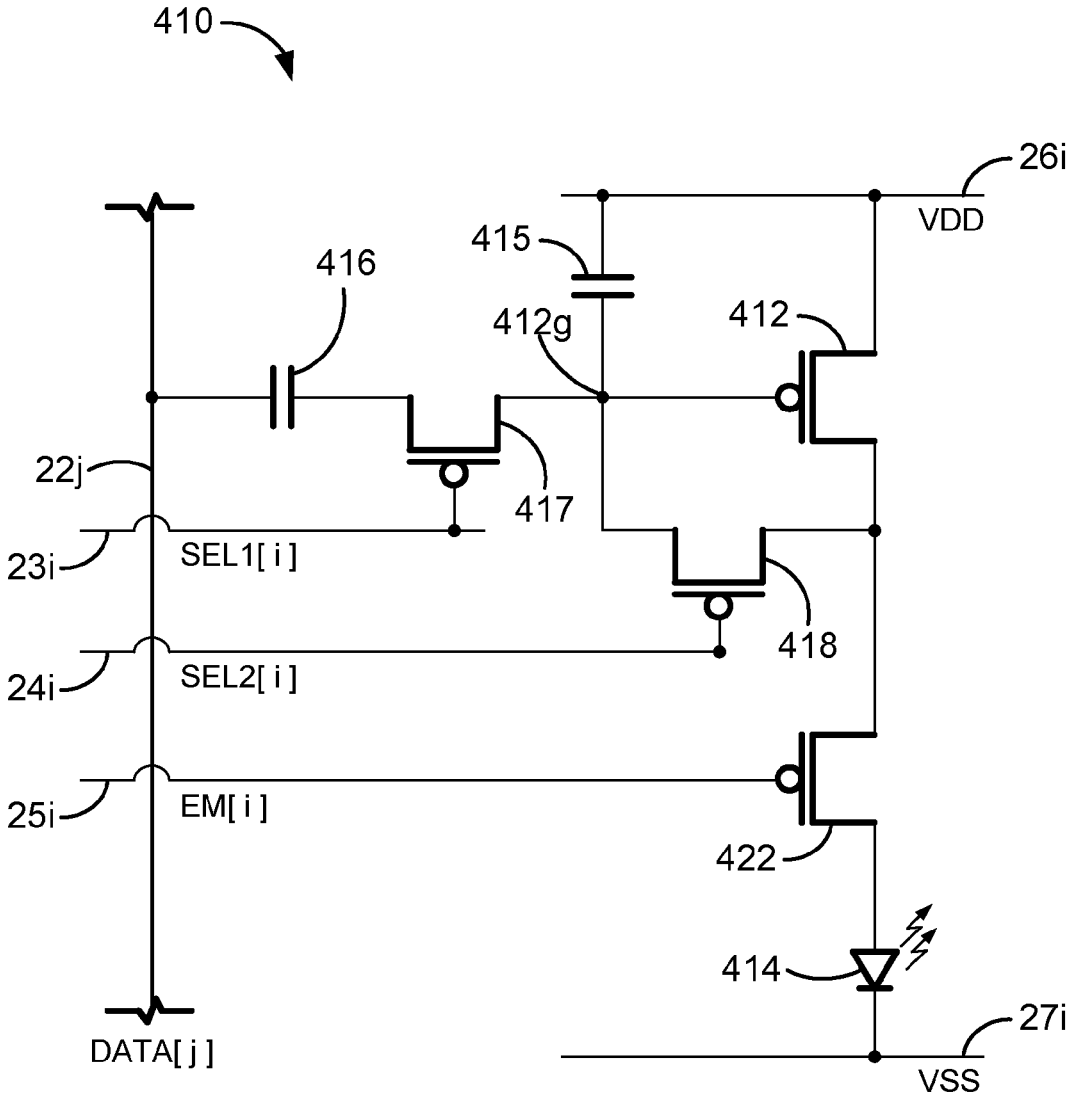
FIG. 9A illustrates an additional configuration of a pixel circuit configured to program the pixel circuit via a programming capacitor connected to a gate terminal of a drive transistor via a first selection transistor.

FIG. 9A illustrates an additional configuration of a pixel circuit 410 configured to program the pixel circuit 410 via a programming capacitor 416 ("Cprg") connected to a gate terminal of a drive transistor 412 via a first selection transistor 417. The pixel circuit 410 also includes a storage capacitor 415 ("Cs") connected directly to the gate terminal of the drive transistor 412. The pixel circuit 410 can be implemented in the display system 50 described above in connection with FIG. 1, and can be one of a plurality of similar pixel circuits arranged in rows and columns to form a display panel, such as the display panel 20 described in connection with FIG. 1. However, as shown, the pixel circuit 410 does not utilize a separate monitoring line for providing feedback. Furthermore, the pixel circuit 410 includes both a first select line 23*i* ("SEL1") and a second select line 24*i* ("SEL2"). The pixel circuit 410 also includes a connection to an emission control line 25*i* ("EM") and two voltage supply lines 26*i*, 27*i* for supplying a current source and/or sink for a driving current conveyed through the pixel circuit 410 according to programming information.

The pixel circuit 410 includes a first switch transistor 417 operated according to the first select line 23*i* and a second switch transistor 418 operated according to the second select line 24*i*. The pixel circuit 410 also includes the drive transistor 412, an emission control transistor 422 operated according to the emission control line 25*i*, and a light emitting device 414, such as an organic light emitting diode. The drive transistor 412, emission control transistor 422, and the light emitting device 414 are connected in series such that while the emission control transistor 422 is turned on, a current conveyed through the drive transistor 412 is also conveyed through the light emitting device 414. The pixel circuit 410 also includes a storage capacitor 415 having a first terminal connected to a gate terminal of the drive transistor 412 at a gate node 412*g*. A second terminal of the storage capacitor 415 is connected to the voltage supply line 26*i*. The second switch transistor 418 is connected between the gate node 412*g* and a connection point between the drive transistor 412 and the emission control transistor 422. The programming capacitor 416 is connected in series between the data line 22*j* and the first switch transistor 417. Thus, the first switch transistor 417 is connected between a first terminal of the programming capacitor 416 and a gate terminal of the drive transistor 412, while a second terminal of the programming capacitor 416 is connected to the data line 22*j*.

Certain transistors in the pixel circuit 410 provide functions similar in some respects to corresponding transistors in the pixel circuit 210. For example, in a manner similar to the drive transistor 212, the drive transistor 412 directs a current from the voltage supply line 26*i* from a first terminal (e.g., a source terminal) to a second terminal (e.g., a drain terminal) based on the voltage applied to the gate node 412*g*. The current directed through the drive transistor 412 is conveyed through the light emitting device 414, which emits light according to the current flowing through it similar to the light emitting device 214. In a manner similar to the operation of the emission control transistor 222, the emission control transistor 422 selectively allows current flowing through the drive transistor to be directed to the light emitting device 414, and thereby increases a contrast ratio of the display by reducing accidental emissions of the light emitting device. The second switch transistor 418 is operated by the second select line 24*i* similarly to the switch transistor 218 so as to selectively connect the second terminal of the drive transistor 412 to the gate node 412*g*. Thus, while the second switch transistor 418 is turned on, the second switch transistor provides a current path is between the voltage supply line 26*i* to the gate node 412*g*, through the drive transistor 412. While the second switch transistor 418 is turned on, the voltage on the gate node 412*g* can thus adjust to a voltage suitable to convey a current through the drive transistor.

Figure 9B:
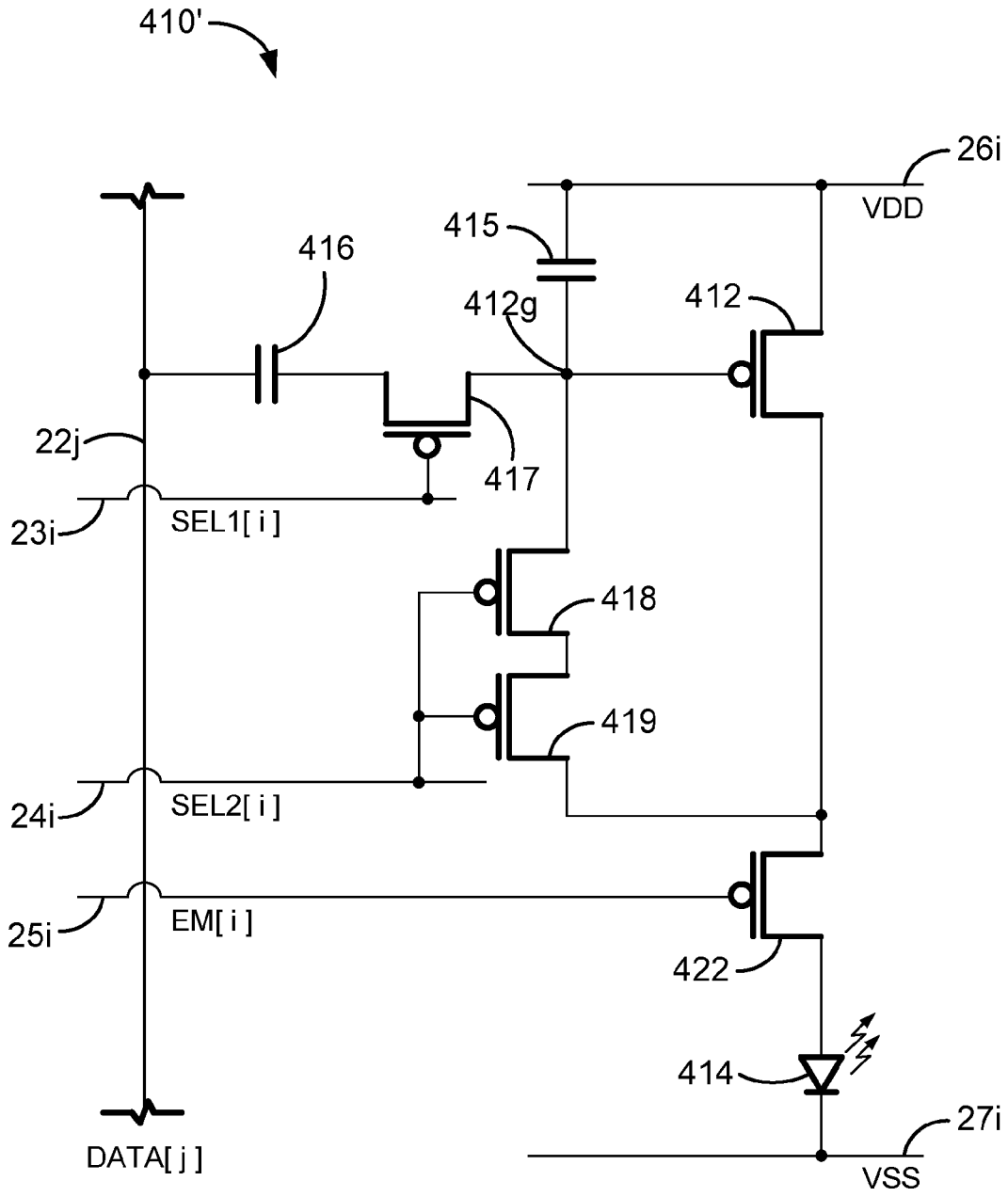
FIG. 9B is an alternative pixel circuit configured similarly to the pixel circuit shown in FIG. 9A, but with an additional switch transistor connected in series with the second switch transistor.

FIG. 9B is an alternative pixel circuit 410' configured similarly to the pixel circuit 410 shown in FIG. 9A, but with an additional switch transistor 419 connected in series with the second switch transistor 418. Both the additional switch transistor 419 and the second switch transistor 418 are operated according to the second select line 24*i*, such that setting the second select line 24*i* at a voltage sufficient to turn on the transistors 418, 419 connects a second terminal (e.g., a drain terminal) of the drive transistor 412 to the gate node 412*g*. Thus, in the pixel circuit 410', activating the second select line 24*i* provides a current path from the supply voltage line 26*i* to the gate node 412*g*, through the drive transistor 412, similar to the pixel circuit 410 described in connection with FIG. 9A. By including the additional switch transistor 419, however, the pixel circuit 410' offers superior resistance to leakage between the gate node 412*g* and the second terminal of the drive transistor 412 while the second select line 24*i* is set to turn off the transistors 418, 419. The description herein of the operation and function of the pixel circuit 410 accordingly applies to the pixel circuit 410' shown in FIG. 9B.

In comparison to the pixel circuit 210 illustrated and described in connection with FIGS. 4A through 4F, the pixel circuit 410 shown in FIG. 9A includes the first switch transistor 417 for selectively connecting the programming capacitor 416 to the gate node 412*g*. Furthermore, the pixel circuit 410 includes the storage capacitor 415 connected between the gate node 412*g* and the voltage supply line 26*i*. The first switch transistor 417 allows the gate node 412*g* to be isolated (e.g., not capacitively coupled) to the data line 22*j* during an emission operation of the pixel circuit 410. For example, the pixel circuit 410 can be operated such that the first selection transistor 417 is turned off so as to disconnect the gate node 412*g* from the data line 22*j* whenever the pixel circuit 410 is not undergoing a compensation operation or a programming operation. Additionally, during an emission operation of the pixel circuit 410, the storage capacitor 415 holds a voltage based on programming information and applies the held voltage to the gate node 412*g* so as to cause the drive transistor 412 to drive a current through the light emitting device 414 according to the programming information.

By contrast, again referring to the pixel circuit 210 described in connection with FIGS. 4A through 4F above, the capacitor 216 is allowed to float during the programming of other rows of the display while the selection transistor 218 is turned off. Thus, in order to properly reference the capacitor 216, during the emission period 266, the data line 22*j* is set to an appropriate reference voltage (e.g. $V_{REF}$) to reference the second terminal of the capacitor 216 connected to the data line 22*j* such that the voltage applied to the gate terminal of the drive transistor 212 is based on the previously applied programming voltage. As a result, the entire row of the display is generally programmed with programming voltages row by row, prior to the display being driven. During driving, the data line 22*j* is assigned to the reference voltage $V_{REF}$ during the emission period and thus programming and/or compensation cannot be carried out on some rows while other rows are driven to emit light. As discussed in connection with FIG. 5, one way to address the issue and provide the ability to conduct simultaneous operations in parallel on distinct segments of the display panel 20 is by segmenting the data line 22*j* into groups of pixels, such as sets of rows of the display panel. By allowing each segment to be independently connected to the data line 22*j*, and alternately connected to the reference voltage $V_{REF}$, parallel operations can be performed on separate segments of the display panel 20.

Another configuration allowing for simultaneous operations is provided by the pixel circuit 410 described in FIG. 9A (or the pixel circuit 410' of FIG. 9B), the operation of which is described next. The simultaneous parallel operation of different functions (i.e., compensation, programming, and driving) on different rows of the display panel 20 allow for increased duty cycles, higher display refresh rates, longer programming and/or compensation operations, and combinations thereof.

Figure 9C:
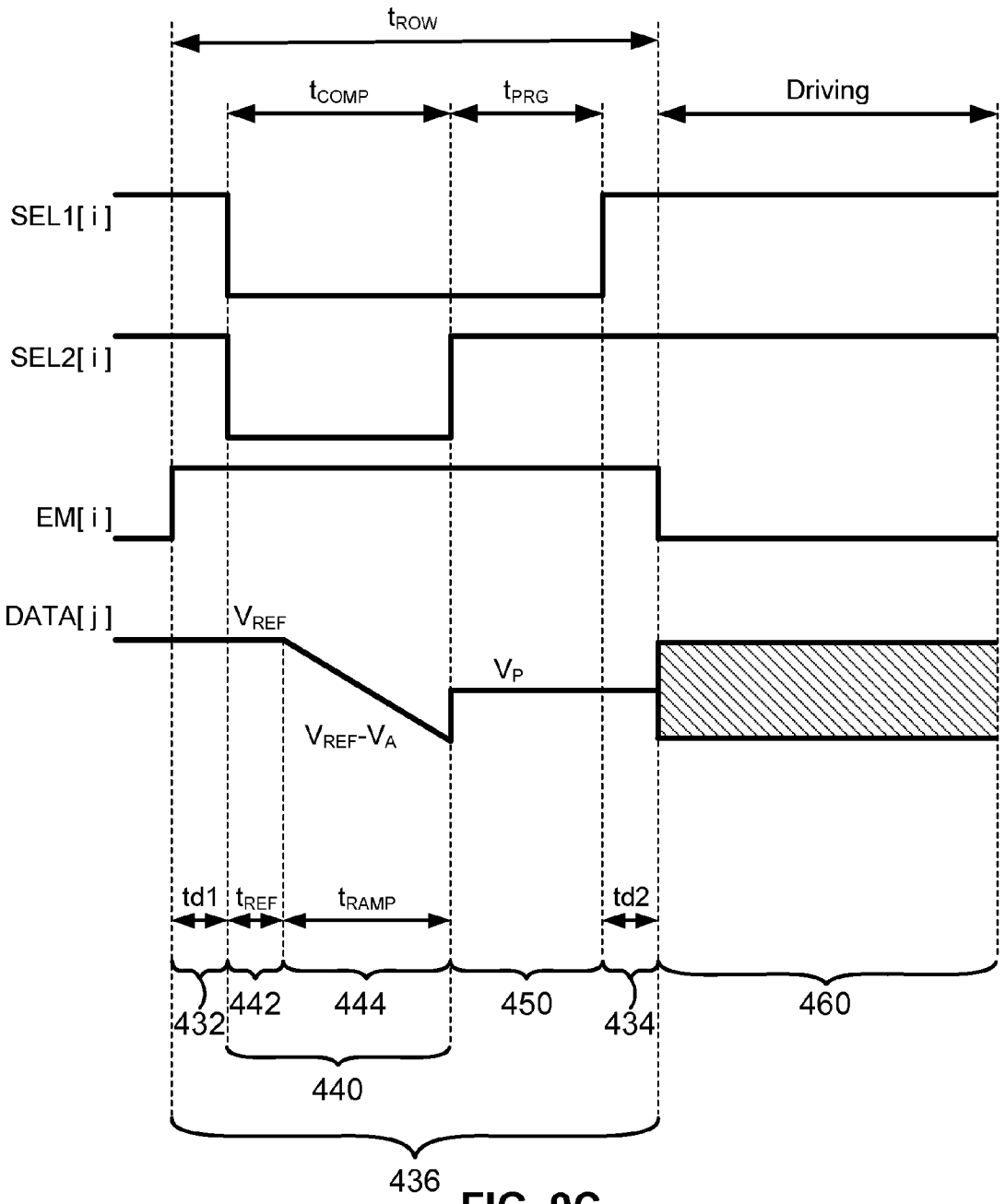
FIG. 9C is a timing diagram describing an exemplary operation of the pixel circuit of FIG. 9A or the pixel circuit of FIG. 9B.

FIG. 9C is a timing diagram describing an exemplary operation of the pixel circuit 410 of FIG. 9A or the pixel circuit 410' of FIG. 9B. As shown in FIG. 9C, operation of the pixel circuit 410 includes a compensation cycle 440, a program cycle 450, and an emission cycle 460 (alternately referred to herein as a driving cycle). The entire duration that the data line 22*j* is manipulated to provide compensation and programming to the pixel circuit 410 is a time row period 436 having a duration $t_{ROW}$. The duration of $t_{ROW}$ can be determined based on the number of rows in the display panel 20 and the refresh rate of the display system 50. The row period 436 is initiated by a first delay period 432, having duration td1. The first delay period 432 provides a transition time to allow the data line 22*j* to be reset from its previous programming voltage (for another row) and set to a reference voltage Vref suitable for commencing the compensation cycle 440. The duration td1 of the first delay period 432 is determined based on the response times of the transistors in the display system 50 and the number of rows in the display panel 20. The compensation cycle 440 is carried out during a time interval with duration $t_{COMP}$. The program cycle 450 is carried out during a time interval with duration $t_{PRG}$. At the initiation of the row period 436 the emission control line 25*i* ("EM") is set high to turn off the emission control transistor 422. Turning off the emission control transistor 422 during the row period 436 reduces accidental emission form the light emitting device 414 during the row period 436 while the pixel circuit 410 undergoes compensation and programming operations and thereby enhances contrast ratio.

Following the first delay period 432, the compensation cycle 440 is initiated. The compensation cycle 440 includes a reference voltage period 442 and a ramp voltage period 444, which have durations of $t_{REF}$ and $t_{RAMP}$, respectively. The first and second select lines 423*i*, 424*i* are each set low at the start of the compensation cycle 440 so as turn on the first and second selection transistors 417, 418. The data line 22*j* ("DATA[j]") is set with at a reference voltage Vref, during the reference voltage period 442. The reference voltage period 442 accordingly sets the voltage of the second terminal of the programming capacitor 416 to Vref.

The reference voltage period 442 is followed by the ramp voltage period 444 where the voltage data line 22*j* is decreased from the reference voltage Vref to a voltage Vref–$V_A$. During the ramp voltage period 444, the voltage on the data line 22*j* is decreased by an amount given by the voltage $V_A$. In some embodiments, the ramp voltage can be a voltage that decreases at a substantially constant rate (e.g., has a substantially constant time derivative) so as to generate a substantially constant current through the programming capacitor 416. The programming capacitor 416 thus provides a current Iprg through the drive transistor 412, via the second switch transistor 418 and the first switch transistor 417 during the voltage ramp period 444. The amount of the current Iprg thus applied to the pixel circuit 410 via the programming capacitor 416 can be determined based on the amount of $V_A$, the duration $t_{RAMP}$, and the capacitance of the programming capacitor 416, which can be referred to as Cprg. Upon determining the current Iprg, the voltage that settles on the gate node 412*g* can be determined according to equation 19, where Iprg is substituted for $I_{pixel}$. Thus the voltage of the gate node 412*g* at the conclusion of the compensation cycle 440 is a voltage that accounts for variations and/or degradations in transistor device parameters, such as degradations influencing the threshold voltage, mobility, oxide thickness, etc. of the drive transistor 412. At the conclusion of the ramp voltage period 444, the second select line 24*i* is set high so as to turn off the second switch transistor 418, such that the gate node 412*g* is no longer allowed to adjust according to a current conveyed through the drive transistor 412.

Following the compensation cycle 440, the programming cycle 450 is initiated. During the programming cycle 450, the first select line 23*i* remains low so as to keep the first switch transistor 417 turned on. In some embodiments, the compensation cycle 440 and the programming cycle 450 can be briefly separated temporally by a delay time to allow the data line to transition from conveying the ramp voltage to conveying a programming voltage. To isolate the pixel circuit 410 from any noise on the data line generated during the transition, the first select line 23*i* can optionally go high briefly, during the delay time, so as to turn off the first switch transistor 417 during the transition. The second switch transistor 418 remains turned off during the programming cycle 450. During the programming cycle 450, the data line 22*j* is set to a programming voltage Vp and applied to the second terminal of the programming capacitor 416. The programming voltage Vp is determined according to programming data indicative of an amount of light to be emitted from the light emitting device 414, and translated to a voltage based on a look-up table and/or formula that accounts for gamma effects, color corrections, device characteristics, circuit layout, etc.

While the programming voltage Vp is applied to the second terminal of the programming capacitor 416, the voltage of the gate node 412*g* is adjusted due to the capacitive coupling of the gate node 412*g* with the data line 22*j*, through the first switch transistor 417 and the programming capacitor 416. For example, the amount of change in the voltage on the gate node 412*g*, during the programming cycle 450, relative to the gate node voltage at the conclusion of the compensation cycle 440, can be given by the relation $(Vp-V_{REF}+V_A)$ [CS/(Cs+Cprg)]. An appropriate value for Vp can be selected according to a function including the capacitances of the programming capacitor 416 and the storage capacitor 415 (i.e., the values Cprg and Cs) and the programming information. Because the programming information is conveyed through the capacitive coupling with the data line 22*j*, via the programming capacitor 416, DC voltages on the gate node 412*g* prior to initiation of the programming cycle 440 are not cleared from the gate node 412*g*. Rather, the voltage on the gate node 412*g* is adjusted during the programming cycle 440 so as to add (or subtract) from the voltage already on the gate node 412*g*. In particular, the voltage that settles on the gate node 412*g* during the compensation cycle 440, which can be referred to as Vcomp, is not cleared by the programming operation, because Vcomp acts as a DC voltage on the gate node 412*g* while the gate node is adjusted via the capacitive coupling with the data line 22*j*. The final voltage on the gate node 412*g*, at the conclusion of the programming cycle 440 is thus an additive combination of Vcomp and a voltage based on Vp. For example, the final voltage can be given by $Vcomp+(Vp-V_{REF}+V_A)$ [Cs/(Cs+Cprg)]. The programming cycle concludes with the first select line 23*i* being set high so as to turn off the first selection transistor 417 and thereby disconnect the pixel circuit 410 from the data line 22*j*.

The emission cycle 460 is initiated by setting the emission control line 425*i* to a low voltage suitable to turn on the emission control transistor 422. The initiation of the driving cycle 460 can be separated from the termination of the programming cycle 450 by a second delay period 434 to allow some temporal separation between turning off the first selection transistor 417 and turning on the emission control transistor 422. The second delay period 434 has a duration td2 determined based on the response times of the transistors 417 and 422.

Because the pixel circuit 410 is decoupled from the data line 22*j* during the driving cycle 460, the emission cycle 460 can be carried out independent of the voltage levels on the data line 22*j*. In particular, the pixel circuit 410 can be operated in the emission mode while the data line 22*j* is operated to convey a voltage ramp (for compensation) and/or programming voltages (for programming) to other rows in the display panel 20 of the display system 50. In some embodiments, the time available for programming and compensation, (e.g., the values $t_{comp}$ and $t_{prog}$) are maximized by implementing the compensation and programming operations to each row in the display panel 20 one after another such that the data line 22*j* is substantially continuously driven to alternate between voltage ramps and programming voltages, which are applied to each sequentially. By allowing the emission cycle 460 to be carried out independently of the compensation and programming cycles 440, 450, the data line 22*j* is prevented from requiring wasteful idle time in which no programming or compensation is carried out.

Figure 10A:
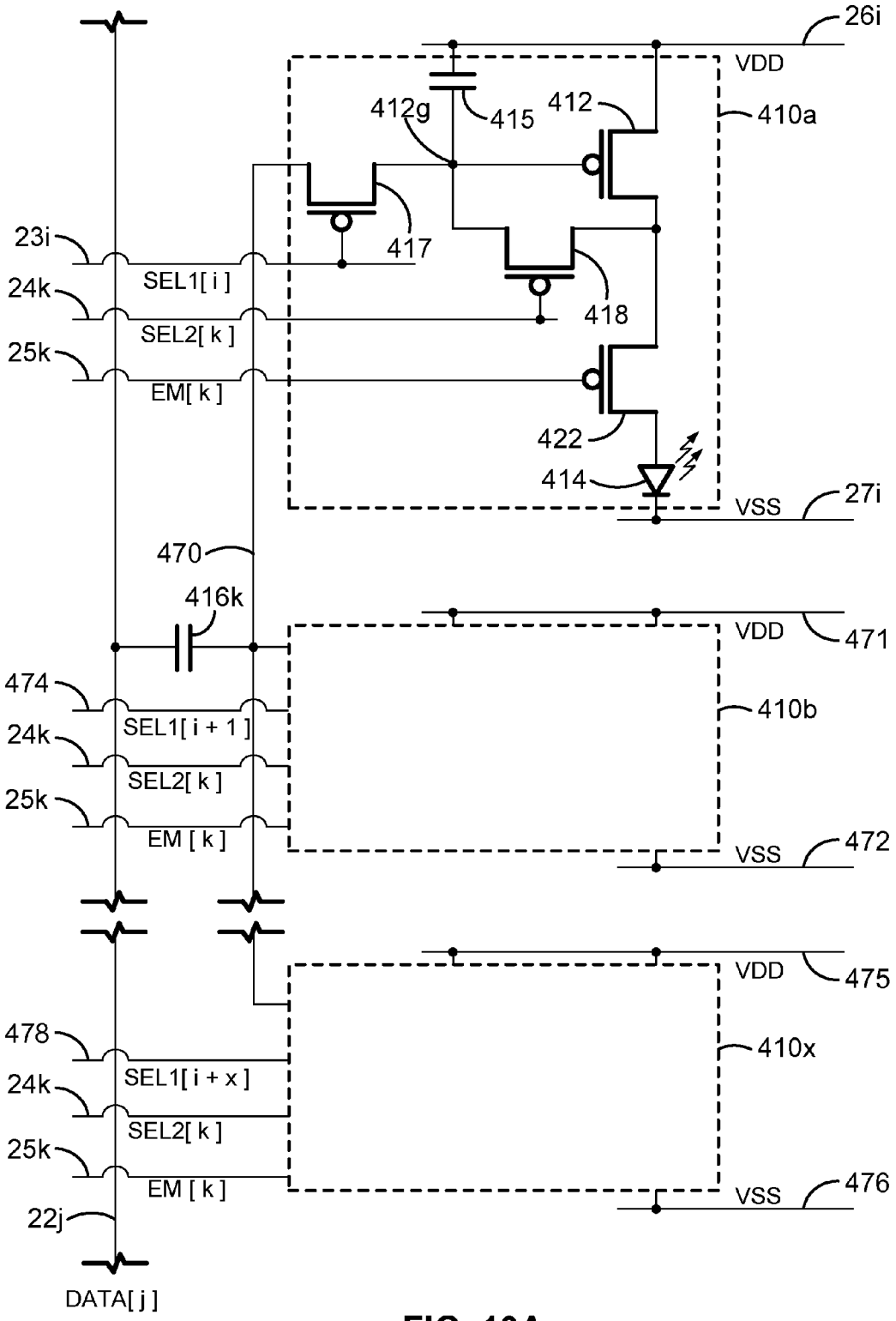
FIG. 10A illustrates a circuit diagram of a portion of a display panel in which multiple pixel circuits are arranged to share a common programming capacitor.

FIG. 10A illustrates a circuit diagram of a portion of a display panel in which multiple pixel circuits 410*a*, 410*b*, 410*x* are arranged to share a common programming capacitor 416*k*. The pixel circuits 410*a*, 410*b*, 410*x* represent a portion of a display panel suitable for incorporation in a display system, such as the display system 50 discussed in connection with FIG. 1. The pixel circuits 410*a-x* are a group of pixel circuits in a common column of a display panel (e.g., the "jth" column) and can be in adjacent rows of the display panel (e.g., the "ith," "(i+1)th," through to the "(i+x)th" rows). The pixel circuits 410*a-x* are configured similarly to the pixel circuit 410 described above in connection with FIGS. 9A-9C, except that the group of pixels circuits 410*a-x* all share the common programming capacitor 410*k*. The group of pixel circuits 410*a-x* are each connected to a segment data line 470 that is connected to a first terminal of the common programming capacitor 416*k* while a second terminal of the common programming capacitor is connected to the data line 22*j*.

The group of pixel circuits 410*a-x* that share the common programming capacitor 416*k* are included in a segment of the display panel 20 which is a sub-group of the pixel circuits in the display panel 20. The segment including the pixel circuits 410*a-x* can also extend to each of the pixel circuits in a common row with the pixel circuits 410*a-x*, i.e., the pixel circuits in the display panel 20 having a common first select line with the pixel circuits 410*a-x* (SEL1[i] to SEL11[i+x]). Among the plurality of pixel circuits in the segment, pixels circuits in a common column of the display panel 20 i.e., the pixel circuits connected to the same data line (DATA[j]), share the common programming capacitor 416*k* and are controlled according to segmented emission and second select lines 24*k*, 25*k*. For convenience the group of pixel circuits

410*a-x* (and the pixel circuits in the same rows as the pixel circuits 410*a-x*) is referred to herein as the "kth" segment.

In addition to sharing the common programming capacitor 416*k*, the "kth" segment also operates according to a segmented emission control line 425*k* ("EM[k]") which operates the respective emission control transistors (e.g., the emission control transistor 422) in all of the pixel circuits 410*a-x* in the "kth" segment in a coordinated fashion. In some examples, the entire display panel 20 is divided into a plurality of segments similar to the "kth" segment. Each segment includes a plurality of pixel circuits that are controlled, at least in part, by commonly operated segmented control line. In some examples, each segment can include an equal number of rows of the display panel. As will be explained further in regard to FIGS. 10B and 10C, such a segmented display architecture allows for efficient programming and driving sequences where pixel circuits in each segment (which each include multiple rows of a display panel) can be operated to provide a compensation operation simultaneously, rather than performing the compensation operation on each row consecutively.

For clarity in explanation, the "kth" segment referred to herein will be described by way of example as a segment including 5 adjacent rows of pixel circuits. In this way an entire display panel can be divided into segments ("subgroups") of 5 rows each. For example, a display panel with 720 rows can be divided into 144 segments, each having 5 adjacent rows of the display panel. However, it is noted that the discussions herein of segmented display architectures is generally not so limited, and the discussions herein referring to segments having 5 rows can generally be extended to segments having more than, or less than, 5 rows, such as 4 rows, 6 rows, 8 rows, 10 rows, 16 rows, 1, etc., or any number of rows that evenly divides the total number of rows in the display panel, and also to segments including non-adjacent rows of a display panel, such as interleaved rows (odd/even rows), etc.

Thus, in an example where the "kth" segment includes 5 adjacent rows of a display panel, pixel circuits 410*a*-410*x* in the "jth" column of the "kth" segment can be pixel circuits in the "ith," "(i+1)th," "(i+2)th," "(i+3)th," and "(i+4)th" rows of the display panel. Each of the pixel circuits includes connections to respective supply voltage lines, first and second select lines, and emission control lines, which are driven to operate the pixel circuits 410*a*-410*x*. For example, the pixel circuit 410*a* in the "ith" row and "jth" column is connected to the supply voltage lines 26*i*, 27*i* and the first select line 23*i* for the "ith" row. Similarly, the pixel circuit 410*b* in the "(i+1)th" row and the "jth" column is connected to supply voltage lines 471, 472 and a first select line 474 ("SEL[i+1]") for the "(i+1)th" row, and the pixel circuit 410*x* in the "(i+4)th" row and "jth" column is connected to supply voltage lines 475, 476 and a first select line 478 ("SEL[i+x]") for the "(i+4)th" row. Each of the pixel circuits in the "kth" segment is also connected to a segmented second select line 24*k* and a segmented emission control line 25*k*. The emission control line and second select line are shared by all pixels in the "kth" segment to allow the emission control transistors and second switch transistors in each of the pixels in the "kth" segment to be operated in coordination.

Figure 10B:
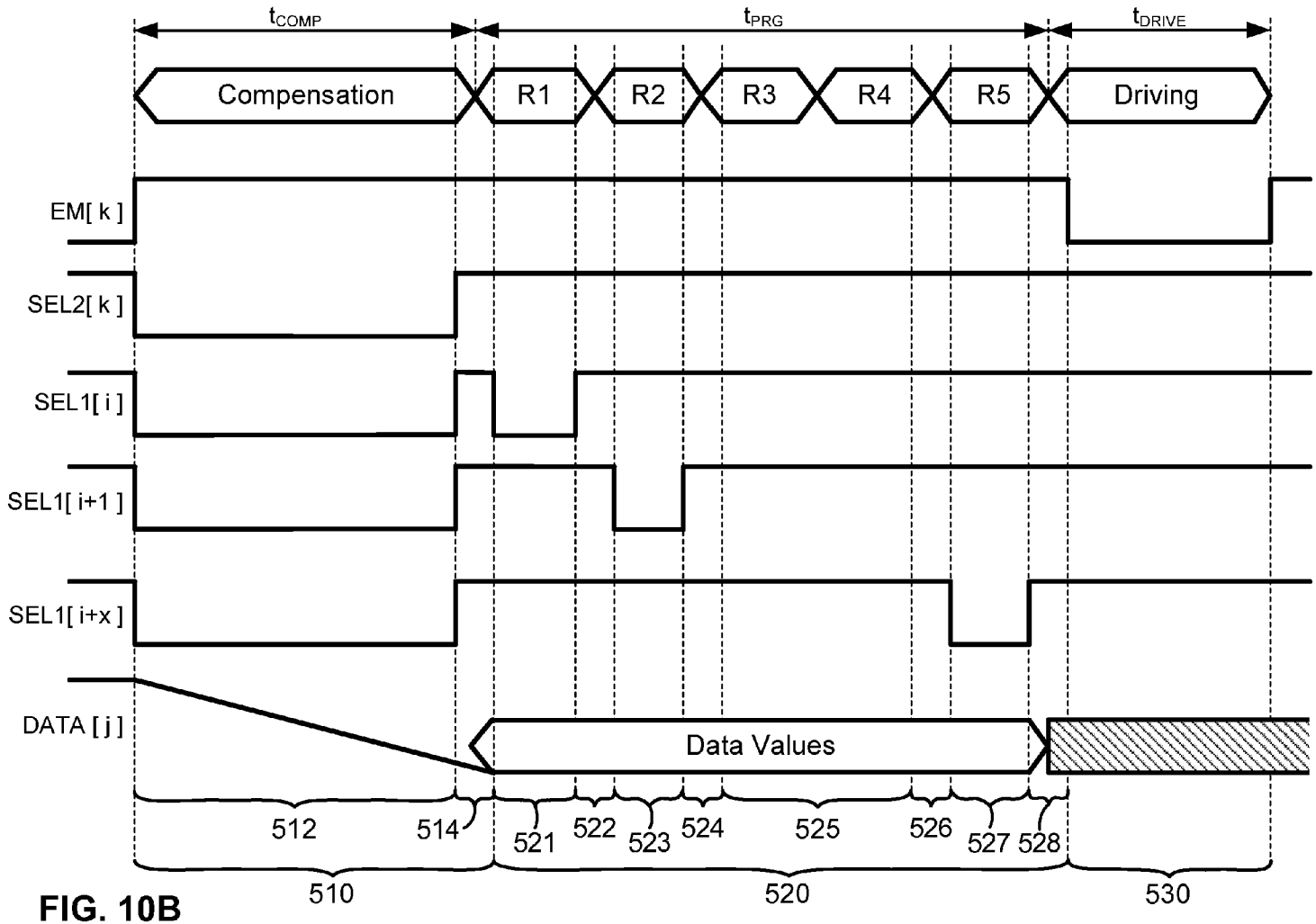
FIG. 10B is a timing diagram of an exemplary operation of the "kth" segment shown in FIG. 10A.

FIG. 10B is a timing diagram of an exemplary operation of the "kth" segment shown in FIG. 10A. As shown in FIG. 10B, operation of the "kth" segment includes a compensation cycle 510, a programming period 520 and a driving cycle 530. During both the compensation cycle 510 and the programming period 520, the segmented emission control line 25*k* ("EM[k]") is set high to keep the emission control transistors turned off and thereby reduce incidental emission during compensation or programming. During the compensation cycle 510, the segmented second select line 24*k* is set low to turn on the second switch transistors in each of the pixel circuits 410*a-x* in the "kth" segment. The first select lines (e.g., 23*i*, 474, 478, etc.) for each of the pixel circuits 410*a-x* are also set low during the compensation cycle 510 and a ramp voltage is applied on the data line 22*j*. Thus, during the compensation cycle 510, a current is conveyed through the pixels circuits in the "kth" segment (due to the ramp voltage applied to the common programming capacitor 416*k*) and the respective gate nodes in each pixel circuit 410*a-x* are allowed to adjust according to the current (via the respective turned on second switch transistors). Thus, voltages are established on each of the respective gate nodes of the pixel circuits 410*a-x* during the compensation cycle that account for variations and/or degradations in the respective drive transistors, such as degradations due to threshold voltage variations, mobility variations, etc. The voltages established on the gate nodes are thus similar to the gate node voltage established during the compensation cycle 440 in connection with FIGS. 9A-9C.

At the conclusion of the compensation cycle 510, the segmented second select line 24*k* is set high, to turn off the respective second switch transistors in the pixel circuits 410*a-x*. In order to provide some separation between the compensation cycle 510 and the programming period 520, the compensation cycle 510 can a transition delay period 514 following the ramp period 512. During the ramp period 512, the select lines (e.g., the select lines 24*k*, 23*i*, 474, 478, etc.) are all low while the ramp voltage is applied to the data line 22*j*. During the transition delay period 514, the select lines (e.g., the select lines 24*k*, 23*i*, 474, 478, etc.) are all high to separate the pixel circuits 410*a-x* from the data line 22*j* while the data line switches from conveying the ramp voltage to conveying programming voltages. The duration of the transition delay period 514 can be determined based on the switching speed of the transistors involved in connecting the data line 22*j* to a ramp voltage generator and/or programming voltage driver (e.g., the driver 4). The transition of the ramp period 512 is desirably long enough to allow sufficient time for the gate nodes to settle at appropriate voltages related to the currents generated by the ramp voltage applied to the common programming capacitor 416*k*. In an example embodiment, the duration of the compensation period 510 can be 15 microseconds, with the ramp period 512 lasting over 10 microseconds.

Once the compensation cycle 510 is complete and the gate nodes of each pixel circuit 410*a-x* have settled at appropriate voltages to account for transistor degradations, the data line 22*j* is operated to sequentially provide programming voltages to each of the pixel circuits 410*a-x* in the "kth" segment during the programming period 520. The segmented second selection line 24*k* remains high for the duration of the programming period 520. As shown in FIG. 10B, the programming period 520 includes a sequence of programming intervals for each pixel circuit (e.g., the first programming interval 521, the second programming interval 523, the last programming interval 527, etc.) alternated with delay intervals (e.g., the delay intervals 522, 524, 526, etc.). During each programming interval, respective ones of the pixel circuits 410*a-x* which have their corresponding first switch transistors turned on receive programming voltages applied to the data line 22*j*. The delay intervals between each programming interval allow the pixel circuits to be disconnected from the data line 22*j* while the programming voltage is being set to the next value appropriate for the next pixel circuit. Cross-talk effects can occur, for example, if the programming voltage on the data line 22*j* updates to the value for the next pixel circuit (e.g., the pixel circuit in the next row) before the respective first switch transistor is turned off to disconnect the pixel circuit from the data line 22*j*. Thus, the delay intervals between the programming intervals reduce cross-talk effects during programming.

The programming period 520 begins with the first programming interval 521 during which the first select line 423*i* for the pixel circuit 410*a* ("SEL1[i]") is set low and the data line 22*j* is set to a programming voltage Vp[i, j]. As used herein Vp[i, j] refers to a programming voltage appropriate for the "ith" row and "jth" column of the display panel 20 during a particular frame. Furthermore, Vp[i+1, j] refers to a programming voltage appropriate for the "(i+1)th" row and "jth" column of the display panel 20 during a particular frame, and so on. The application of the programming voltage adjusts the voltage at the gate node 412*g* of the pixel circuit 410*a* due to the capacitive coupling between the gate node 412*g* and the data line 22*j* via the common programming capacitor 416*k*. The adjustment to the voltage of the gate node 412*g* is carried according to the voltage division relationship between the common programming capacitor 412*k* and the storage capacitor 415, similar to the description of programming the pixel circuit 410 in connection with FIGS. 9A-9C. At the conclusion of the first programming interval 521, SEL1[i] is set high to disconnect the pixel circuit 410*a* from the data line 22*j*. The data line 22*j* adjusts to the next programming voltage during the delay interval 522 and settles at the next programming voltage value Vp[i+1, j] to start the second programming interval 523. During the second programming interval 523, SEL1[i+1] is set low to capacitively couple the pixel circuit 410*b* to the data line 22*j* via the common programming capacitor 416*k*. The gate node of the second pixel circuit 410*b* is adjusted by an amount based on the programming voltage Vp[i+1, j] during the second programming interval 523. At the conclusion of the second programming interval 523, SELL [i+1] is set high to disconnect the pixel circuit 410*b* from the data line 22*j*, and the data line adjusts to another programming voltage during the delay interval 524.

The programming period 520 continues by programming each pixel circuit in the "kth" segment, sequentially, row-by-row during programming intervals separated by delay intervals. Each of the respective first select lines for each row being programmed is accordingly set low during the programming interval corresponding to each row. Thus, the period 525 shown in FIG. 10B includes an appropriate number of distinct programming intervals until the second-to-last row of the "kth" segment. For example, where the "kth" segment includes 5 rows, the period 525 includes a programming interval for a third pixel circuit and a fourth pixel circuit, separated by a delay interval. The programming period 520 then continues with a delay interval 526 to separate the final programming interval 527 from the programming of the previous rows (during the period 525). The data line 22*j* is set to the final programming voltage Vp[i+x, j] during the delay interval 526. In an example where the "kth" segment includes 5 rows, the value "x" can be 4, but in general the value of "x" will be one less than the number of rows in each segment. The first select line for the final row, SEL1[i+x] is set low during the final programming period 527 and the gate node of the final pixel circuit 410*x* is adjusted according to Vp[i+x, j] through the capacitive coupling with the data line 22*j* via the common programming capacitor 416*k*. Following the final programming interval 527, a transition delay 528 concludes the programming period 520. The transition delay 528 provides a delay for the data line 22*j* to adjust to begin driving the next segment of the display, e.g., the "(k+1)th" segment. To prevent cross-talk SEL1[i+x] is set high at the conclusion of the final programming interval 527. Thus, all of the select lines in the "kth" segment are high during the transition delay 528. In an example with 5 rows in the "kth" segment, the programming period can have a duration of approximately 50 microseconds, which allows approximately 10 microseconds for each programming interval, and accompanying delay interval, which can be approximately 1 to 3 microseconds. Generally, the length of the delay intervals will depend on the response speeds of the switching transistors and the time required to change programming voltages on the data line.

After the programming period 520, the "kth" segment is then driven to emit light during an emission interval 530 according to the programming voltages provided during the programming period 520. During the emission interval 530, the segmented emission line ("EM[k]") is set low to allow current to flow through the drive transistors to the light emitting devices in the "kth" segment according to the voltages retained on the respective gate nodes (e.g., the gate node 412*g*) by the respective storage capacitors (e.g., the storage capacitor 415). Repeating the compensation, programming, and driving procedure for each segment of the display panel causes a single frame to be displayed on the display panel 20. At the conclusion of the drive interval 530, the "kth" segment undergoes another compensation operation and then receives programming information for the next frame. Thus, continuously repeating the compensation, programming and driving sequence for each segment of the display causes video to be displayed on the display panel 20. In a particular implementation, the duration of the driving interval 530, $t_{DRIVE}$ is dependent on the refresh rate of the display and/or the frame rate of the incoming video stream. For example, for a refresh rate of approximately 60 Hz, $t_{FRAME}$ can be approximately 16 milliseconds, and $t_{DRIVE} \approx t_{FRAME} - (t_{COMP} + t_{PRG})$. Furthermore, the duration of the compensation and programming cycles for each frame, i.e., $t_{COMP} + t_{PRG}$, is dependent at least in part on the number of segments in the display panel. In particular, the duration $t_{COMP} + t_{PRG}$ is desirably less than, or approximately equal to, tFRAME/nSeg, where nSeg is the number of segments in the display. Selecting the durations desirably allow each segment to undergo a compensation cycle and a programming cycle in sequence in a single frame, before the sequence is repeated to display the next frame.

Figure 10C:
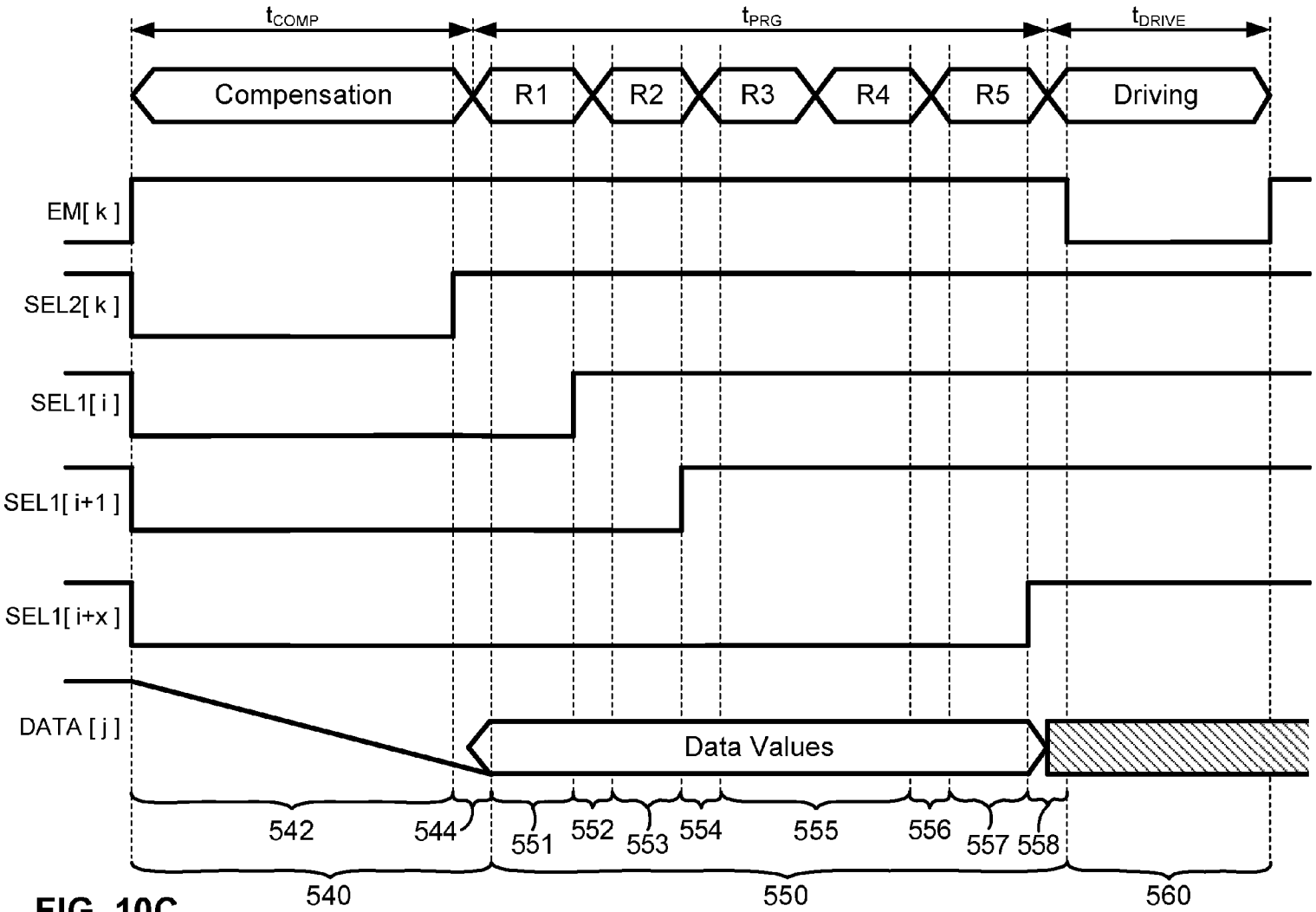
FIG. 10C is a timing diagram of another exemplary operation of the "kth" segment shown in FIG. 10A.

FIG. 10C is a timing diagram of another exemplary operation of the "kth" segment shown in FIG. 10A. Similar to FIG. 10B, operation of the "kth" segment includes a compensation interval 540, a programming period 550, and a driving interval 560. The compensation interval 540 begins similarly to the compensation interval 510 discussed in connection with FIG. 12A, with a ramp period 542 during which a ramp voltage is applied to the pixel circuits 410*a*, 410*b*, . . . 410*x* to provide a compensation operation to the segment simultaneously. However, during the transition delay period 544, the first selection lines (e.g., SEL1[i], SEL1[i+1], . . . SEL1[i+x]) are all kept low, rather than being switched high. The segmented second selection line 24*k* ("SEL2[k]") is set high at the initiation of the transition delay period 544.

During the programming period 550, the respective first selection lines are kept low until the conclusion of the programming interval for each respective row, at which point they are set high to disconnect the respective pixel circuit from the data line 22*j* before the next programming voltage is applied. Thus, the later-programmed pixel circuits in the "kth" segment are allowed to float with respect to the programming voltages applied to earlier-programmed pixel circuits. Once the programming voltage corresponding to the particular pixel circuit is applied on the data line 22*j*, the respective first selection transistor is turned off (by the respective first selection line) before the data line 22*j* is adjusted to a different value. Because the later-programmed pixel circuits in the "kth" segment are allowed to float during the programming of the earlier-programmed pixel circuits, the amount of adjustment to the gate nodes of the later-programmed pixel circuits retained by the respective storage capacitors (e.g., 415) is determined by the voltage on the data line 22*j* most recently before the first switch transistor (e.g., 417) is turned off. The arrangement in FIG. 10C thus allows for less voltage changes, overall, on the first selection lines (SEL1[i], SEL1[i+1], . . . , SEL1[i+x]) compared to the arrangement in FIG. 10B, which eases the burden on the address driver 8 operating the select lines.

The first programming interval 551 begins with all of the first selection transistors set low and the data line 22*j* set to Vp[i, j]. The first programming interval 551 ends with SEL1[i+1] being set high before the data line 22*j* adjusts to Vp[i+1, j] during the delay interval 552. During the delay interval 552, while the first pixel circuit 410*a* is disconnected from the data line 22*j*, the next programming voltage Vp[i+1, j] is charged on the data line 22*j*. The pixel circuit 410*b* is programmed during the second programming interval 553. SEL1[i+1] is set high during the delay interval 554 to disconnect the second pixel circuit 410*b* from the data line 22*j*. The remainder of the pixel circuits in the "kth" segment are programmed during the period 555, with each pixel circuit being disconnected from the data line 22*j* before the data line 22*j* is adjusted to a programming voltage for the next row, in a manner similar to the procedure for the first two rows described above. The final programming interval 557 is preceded by a delay interval 556 during which the data line 22*j* adjusts to Vp[i+x, j]. At the conclusion of the final programming interval 557, SEL1[i+x] is set high during the transition delay 558, at which point all of the first selection lines SEL1[i], SELL [i+1], . . . , SEL1[i+x] are set high and the "kth" segment is completely programmed. Once the "kth" segment is programmed, the emission interval 560 is commenced to drive the pixels in the "kth" segment to emit light according to the programming information stored in the respective storage capacitors. During the driving interval 560, other segments in the display are operated to provide compensation and/or programming operations.

Figure 11A:
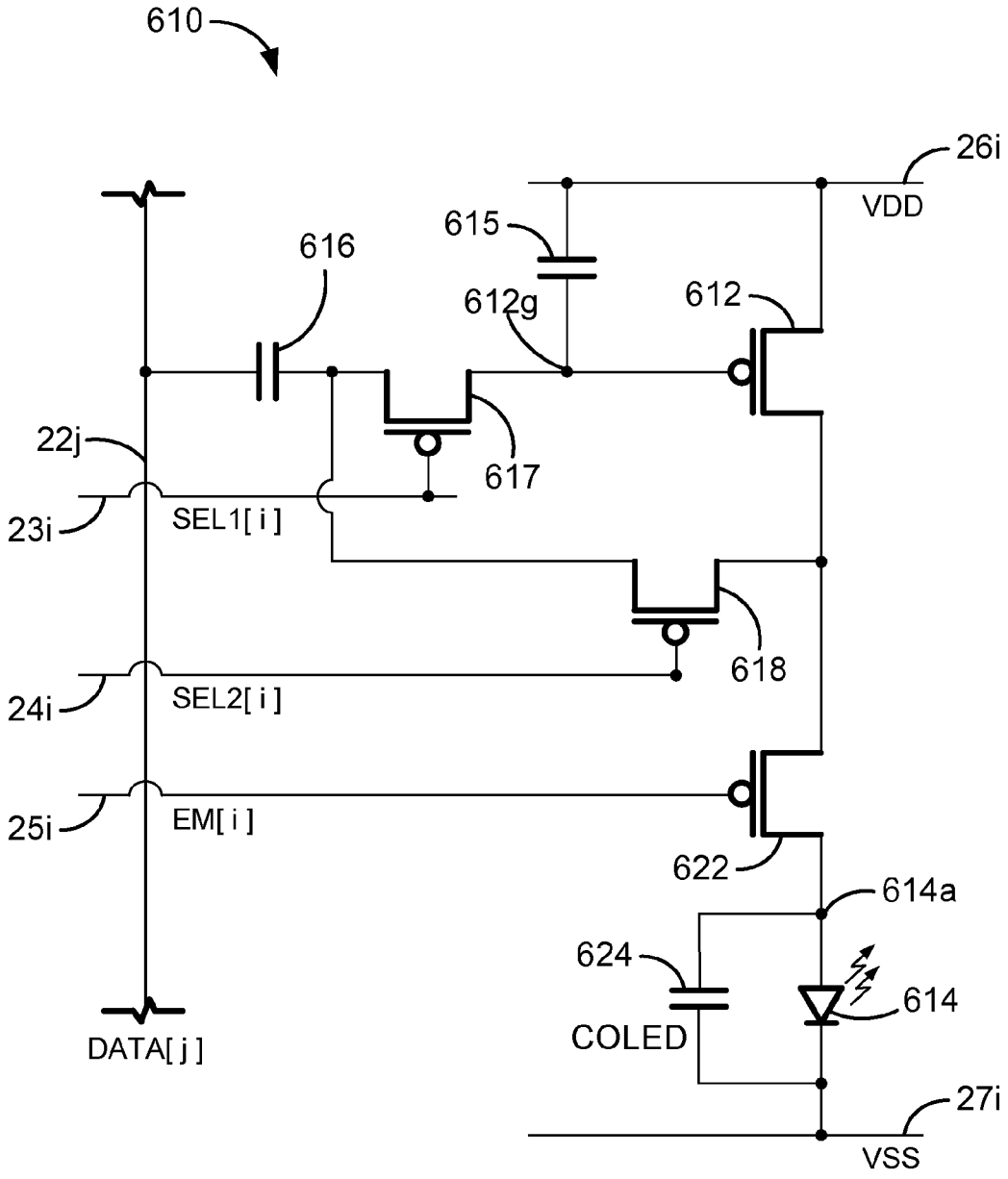
FIG. 11A illustrates an additional configuration of a pixel circuit configured to be programmed via a programming capacitor connected to a gate terminal of a drive transistor, via a first selection transistor, at a gate node.

FIG. 11A illustrates an additional configuration of a pixel circuit 610 configured to be programmed via a programming capacitor 616 connected to a gate terminal of a drive transistor 612, via a first selection transistor 617, at a gate node 612*g*. The pixel circuit 610 also includes a storage capacitor 615 connected to the gate terminal of the drive transistor 612 and a second selection transistor 618 configured to allow the gate terminal of the drive transistor 612 to adjust according to a compensation current flowing through the drive transistor 612. The pixel circuit 610 can be implemented in the display system 50 described above in connection with FIG. 1, and can be one of a plurality of similar pixel circuits arranged in rows and columns to form a display panel, such as the display panel 20 described in connection with FIG. 1. The pixel circuit 610 of FIG. 11A is similar in some respects to the pixel circuits 410, 410' of FIGS. 9A and 9B, but differs in the configuration of the second selection transistor 618. The difference in configuration allows for certain performance benefits of the pixel circuit 610 in comparison to the pixel circuits 410, 410' described above. In particular, the second selection transistor 618 is connected to a point between the programming capacitor 616 and the first selection transistor 617 rather than being connected directly to the gate node 612*g*.

Similar to the pixel circuit 610 includes both a first select line 23*i* ("SEL1") and a second select line 24*i* ("SEL2") for operating the first selection transistor 617 and the second selection transistor 618, respectively. The pixel circuit 410 also includes a connection to an emission control line 25*i* ("EM"). The first and second select lines 23*i*, 24*i* and the emission control line 25*i* can be operated by the address driver 8 in the display system 50 according to instructions from the controller 2. Programming information is conveyed as programming voltages on the data line 22*j*, which is driven by the data driver 4. Two voltage supply lines 26*i*, 27*i* supply a current source and/or sink for a driving current conveyed through the pixel circuit 610 according to programming information. Similar to the discussion of the pixel circuits 410, 410' in FIGS. 9A-9C above, the data line 22*j* is also driven with ramp voltages in order to generate compensation currents through the pixel circuits via the programming capacitor 616. The ramp voltages can be supplied by a system within the data driver 4 or by a separate ramp voltage generator that selectively connects to the data line 22*j* during periods when the ramp voltage is desired to be supplied to the data line 22*j*.

The pixel circuit 610 also includes an emission control transistor 622 operated according to the emission control line 25*i*, and a light emitting device 614, such as an organic light emitting diode or another emissive device. The drive transistor 612, emission control transistor 622, and the light emitting device 614 are connected in series such that while the emission control transistor 622 is turned on, a current conveyed through the drive transistor 612 is also conveyed through the light emitting device 614. The pixel circuit 610 also includes a storage capacitor 615 having a first terminal connected to a gate terminal of the drive transistor 612 at the gate node 612*g*. A second terminal of the storage capacitor 615 is connected to the voltage supply line 26*i*, or to another suitable voltage (e.g., a reference voltage) to allow the storage capacitor 615 to be charged according to programming information. The programming capacitor 616 is connected in series between the data line 22*j* and the first switch transistor 617. Thus, the first switch transistor 617 is connected between a first terminal of the programming capacitor 616 and the gate node 612*g*, while a second terminal of the programming capacitor 616 is connected to the data line 22*j*.

As noted above, the second switch transistor 618 is connected between a point between the programming capacitor 616 and the first selection transistor 617 and a point between the drive transistor 612 and the emission control transistor 622. Thus, the second selection transistor 618 is connected to the gate terminal of the drive transistor through the first selection transistor 617. In this configuration, the gate terminal of the drive transistor 612 is separated from the emission control transistor 622 by two transistors in series (i.e., the first and second selection transistor 617, 618), similar to the arrangement of the transistors 418, 419 in the pixel circuit 410' of FIG. 9B. Separating the gate node 612*g* from the path of the driving current by two transistors in series reduces leakage currents through the drive transistor 612 by preventing influences on the source/drain terminals of the drive transistor 612 from influencing the voltage of the gate node 612*g*.

Referring again to FIGS. 9A and 11A, certain transistors in the pixel circuit 610 provide functions similar in some respects to corresponding transistors in the pixel circuit 410. For example, in a manner similar to the drive transistor 412, the drive transistor 612 directs a current from the voltage supply line 26*i* from a first terminal (e.g., a source terminal) to a second terminal (e.g., a drain terminal) based on the voltage applied to the gate node 612*g*. The current directed through the drive transistor 612 is conveyed through the light emitting device 614, which emits light according to the current flowing through it similar to the light emitting device 414. In a manner similar to the operation of the emission control transistor 422, the emission control transistor 622 selectively allows current flowing through the drive transistor 612 to be directed to the light emitting device 614, and thereby increases a contrast ratio of the display by reducing accidental emissions of the light emitting device 614 during non-emission periods. The first selection transistor 617 selectively connecting the programming capacitor 616 to the gate node 612*g* to allow the gate node 612*g* to be influenced by programming voltages and/or compensation currents conveyed via the programming capacitor 616 by the capacitive coupling with the data line 22*j*. The pixel circuit 610 also includes the storage capacitor 615 connected between the gate node 612*g* and the voltage supply line 26*i* (or another suitable voltage). The first switch transistor 617 allows the gate node 612*g* to be isolated (e.g., not capacitively coupled) to the data line 22*j* during an emission operation of the pixel circuit 610.

The second selection transistor 618 is operated by the second select line 24*i* so as to selectively connect the second terminal of the drive transistor 612 to the gate node 612*g*, via the first selection transistor 617. Thus, while the first and second selection transistors 617, 618 are turned on, a current path is provided between the voltage supply line 26*i* to the gate node 612*g*, through the drive transistor 612, to allow the voltage on the gate node 612*g* to adjust to a voltage suitable to convey a compensation current through the drive transistor 612. The second selection transistor 618 is also operated to selectively connect the programming capacitor 616, while the first selection transistor 617 is turned off, to reset the programming capacitor 616 by discharging the programming capacitor 616 to the OLED capacitance ("COLED") 624 via the emission control transistor 622. Resetting the programming capacitor 616 can be performed prior to compensation and programming to minimize the effects of previous frames on the display.

While the first selection transistor 617 is turned off, the pixel circuit 610 drives current through the light emitting device 614 according to charge stored on the storage capacitor 615 without influence from the data line 22*j*. Thus, similar to the pixel circuit 410, a display array including a plurality of pixel circuits similar to the pixel circuit 610 can be operated to allow some pixel circuits to be driven to emit light while others connected to a common data line undergo a compensation or programming operation. In other words, the pixel circuit 610 allows for different functions (e.g., programming, compensation, emission) to be carried out in parallel.

Figure 11B:
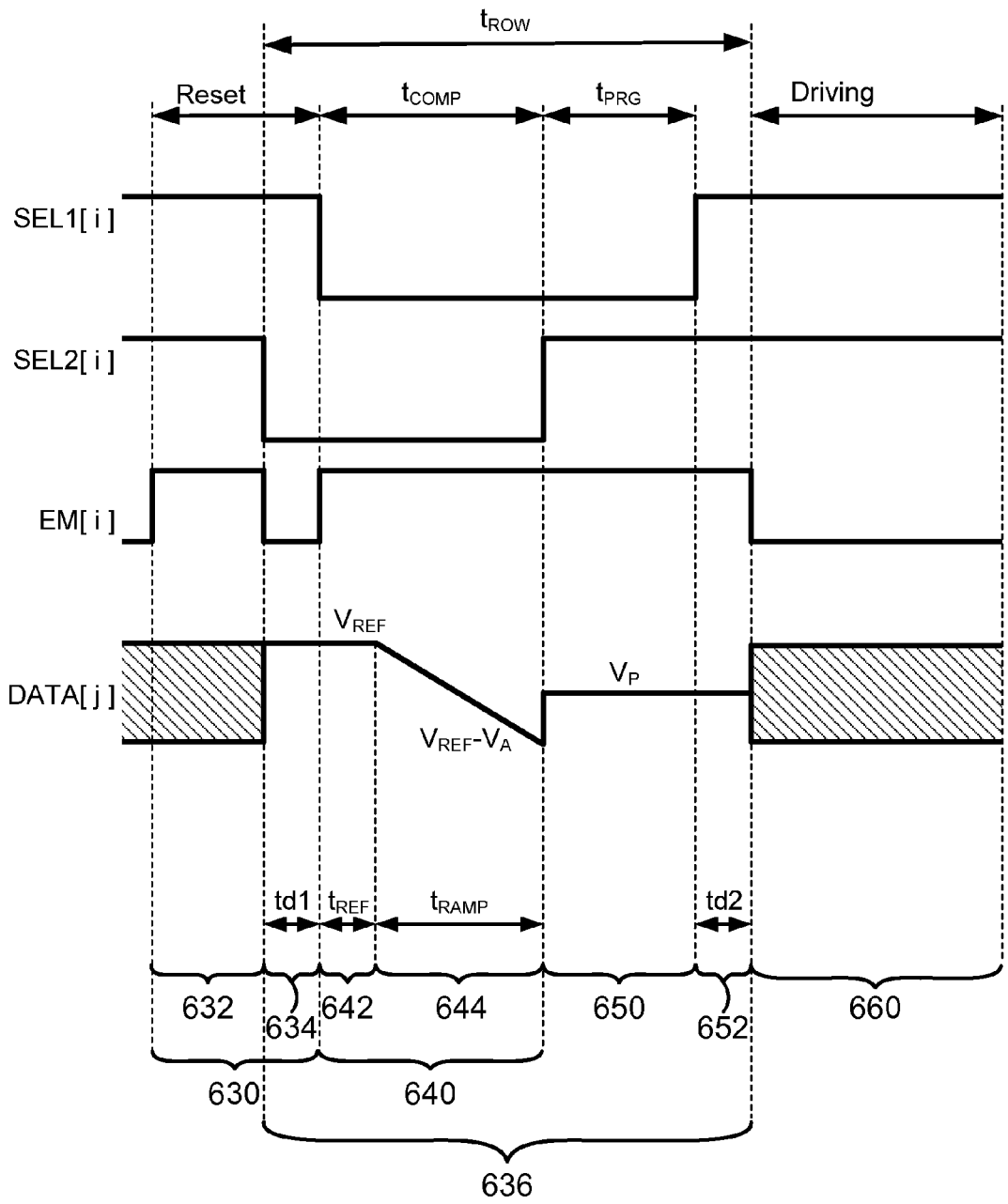
FIG. 11B is a timing diagram describing an exemplary operation of the pixel circuit of FIG. 11A.

FIG. 11B is a timing diagram describing an exemplary operation of the pixel circuit 610 of FIG. 11A. Operation of the pixel circuit 610 includes a reset cycle 630, a compensation cycle 640, a program cycle 650, and an emission cycle 660 (alternately referred to herein as a driving cycle). The entire duration that the data line 22*j* is manipulated to provide compensation and programming to the pixel circuit 610 is a row period 636 having a duration $t_{ROW}$. The duration of $t_{ROW}$ can be determined based on the number of rows in the display panel 20 and the refresh rate of the display system 50.

The reset cycle 630 includes a first phase 632 and a second phase 634. During the first phase 632, the emission control line EM[i] is set high to turn off the emission control transistor 622 and cease emission from the pixel circuit. Once the emission control transistor 622 is turned off, the driving current stops flowing through the light emitting device 614 and the voltage across the light emitting device 614 goes to the OLED off voltage, $V_{OLED}$(Off). While the emission control transistor 622 is turned off, current stops flowing through the drive transistor 612, and the stress on the drive transistor 612 during the first phase 632 is reduced.

For example, the light emitting device 614 can be an organic light emitting diode with a cathode connected to VSS and an anode connected to the emission control transistor 622 at a node 614*a*. At the end of the first phase 632, the voltage at the node 614*a* settles at $V_{OLED}$(Off), relative to VSS. During the second phase 634, the emission control line 25*i* is set low while the second select line 24*i* is also low and the data line 22*j* is set to a reference voltage $V_{REF}$. Thus, the second selection transistor 618 and the emission control transistor 622 are turned on to connect the programming capacitor 416 between the data line 22*j* charged to $V_{REF}$ and the node 614*a* charged to $V_{OLED}$(Off). The first selection transistor 617 is held off by the first select line 23*i* during the second phase 634 such that the gate of the drive transistor 612 is not influenced during the reset cycle 630.

The light emitting device 614 is illustrated connected in parallel with an OLED capacitance 624 ("COLED"), which represents the capacitance of the light emitting device 614. The OLED capacitance 624 is generally greater than the capacitance of the programming capacitor 616 such that connecting Cprg to COLED during the second phase 634 (via the emission control transistor 622 and the second selection transistor 618) allows the voltage on Cprg 616 to substantially discharge to COLED 624. The OLED capacitance 624 thus acts as a source or sink to discharge the voltage on Cprg 616 and thereby reset the programming capacitor 616. During the second phase 634, Cprg 616 and COLED 624 are connected in series and the voltage difference between VSS and $V_{REF}$ is allocated between them according to a voltage division relationship, with the bulk of the voltage drop being applied across the lesser of the two capacitances. The voltage across Cprg is close to be $V_{REF}+V_{OLED}-VSS$ considering COLED is larger than Cprg. Because the OLED 614 is turned off during the first phase 632, and the voltage at the node 614*a* allowed to settle at $V_{OLED}$(Off), the voltage changes on the node 614*a* during the second phase 634 are insufficient to turn on the OLED 614, such that no incidental emission occurs.

Following the reset cycle 630, the first and second select lines 23*i*, 24*i* and emission control line 25*i* are operated to provide the compensation cycle 640, the programming cycle 650, and the driving cycle 660, which are each similar to the compensation, programming, and driving cycles 440, 450, 450 discussed at length in connection with FIG. 9C. Because the operation of the pixel circuit 610 following the reset cycle 630 is substantially the same as the operation of the pixel circuits 410, 410' already discussed above, the compensation cycle 640, programming cycle 650, and driving cycles 660 are only briefly discussed below.

A ramp voltage is applied on the data line 22*j* during the compensation cycle 640 to convey a compensation current through pixel circuit 610 via the programming capacitor 616. The compensation cycle 640 is initiated with a reference voltage period 642 where the data line 22*j* is held constant at the reference voltage $V_{REF}$. During the ramp period 644, the voltage on the data line 22*j* is decreased from VREF to VA, at a substantially constant time derivative so as to convey a current through the drive transistor 612 and the second switch transistor 618 and allow the gate node 612*g* to adjust according to the conveyed current. During the programming cycle 650, the data line 22*j* is set to a programming voltage VP while the first selection transistor 617 is turned on and the second selection transistor 618 is turned off. One or more delay periods (e.g., the period 652) can separate the reset cycle 630, the compensation cycle 640, the programming cycle 650 and the driving cycle 660.

Displays are being sought with ever higher pixel densities, which influences designers to create pixel circuits with ever smaller areas to increase the number of pixels per area. To save space, pixel circuit designers look to reduce as many components as possible and to use smaller components whenever possible. Reduced capacitances have been employed, which are inherently more sensitive to dynamic effects on the data lines. Resetting the programming capacitor 616 in the reset cycle 630 reduces the effects of prior frames during the compensation cycle 640 and the programming cycle 650, mitigates the dynamic effects, and thereby allows for the selection of a reduced capacitance value for the programming capacitor, which saves space in the circuit layout and allows for an increase in pixel density.

Figure 12A:
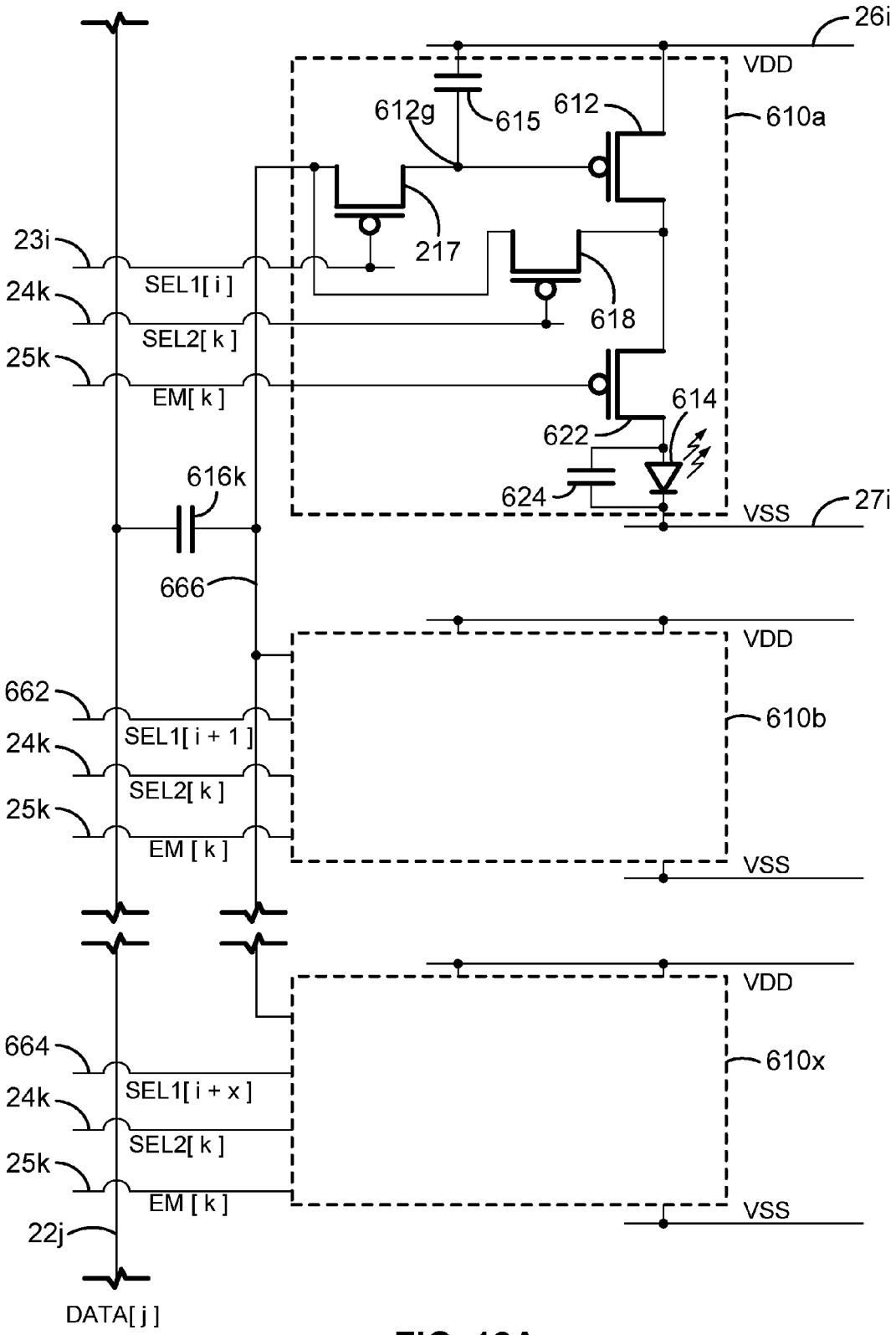
FIG. 12A is a timing diagram of an exemplary operation of the "kth" segment shown in FIG. 11.

FIG. 12A illustrates a circuit diagram of a portion of a display panel in which multiple pixel circuits 610*a*, 610*b*, 610*x* are arranged to share a common programming capacitor 616*k*. The pixel circuits 610*a*, 610*b*, 610*x* represent a portion of a display panel suitable for incorporation in a display system, such as the display system 50 discussed in connection with FIG. 1. The pixel circuits 610*a-x* are a group of pixel circuits in a common column of the display panel (e.g., the "jth" column) and can be in adjacent rows of the display panel (e.g., the "ith," "(i+1)th," through to the "(i+x)th" rows). The pixel circuits 610*a-x* are configured similarly to the pixel circuit 610 described above in connection with FIGS. 11A-11B, except that the group of pixels circuits 610*a-x* all share the common programming capacitor 616*k*. The group of pixel circuits 610*a-x* are each connected to a segment data line 666 that is connected to a first terminal of the common programming capacitor 616*k* while a second terminal of the common programming capacitor 616*k* is connected to the data line 22*j*.

The group of pixel circuits 610*a-x* that share the common programming capacitor 616*k* are included in a segment of the display panel 20 which is a sub-group of the pixel circuits in the display panel 20. The segment including the pixel circuits 610*a-x* can also extend to each of the pixel circuits in a common row with the pixel circuits 610*a-x*, i.e., the pixel circuits in the display panel 20 having a common first select line with the pixel circuits 610*a-x* (SEL1[i] to SEL11[i+x]). Among the plurality of pixel circuits in the segment, pixels circuits in a common column of the display panel 20 i.e., the pixel circuits connected to the same data line (DATA[j]), share the common programming capacitor 616*k* and are controlled according to segmented emission and second select lines 24*k*, 25*k*. For convenience the group of pixel circuits 610*a-x* (and the pixel circuits in the same rows as the pixel circuits 610*a-x*) is referred to herein as the "kth" segment.

For clarity in explanation, the "kth" segment referred to herein will be described by way of example as a segment including 5 adjacent rows of pixel circuits. In this way an entire display panel can be divided into segments ("sub-groups") of 5 rows each. For example, a display panel with 720 rows can be divided into 144 segments, each having 5 adjacent rows of the display panel. However, it is noted that the discussions herein of segmented display architectures is generally not so limited, and the discussions herein referring to segments having 5 rows can generally be extended to segments having more than, or less than, 5 rows, such as 4 rows, 6 rows, 8 rows, 10 rows, 16 rows, 1, etc., or a number of rows that evenly divides the total number of rows in the display panel, and also to segments including non-adjacent rows of a display panel, such as interleaved rows (odd/even rows), etc.

Figure 12B:
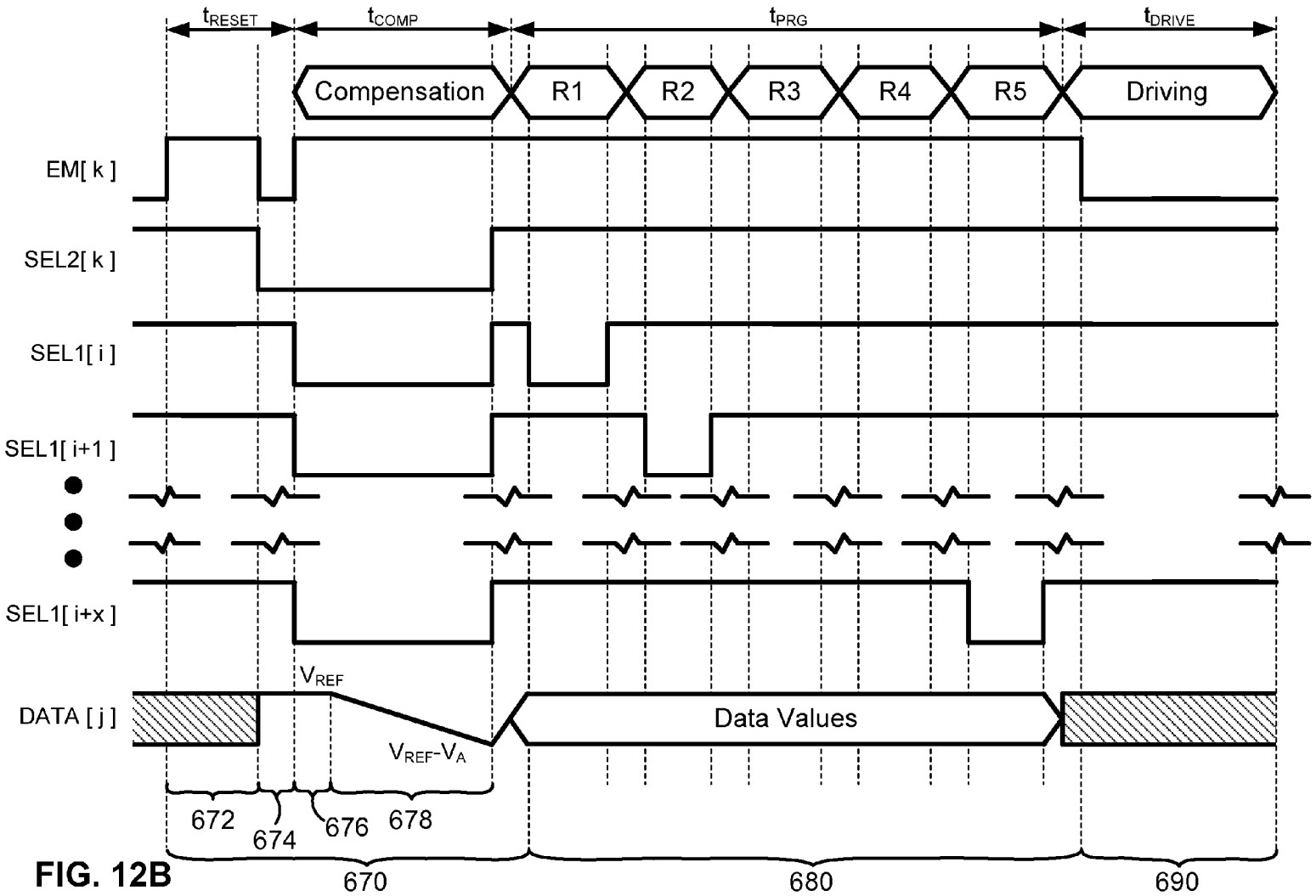
FIG. 12B is a timing diagram of another exemplary operation of the "kth" segment shown in FIG. 11.

FIG. 12B is a timing diagram of an exemplary operation of the "kth" segment shown in FIG. 12A. Operation of the "kth" segment includes a reset and compensation period 670, a programming period 680, and a driving cycle 690. The reset and compensation period 670 includes a first phase 672 during which the light emitting devices in the "kth" segment are turned off by operation of the segmented emission control line 25*k* ("EM[k]"). During the first phase 672, the emission control transistors (e.g., 622) in each pixel circuit in the "kth" segment are turned off, which allows the light emitting devices in each pixel circuit to settle at their respective off voltages. The first phase 672 is followed by a second phase 674 where the segmented second select line 24*k* ("SEL2[k]") and EM[k] 25*k* are both set low to allow the programming capacitors 616*k* for each segment to discharge to the OLED capacitances (e.g., COLED) in each respective segment. During the second phase 674 ("discharge phase"), the OLED capacitances in each segment for a common data line are connected in parallel through the segmented data line 666. The total capacitance of the parallel connected OLED capacitances thus provides a source or sink to discharge the voltage on the segmented programming capacitor 616*k* and thereby clear the effects of previous frames from the segmented programming capacitor 616*k*.

Following the first and second phases 672, 674, the segmented programming capacitor is reset according to the reference voltage $V_{REF}$ applied on the data line 22*j* during the second phase 674. The segmented emission line 25*k* is then set high to prevent incidental emission from the light emitting devices 614 in the "kth" segment during the compensation and programming operations. Compensation is carried out by initializing the data line 22*j* to $V_{REF}$ during a reference period 676 and then providing a ramp voltage on the data line 22*j* during a ramp period 678. The ramp voltage changes from $V_{REF}$ to $V_{REF}-V_A$ with a substantially constant time derivative such that a compensation current is conveyed through the segmented programming capacitor 616*k*. The first select lines in the segment (e.g., the select lines 23*i*, 662, 664, etc.) and the segmented second select line 24*k* are held low during the application of the ramp voltage to allow the gate of the respective drive transistors in the segment to adjust according to the compensation current conveyed through the pixel circuits by the segmented programming capacitor 616*k*. Thus, voltages are established on each of the respective gate nodes of the pixel circuits 610*a-x* during the compensation cycle that account for variations and/or degradations in the respective drive transistors, such as degradations due to threshold voltage variations, mobility variations, etc.

Following the reset and compensation period 670, SEL2[k] is set high during the programming period 680, to fix the compensation voltage on the storage capacitor of each pixel circuit in the segment. The rows in the "kth" segment are sequentially voltage programmed, by sequentially selecting the respective first select lines (SEL1[i], SEL1[i+1], . . . , SEL1[i+x]) for each row during programming intervals separated by delay intervals included in the programming period 680. Programming voltages for each row are provided on the data line 22*j*, during the appropriate programming intervals. Following the programming of each respective row, the respective first select line is set high to disconnect the drive transistor from the segmented data line 666, and allow for programming of subsequent pixel circuits in the segment without influencing the voltages on the already programmed pixels. The pixel circuits are then driven to emit light according to the voltages stored on their respective storage capacitors (e.g., the storage capacitor 615) during the driving period 690. The programming period 680 and the driving period 690 are thus similar to the programming periods 520, 550 and driving periods 530, 560 discussed above in connection with FIGS. 10B-10C.

Figure 13A:
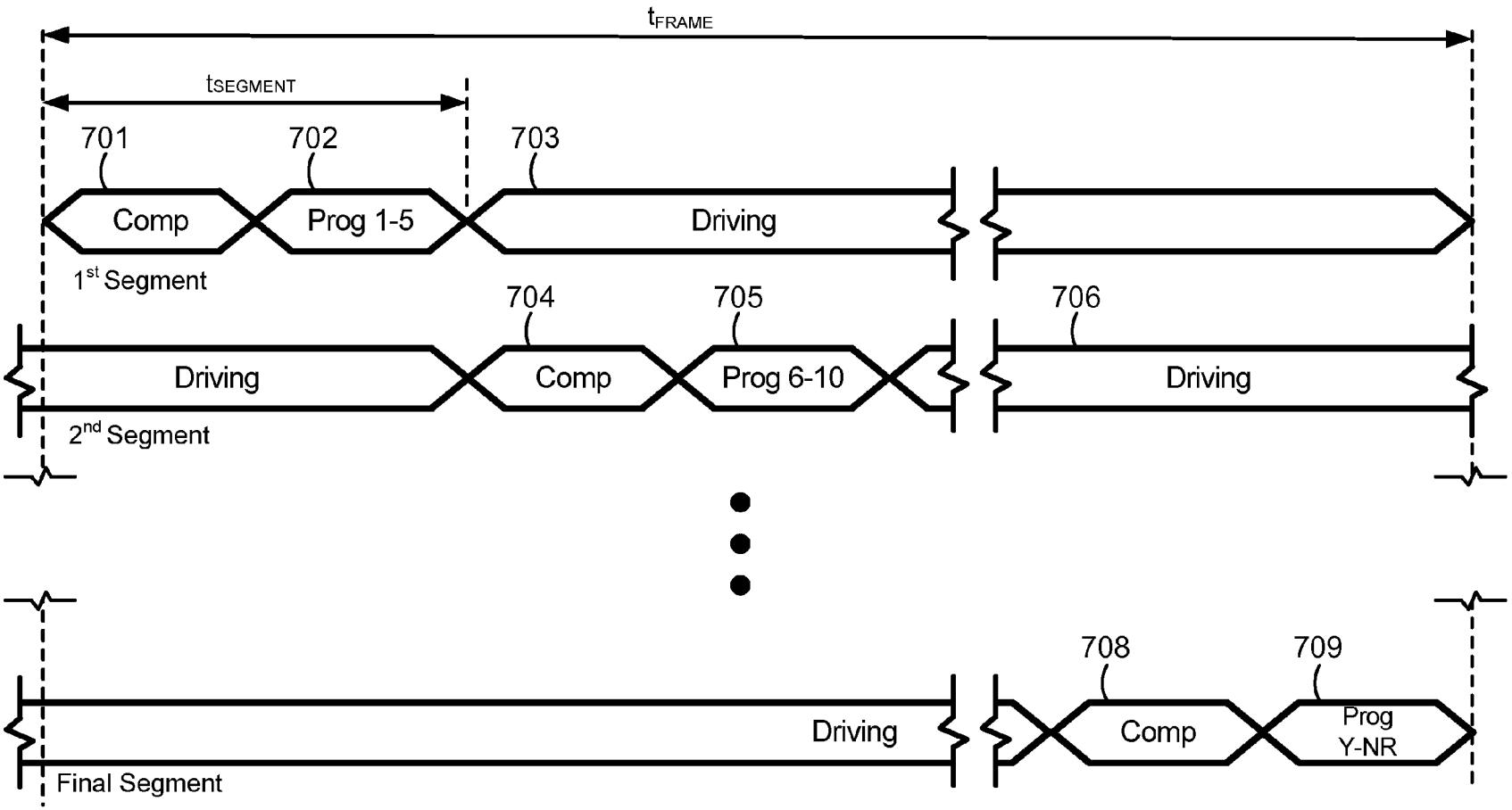
FIG. 13A is a timing diagram for driving a single frame of a segmented display.

FIG. 13A illustrates a timing diagram for driving a single frame of a segmented display. The example timing diagram in FIG. 13A refers to an arrangement where the display panel is segmented into multiple segments each having 5 rows, such that the first segment includes rows 1 through 5, the second segment includes rows 6 through 10, etc. The final segment includes rows Y through NR, where NR is the number of rows in the display, and Y is a number 4 less than NR. However, the present disclosure is not limited to segments having 5 rows or to segments having adjacent rows. For example, a segmented display with two rows can be formed a first segment including all of the even rows and a second segment including all of the odd rows. In another example, a segmented display can include a first segment including pixels in odd rows and odd columns, a second segment including pixels in odd rows and even columns, a third segment including pixels in even rows and odd columns, and a fourth segment including pixels in even rows and even columns. Other examples of segments are also applicable to the present disclosure, but in the interests of brevity it suffices to note that the driving schemes described herein for segmented displays apply to segments having less than, or more than, 5 rows, to segments including non-adjacent rows, and to segments including only portions of rows.

Referring to FIG. 13A, the data lines (e.g., 22*j*, 22*m*, etc.) of the display system 50 are driven such that rows 1 through 5 (the first segment) are compensated in a compensation cycle (701), and then rows 1 through 5 are programmed in a programming cycle (702), and driven to emit light in an emission cycle (703). The sequence of compensation, programming, and emission can be carried out according to the timing diagrams shown in FIGS. 10B-10C, for example. The duration of the compensation cycle (701) and the programming cycle (702) for the first segment has a duration $t_{SEGMENT}$. Where the number of segments is relatively large, the duration of $t_{SEGMENT}$ can be approximately given by $t_{SEGMENT} \approx t_{FRAME}$/(Number of Segments). Following the programming of the first segment (702), the data lines (e.g., 22*j*, 22*m*, etc.) are driven to provide a compensation cycle to the pixels in rows 6 through 10 (704), a programming cycle (705), and an emission cycle (706). The procedure continues to provide compensation and programming to all the segments in the display panel 20 until the final segment (rows Y through NR) is driven in a compensation cycle (708) and a programming cycle (709).

In other examples, a reset period can occur prior to the compensation periods 701, 704, 708, to reset the respective segmented programming capacitors for each segment. The reset period can be similar to the reset cycles discussed above in connection with FIGS. 10A-12B and include a first phase and a second phase. During the first phase the light emitting devices in the segment are turned off by the segmented emission control line to allow the voltage across the light emitting devices (and the OLED capacitances) to settle at the OLED off voltage. During the second phase, the segmented programming capacitor is connected the OLED capacitances to discharge the segmented programming capacitor while the reference voltage is applied to the data line to reset the segmented programming capacitor and decrease the influence of previous frames on the operation of the pixel circuits. In an example including a reset period, the duration of $t_{SEGMENT}$ is roughly the sum of the durations of the compensation cycle 701, the programming cycle 702, and the second phase of the reset period. The first phase of the reset period is not included in $t_{SEGMENT}$, because $t_{SEGMENT}$ indicates the duration that each segment operates the data line 22*j*, and the data line 22*j* is disconnected from the segment during the first phase of the reset period, i.e., the first and second select lines are set high during the first phase (e.g., 672).

The driving scheme provided by the timing diagram in FIG. 13A allows the data lines (22*j*, 22*m*, etc.) to be substantially continuously utilized by the driver 4 to convey ramp voltages and/or programming voltages, without the need for periods where all pixels are driven to emit light and none undergo programming and/or compensation operations. The parallel operation scheme provided by aspects of the present disclosure thereby maximizes available time for programming and/or compensation. Additionally or alternatively, the parallel operation scheme provided by aspects of the present disclosure maximizes the frame rate that can be provided by a display system operated according to the parallel operation scheme.

Furthermore, by allowing the pixels to be in driving cycles nearly the entire time they are not being programmed or compensated, which is possible due to the first switch transistor 417 and the storage capacitor 415, the display operates with a duty cycle approaching 100%. As a result, the light emitting devices can be driven to emit light with roughly half the intensity of a display operating at a 50% duty cycle and still maintain the same cumulative light output from the display at each frame. Thus, the relatively high duty cycle enabled by the present disclosure allows the light emitting devices to emit light at a decreased intensity, which corresponds to a decreased driving current. Driving the light emitting devices and the driving transistors at the decreased driving current causes those components to age ("degrade") relatively less than would be the case with higher driving currents that generate relatively more electrical stress on the semi-conductive materials in the light emitting device and/or driving transistor.

Figure 13B:
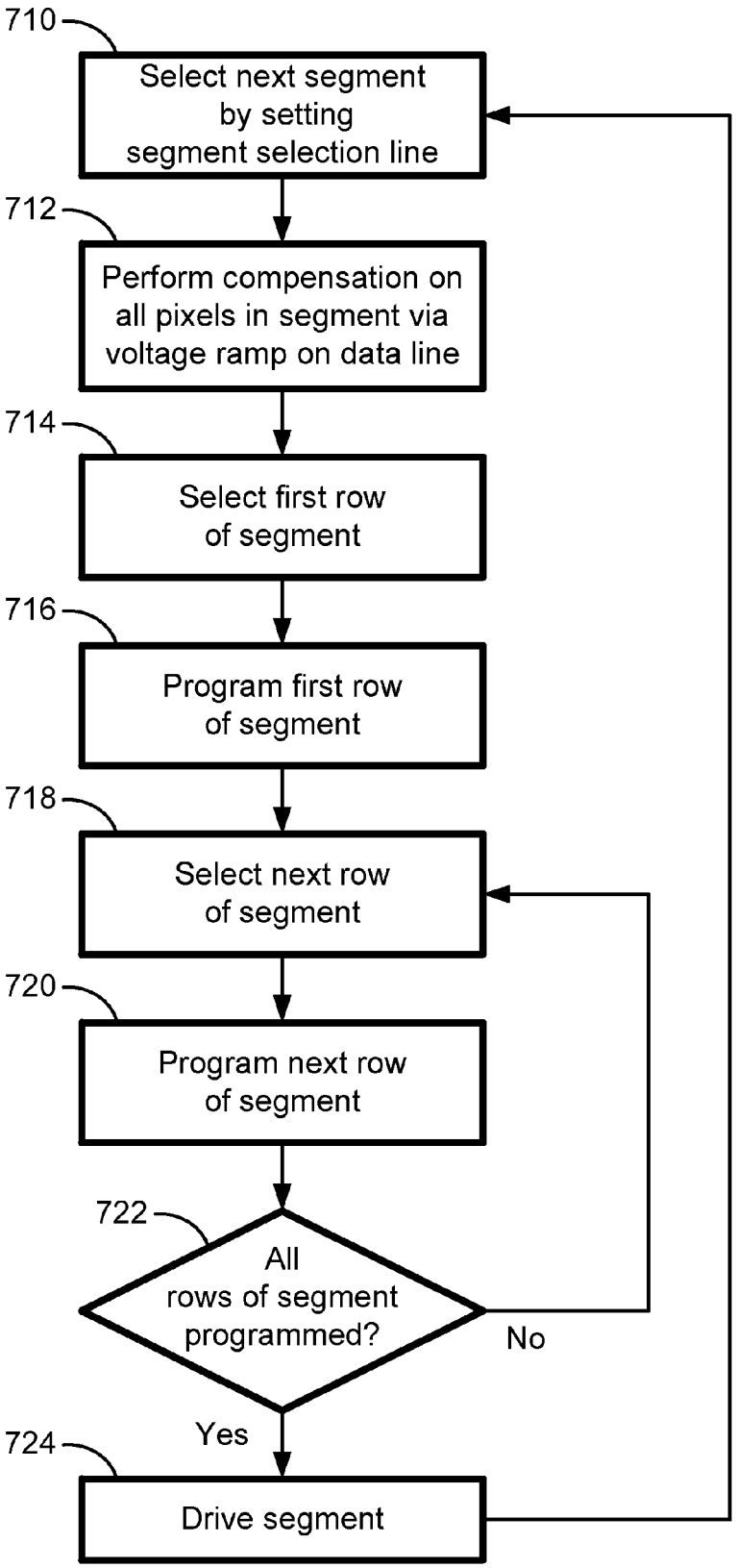
FIG. 13B is a flow chart corresponding to the timing diagram shown in FIG. 13A.

FIG. 13B is a flowchart corresponding to the driving scheme shown in the timing diagram in FIG. 13A. The operation of the flowchart is described in reference generally to the example display system illustrated in FIG. 10A, however, the flowchart also applies to the display system illustrated in FIG. 12A. The next segment is selected by adjusting the select lines shared by the segment to values appropriate for compensation (710). For example, in the display panel configuration shown in FIG. 10A, the segmented second select line 24*k* is set low, to allow the current generated by the ramp voltage to be conveyed through the driving transistor, and the segmented emission line 25*k* is set high, to prevent incidental emission during programming and compensation. In the display panel configuration shown in FIG. 12A, the select lines can be adjusted to provide for reset and compensation, similar to the operation during the reset and compensation period 670 of FIG. 12B. The pixels in the selected segment then undergo a compensation operation (712). The compensation operation can be carried out by generating a voltage ramp on the data line 22*j*, which is applied to the common programming capacitor 416*k* to apply a corresponding current to the pixels in the segment (e.g., 410*a-x*). Each of the first select lines 23*i*, 474, 478 are also set low during the compensation operation to keep the associated first switch transistors (e.g., 417, 617) turned on. During the compensation operation, the gate nodes of the pixel circuits 410*a-x* self-adjust to voltages accounting for the variations in driving transistor threshold voltages. The self-adjustment occurs due to the current passing through the respective drive transistors through the second switch transistors, which adjusts the gate nodes of the driving transistors.

The compensation operation is concluded by turning off the second switch transistors via the segmented second select line 24*k*. The pixels in the selected segmented are then voltage-programmed one row at a time. The first row is selected by setting the first select line (e.g., 23*i*) for the first row of the segment low (714). The first row of the segment is then programmed by setting the data lines to provide programming voltages appropriate for the pixels in the first row (716). The first select line for the first row (e.g., 23*i*) high to disconnect the gate nodes of the pixels and the storage capacitor 415, from the data line 22*j*, and the programming information is retained by the storage capacitor 415. The next row in the segment is selected (718), and that is voltage programmed similarly to the first row (720). If all the rows in the segment have not yet been programmed (722), the next row of the segment is selected (718) and programmed (720) and the process is repeated until all the rows in the segment have been programmed.

Once all the rows in the segment have been programmed (722), a driving operation is performed on the segment (724). During the driving operation (724), the segmented emission line 24*k* for the segment is set low to allow the emission transistors (e.g., 422, 622) in each pixel in the segment to convey current to the light emitting device (e.g., 414, 614) via the driving transistor (e.g., 412, 612). The first and second switch transistors are turned off in each pixel circuit in the segment during the driving operation such that the programming information is retained by the storage capacitors within each pixel circuit independently of the present value on the data line. With the selected segment set in the driving operation (e.g., the driving cycles 530, 560, 690), the driving scheme returns to the beginning to select the next segment in the display (710) and the operation is repeated on the next segment, and each successive segment until returning again to the original segment. A single frame of a video display is displayed in the time passed between successive compensation and programming operations of the same segment of a display.

Figure 14A:
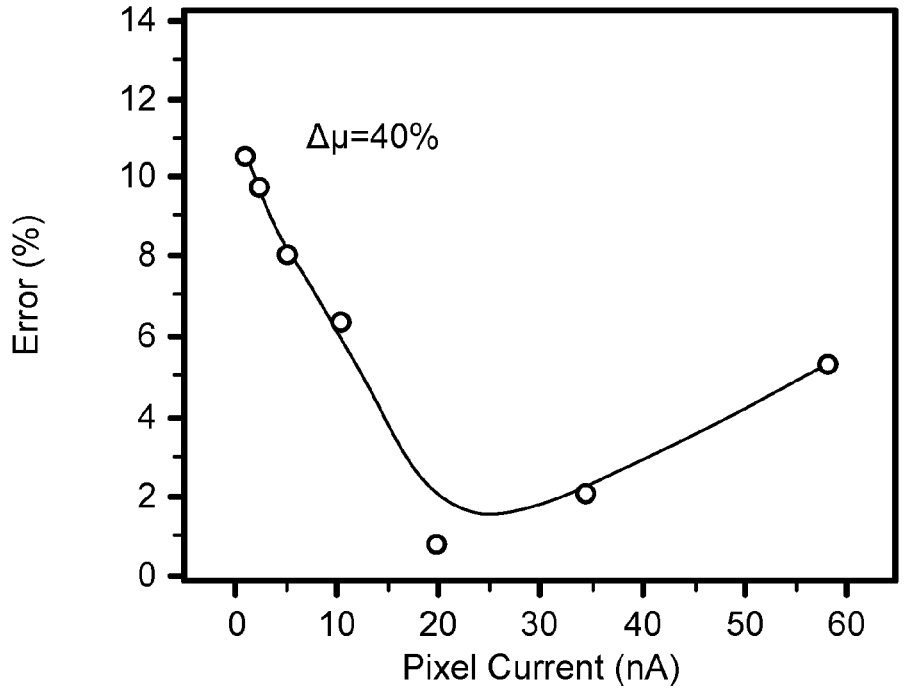
FIGS. 14A and 14B provide experimental results of percentage errors in pixel currents given variations in device parameters for pixel circuits such as those shown in FIGS. 9A and 9B.
Figure 14B:
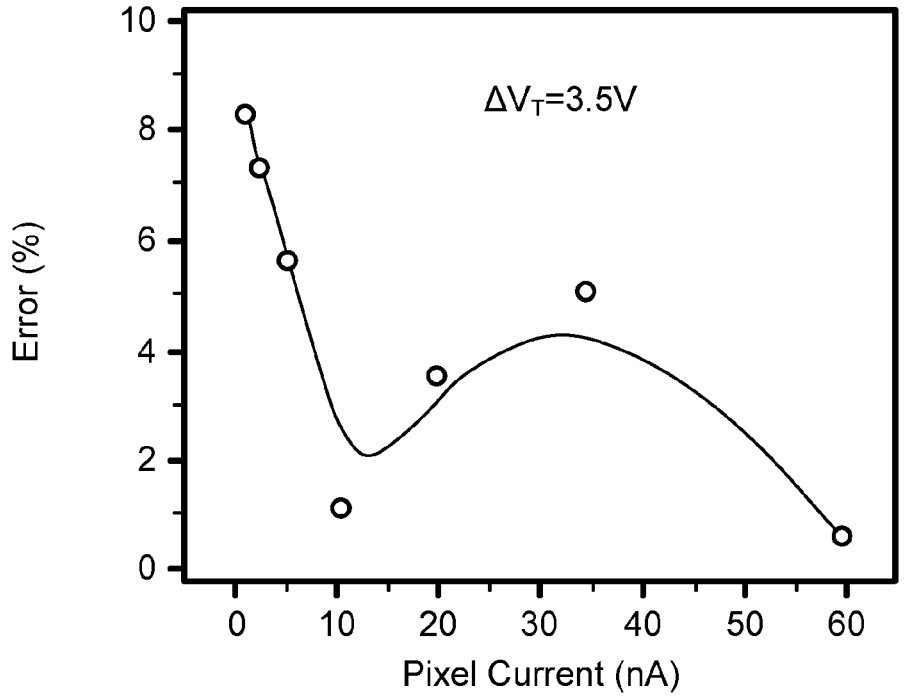

FIGS. 14A and 14B provide experimental results of percentage errors in pixel currents given variations in device parameters for pixel circuits such as those shown in FIGS. 9A and 9B. It is particularly noted that the percentage error in pixel current correlates to a percentage error in luminescence from the light emitting device, because the light emitting device emits light in proportion to the current passing through the device. FIG. 14A provides the simulated error in pixel current from the pixel circuit 410' shown in FIG. 9B when the pixel circuit is programmed at a range of grayscale data values and the drive transistor 412 has a variation in mobility of 40% (e.g., from 0.8 to 1.2). As shown in FIG. 14A, the error in pixel current is under about 6% for most grayscale values, and approaches about 10% for very low pixel currents, even with a mobility variation of 40% on the drive transistor 412.

FIG. 14B provides the simulated error in pixel current from the pixel circuit 410' shown in FIG. 9B when the pixel circuit is programmed at a range of grayscale data values and the drive transistor 412 has a threshold voltage that varies by 3.5 V (e.g., from −0.5 V to −4.0 V). As shown in FIG. 14B, the error in pixel current is under about 6% for most grayscales, and approaches about 8% for very low pixel currents, even with a threshold voltage variation of 3.5 V on the drive transistor 412.

The pixel circuit 410' that achieved the simulated error results shown in FIGS. 14A and 14B was arranged with transistor components as shown in the Table 1 below. Thus, Table 1 provides a single non-limiting listing of potential values for the components in the pixel circuit 410'. With regard to the capacitor values, it is noted that tests have been performed with storage capacitors at 200 fF and programming capacitors at 270 fF. Generally, the capacitance values of the programming capacitor, Cprg, the storage capacitor, Cs, the dynamic range of the ramp (e.g., voltage change from the maximum to the minimum values of the ramp), and the desired bias current to be generated via the ramp voltage and the programming capacitor allows for calculation of the display timing. For example, where the dynamic range is 4 V, Cprg can be 230 fF and Cs can be 170 fF to provide a desired bias current during a 15 μs compensation cycle.

TABLE 1

Exemplary values of circuit elements in pixel circuit shown in FIG. 9B

| Circuit Component | Specification | Element in FIG. 9B |
|---|---|---|
| Driving Transistor | W/L = 5/5 μm | 412 |
| First Switch Transistor | W/L = 4/4 μm | 417 |
| Second Switch Transistor | W/L = 4/4 μm | 418 |
| Additional Switch Transistor | W/L = 4/4 μm | 419 |
| Emission Transistor | W/L = 4/4 μm | 422 |
| Storage Capacitor | 400 fF | 415 |
| Programming Capacitor | 270 fF | 416 |

FIGS. 14A and 14B indicate that degradations in the drive transistor 412 due to both mobility variations or threshold voltage variations are well compensated by the pixel circuits described herein. Generally, the pixel circuits described herein provide compensation by applying a current to allow the drive transistor to adjust its gate voltage according to the parameters of the drive transistor ($V_T$, $C_{ox}$, μ, etc.), as described, for example, in connection with equations 14-20. As shown herein, the compensation operation can be performed before programming (e.g., FIGS. 9A-9C), during programming (e.g., FIGS. 8A-8B), or following programming (FIGS. 4A-4F). Furthermore, aspects and features of the pixel circuits and driving schemes described separately herein can be modified so as to combine separately described features in a single pixel circuit and/or scheme of operation. For example, the use of a ramp voltage to generate a current through the drive transistor during compensation can be applied to the pixel circuit 210 of FIGS. 4A-4F, or the use of a bias current on the data line can be applied to the pixel circuit 410 of FIGS. 9A-9C, or the pixel circuit 310 of FIG. 8A can be modified to include a second capacitor similar to the storage capacitor 415 of FIGS. 9A-9B, etc.

FIG. 15A is a circuit diagram showing a portion of the gate driver 8 including control lines ("CNTi") 734 to regulate the first select lines for each segment. For example, the address driver 8 can includes outputs for the lines that are shared within each segment, e.g., the segmented emission line 25*k* and the segmented second select line 24*k*. The address driver 8 can also include gate outputs ("Gate k") that combines with the control lines 734 to generate the first select lines 740 to each segment of the display array. As shown in FIG. 15A, the gate output 738 is connected to the first select lines 740 via a first switch 730 operated by the control lines 734. Inverse control lines "(/CNTi") 736 control a second switch 732. One side of the second switch 732 is connected to a high voltage line ("Vgh") 742. The other side of the second switch 732 is electrically connected to a node of the first switch 730 other than the one connected to the gate output 738. That is, the second switch 732 is electrically connected to the node of the first switch 730 that is also connected to the first select lines 740. The second switch 732 thus conveys the voltage on the high voltage line 742 to the first select lines 740 while the second switch 732 is closed and the first switch 730 is open. Selectively receiving the output of the gate output 738 or the high voltage line 742 depending on the status of the control lines 734 and inverse control lines 736.

The inverse control lines 736 are configured to provide signals opposite to the control lines 734, thus when the CNTi lines are high, the /CNTi lines are low, and vice versa. The switches 734, 736 are switches that are selectively opened and closed according to the signals on the control lines 734 and inverse control lines 736, respectively, such that the first switch 730 is open while the second switch 732 is closed, and vice versa. Thus, when the control line 734 is high (and the inverse control line 736 is low), the first select lines 630 receive the high voltage on the high voltage line 742 via the second switch 732, which is closed. When the control line 734 is low (and the inverse control line 736 is high), the first select lines 740 receive the voltage on the gate output 738.

FIG. 15B is a diagram of the first two gate outputs 750, 760 which are used to provide the first select lines for the first two segments. Thus, the first gate output ("Gate #0") 750 can be connected to first select lines 751-755 for the first five rows of the display, which first five rows comprise the first segment of the display. The first gate output 750 is connected to each of the first select lines 751-755 via a switch controlled by one of the control lines 734. In at least some examples, the switchable connection between the gate output 750 and each of the first select lines 751-755 is a switchable connection similar to the arrangement shown in FIG. 15A. Each switchable connection can include two switches (similar to the switches 730, 732) that are controlled by a control line and an inverse control line, respectively (similar to the lines 734, 736) such that one switch is on while the other is off and the first select line receives either the voltage on the gate output 750 or a high voltage Vgh, depending on the control line values.

In one example, the first select line for the first row 751 ("SEL 1(1)") receives a high voltage Vgh while the first control line CNT1 is set high. While CNT1 is high, the switch between SEL1(1) 751 and the first gate output 750 is open, and so SEL 1(1) 751 does not receive the voltage on the first gate output 750. However, while CNT1 is high, the inverse of CNT1, which is referred to herein as "/CNT1," is set low, and a switch connected to SEL 1(1) 751, not to the first gate output 750 (switch not shown, but arranged similarly to the switch 622 in FIG. 15A) is turned on so as to connect SEL 1(1) to Vgh. The boxed switches shown in FIG. 15B thus each represent two switches arranged as shown in FIG. 15A to selectively connect the first select lines 751-755 to either the gate output 750 or the high voltage Vgh.

As arranged in FIGS. 15A-15B, SEL 1(1) 751 is low only when the first gate output 750 is low and the first control line CNT1 is also low. During a period when the first gate output 750 is high, such as during a period when the first segment is not being selected for compensation and/or programming, then SEL 1(1) 751 is always high, whether CNT1 is low and SEL 1(1) 751 receives the high voltage from the first gate output 750 or CNT1 is high and SEL 1(1) 751 receives the high voltage from the high voltage line 742. The first select lines 752-755 for the other rows of the first segment are similarly arranged. Thus, the first select lines 751-755 in the first segment are only low so as to turn on the respective first switch transistors in the pixels of the first segment during periods when the first gate output 750 is set low, otherwise the first select lines 751-755 remain high.

The second gate output 760 is connected to first select lines 761-765 for the second segment of the display, and each of the first select lines 761-765 receive either the voltage on the second gate output 760 or a high voltage Vgh according to the control line signals. The control line signals (e.g., CNT1, CNT2, . . . , CNT5) used to generate the first select lines for the first segment are also used to drive the first select lines for the second segment. A separate gate output (similar to gate outputs 750, 760) is included for each segment in the display array, with each gate output used to drive the first select lines in the respective segment as shown in FIGS. 15A-15B. The final segment is driven by first select lines controlled according to the final gate output ("Gate #n"). In an example where each segment includes 5 rows, the final segment thus includes rows n×5+1 through n×5+5, where the number n is an index for the number of segments that starts at zero, and increments for each segment to the "(n+1)th" segment, which is reflected by the first segment being referred to as "Gate #0". In the 5 rows per segment example, the total number of segments is given by (Number of Rows)/5.

For convenience in the description above, various signals, such as the gate outputs 750, 760, and control lines are described as "outputs." However, it is understood that an implementation of an address driver, such as the address driver 8 of the display system 50 shown in FIG. 1, may be configured as an integrated unit with outputs for each first select line, segmented second select line, and/or segmented emission control line, as necessary to operate the pixel circuits described herein. In particular, an address driver configured according to the present disclosure can be arranged with one or more of the switches operated by control lines, e.g., the switches 730, 732 shown in FIG. 15A, internal to the address driver or external to the address driver.

In some instances, the switches 730, 732 can be transistors and the control lines 734 and inverse control lines 732 can be connected to the gates of the transistors to thereby selectively control the conductivity of the channel regions of the transistors so as to open and close the switches 730, 732.

Figure 16:
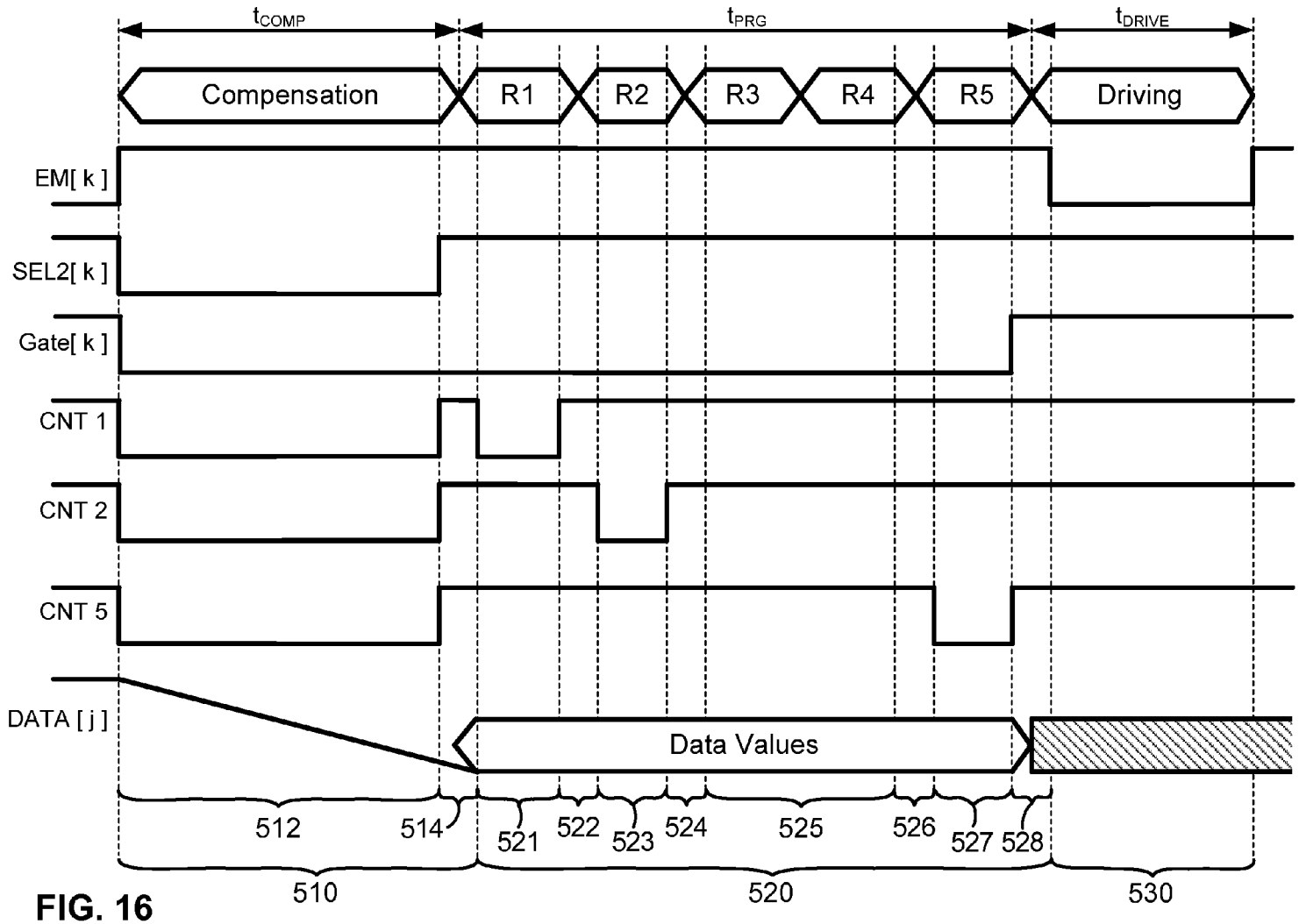
FIG. 16 is a timing diagram for a display array operated by an address driver utilizing control lines to generate the first select line signals.

FIG. 16 is a timing diagram for a display array operated by an address driver utilizing control lines to generate the first select line signals. The timing diagram shown in FIG. 16 provides a compensation, programming, and driving operation for the "kth" segment of the display similar to the timing diagram shown in FIG. 10B or FIG. 12B. However, the timing diagram of FIG. 16 uses the control lines 734 (e.g., CNT1, CNT2, . . . , CNT5) to generate the first select lines (e.g., SEL[i], SEL[i+1], etc. of FIGS. 10B and 12B). To illustrate the operation of the control lines 734 to generate the select lines, the timing diagram in FIG. 16 illustrates the generation of the select lines employed in FIG. 10B, and accordingly the compensation cycle 510, programming cycle 520, and driving cycle 530 shown in FIG. 16 correspond to the respectively cycles in FIG. 10B.

The gate output line ("Gate[k]") is set low to start the compensation cycle 510 and held low through the programming period 520. The Gate[k] signal is thus nearly the opposite of the segmented emission line ("EM[k]"). However, the Gate[k] signal is set high at the start of the transition delay 528, whereas the segmented emission line does not go low until after the transition delay 528. During the entire period that the Gate[k] signal is set low, the first select lines in the "kth" segment are low when the respective ones of the control lines are low and the first select lines are high when the respective ones of the control lines are high. Accordingly, the discussion of the timing of the first select lines in FIG. 10B to allow for compensation and programming of the pixel circuits 410, 410' in the "kth" segment applies to the timing of the control lines shown in FIG. 16. It is particularly noted that the driving scheme of FIG. 10C where the first select lines are held low until turning high at the end of each respective programming period 551, 553, etc., can also be implemented using gate outputs and control lines suitably configured to provide the timing shown in FIG. 10C. In addition, the timing scheme shown in FIG. 12B to operate the display system of FIG. 12A to provide a reset operation can be provided using the gate outputs and control lines configured to provide the timing scheme of FIG. 12B.

Following the compensation and programming of the "kth" segment, the next segment, i.e., the segment following the "kth" segment is initiated by setting the gate output line, Gate[k+1], to low and the control lines CNT1, CNT2, . . . , CNT5 repeat the timing from the previous cycle to generate the first select line signals on the first select lines in the "(k+1)th" segment. It is noted that first select lines in the "kth" segment remain high during the compensation and programming of the "(k+1)th" segment because the gate output Gate [k] for the "kth" segment is high.

By regulating the first select lines in a segmented fashion according to control lines that are re-used for each segment of the display array, at least some computation burden is removed from the address driver, relative to an address driver that separately generates signals for each first select line in a display array. An address driver including switches similar to those shown in FIGS. 15A and 15B is required to produce only the control line signals and each of the gate output signals, and the first select line signals for each row in the display are generated via the switching arrangement according to the gate output signals and control line signals. The address driver can also produce the segmented emission line signals and the segmented second select line signals.

Figure 17A:
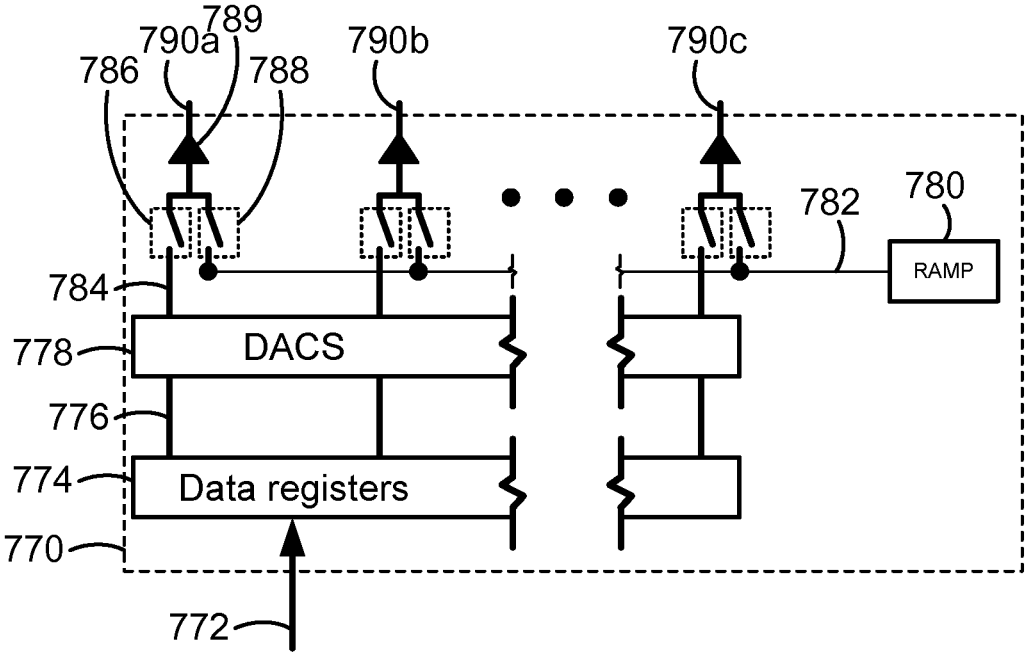
FIG. 17A is a block diagram of a source driver with an integrated voltage ramp generator for driving each data line in a display panel.

FIG. 17A is a block diagram of a source driver 770 with an integrated voltage ramp voltage generator 780 for driving each data line in a display panel. In some examples, the source driver 770 can be used as the data driver 4 of the display system 50 shown in FIG. 1 to provide data voltages and/or ramp voltages for programming and compensation pixel circuits in the display system. The source driver 770 also includes data registers 774 and digital-to-analog converters ("DACs") 778. The data registers 774 store digital data corresponding to programming information 772 to provide to each data line (e.g., 790*a*, 790*b*, etc.) of the display array. The programming information 772 can be a video data stream conveyed from a video data source, and can be provided via a controller, such as the controller 2 of the display system 50. The data registers 774 convey the digital data to the DACs 778 via a connection 776. The DACs 778 transform the digital data to a programming voltage and provide the programming voltage on one or more analog output lines 784. The DACs 778 can be a resistive ladder or resistive lather type DAC, which generates varying voltage outputs via an array of precise resistors selectively connected to the analog output lines 784 to provide the desired voltage output. Generally, there can be one analog output line 784 for each column of the display array or there can be less than one analog output line 784 for each column where a multiplexer is used to share the analog output lines between multiple columns.

The data lines 790*a*, 790*b*, 790*c* correspond to the data lines 22*j*, 22*m* discussed in connection with the display system 50 of FIG. 1 and the various pixel circuit configurations provided herein. The data lines 790*a-c* supply programming voltages (from the DACs 778) or a ramp voltage (from the ramp voltage generator 780) to the pixels in the display system. Each data line 790*a-c* is connected to the analog output lines 784, and the ramp line 782, via a buffer 789. The buffer 789 isolates the DACs 778 and the ramp voltage generator 780 from the load of the display panel. The buffer 789 can be considered an amplifier to condition the voltages on the data lines 790*a-c* according to the output of the DACs 778 and/or ramp voltage generator 780 while preventing the load of the panel from influencing the DACs. Each buffer 789 is alternately connected to the DACs 778 or the ramp voltage generator 780 via two switches 786, 788. A first switch 786 connects the buffer 789 to the analog output line 784 from the DACs 778. A second switch 788 connects the buffer 789 to the ramp line 782 from the ramp voltage generator 780. The switches 786, 788 are operated according to control signals (e.g., from the controller 4 and/or address driver 8) to convey a ramp voltage during compensation intervals and to convey programming voltages from the DACs 778 during programming intervals.

The ramp voltage generator 780 desirably produces a time-changing voltage on the ramp line 782 with a substantially constant time derivative suitable for providing the compensation functions described herein in reference to FIGS. 9-13. In particular, the time-changing voltage from the ramp voltage generator 780 is suitable for being applied to the programming capacitor, e.g., the capacitors 416, 416*k*, 616, 616*k* to generate the compensation current through the driving transistor 412, 612 so as to allow the gate node of the pixel circuit to adjust according to the degradation of the pixel circuit.

The ramp voltage generator 780 can include a current source connected to the ramp line 782 across a capacitor, i.e., a current source in series connection with a capacitor. The ramp voltage generator 780 can also include a digital-to-analog converter ("DAC") receiving a time changing series of digital values, which thereby produce a time changing series of voltages generally defining a time-changing voltage ramp. The series of digital values can be sequential digital values or can be monotonically increasing or decreasing digital values such that the voltage ramp provided on the ramp line 782 is continuously increasing or decreasing, as desired.

The ramp voltage can be a declining voltage ramp or an inclining voltage ramp, with respect to time, depending on the particular pixel circuit configuration selected. Many of the pixel circuits discussed herein describe a declining voltage ramp such that current is drawn through the driving transistor of the pixel circuit. However, pixel circuits disclosed in commonly assigned co-pending U.S. patent application Ser. No. 12/633,209, published as U.S. Patent Application Publication No. US 2010/0207920, the contents of which are incorporated entirely herein by reference, discloses at least some pixel circuits utilizing an inclining voltage ramp applied to a data line to generate a bias current across a capacitor internal to the pixel circuit.

Figure 17B:
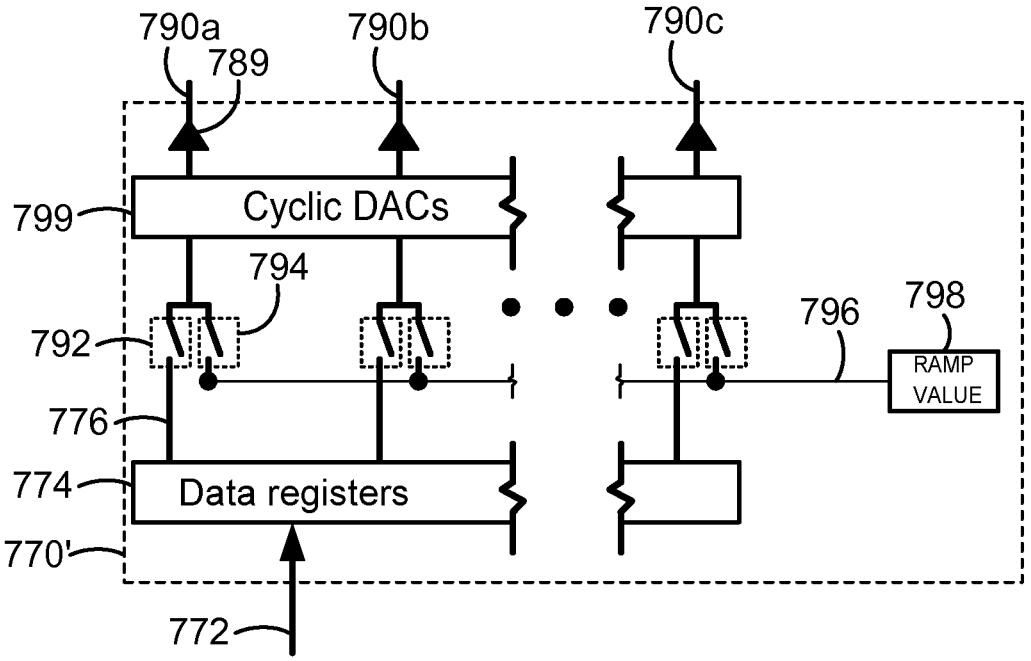
FIG. 17B is a block diagram of another source driver that provides a ramp voltage for each data line in a display panel and includes a cyclic digital to analog converter.

FIG. 17B is a block diagram of another source driver 770' that provides a ramp voltage for each data line in a display panel and includes a cyclic digital-to-analog converter ("cyclic DAC") 799. The cyclic DAC 799 operates by generating a ramp voltage internally, the ramp voltage is compared to a voltage corresponding to a desired output voltage, and when the ramp voltage matches the desired output voltage, the cyclic DAC 799 holds the value corresponding to the programming information and provides the output voltage to the buffer 679.

The internal ramp voltage generation within the cyclic DAC 799 can be utilized to provide the ramp voltage to the data lines 790*a-c* for use in compensation by selectively providing a ramp value 798 to a ramp signal line 796, which ramp value 798 indicates to the cyclic DAC 799 to output the ramp signal to the buffer 789. Similar to the source driver 770 with the resistive type DACs 778 switches 792, 794 are selectively activated to determine whether the cyclic DAC 799 outputs a programming voltage or a ramp voltage. When the first switch 792 is closed, the data registers 774 are connected to the input of the cyclic DAC 799, and the cyclic DAC 799 outputs a programming voltage corresponding to the programming data. When the second switch 794 is closed (and the first switch is open), the ramp value 798 is connected to the input of the cyclic DAC 799 and the data lines 790*a-c* are provided with the ramp voltage generated with the cyclic DAC 799. In some examples, the ramp value 798 can include an indication of a desired dynamic range and/or timing (e.g., increase/decrease rate) of the voltage ramp to be output to the buffer 789.

Similar to the source driver 770 in FIG. 17A, the source driver 770' of FIG. 17B provides a ramp value to the data lines 790*a-c* with a substantially constant time derivative such that the pixel circuits disclosed herein can generate a compensation current through the driving transistor while the gate of the driving transistor adjusts according to the degradation of the pixel circuit (e.g., threshold voltage shifts in the driving transistor, changes in mobility or other factors influencing current-voltage characteristics, etc.).

Figure 18A:
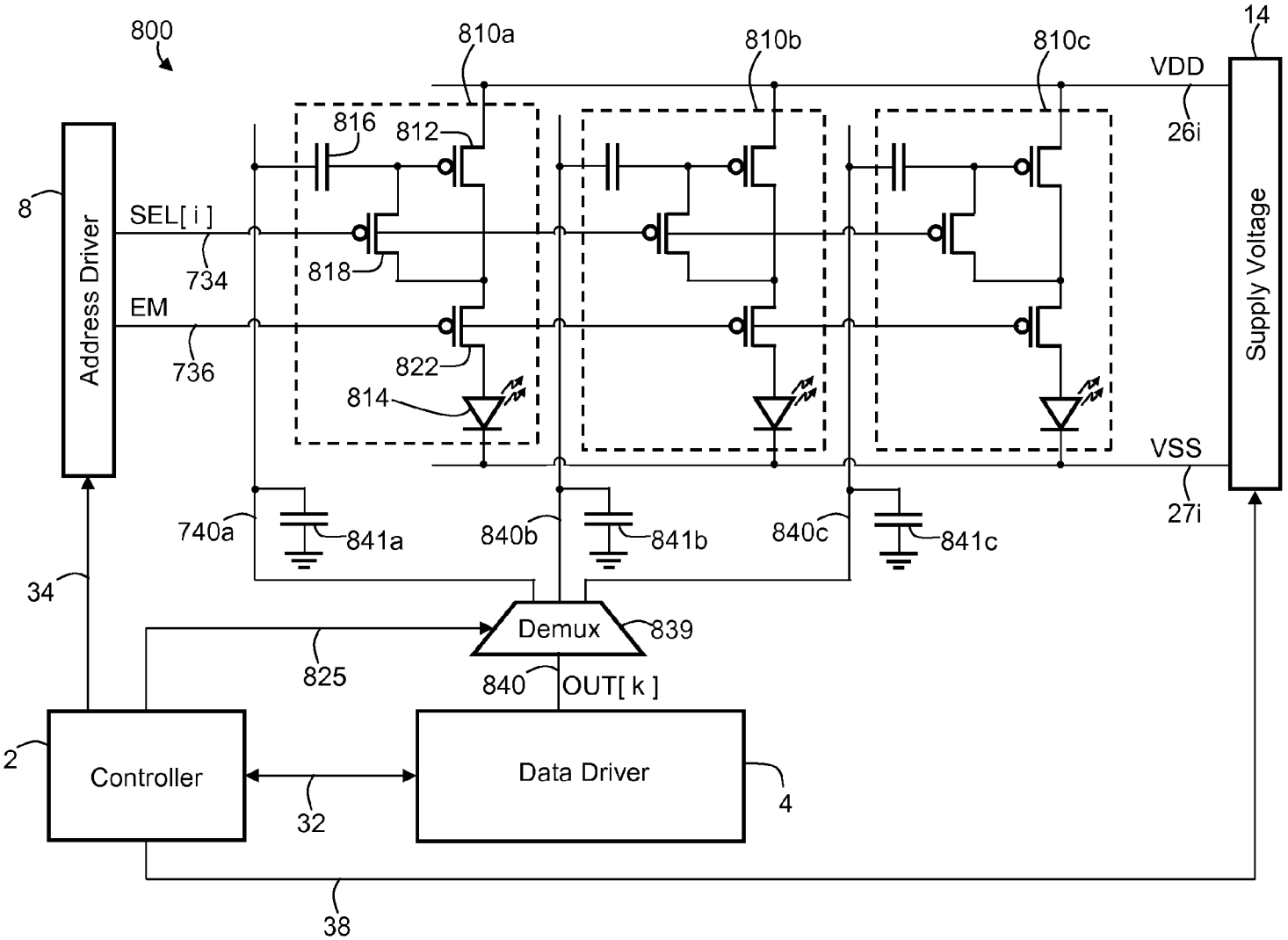
FIG. 18A is a display system including a demultiplexer to share multiple data lines with a single output terminal of the source driver.

FIG. 18A is a display system 800 incorporating a demultiplexer 839 to reduce the number of output terminals 840 from the source driver 4. The demultiplexer 839 provides connections between more than one data lines (e.g., the data lines 840*a-c*) and a single output terminal 840 of the source driver 839. The data lines 840*a-c* are referred to herein as DL[j] 840*a*, DL[j+1] 840*b*, and DL[j+2] 840*c*, to refer to the "jth," "(j+1)th," and "(j+2)th" data lines in the pixel array of the display system 800. By arranging each output terminal of the source driver 4 to be connected to a demultiplexer (such as the demultiplexer 839), the source driver 4 can have N/n output terminals where N is the total number of data lines to be provided to a pixel array and n is the number of outputs from each demultiplexer. In other words, the number of output terminals of the source driver 4 is reduced by a factor of the number of outputs of each demultiplexer.

For example purposes, the display system 800 illustrated in FIG. 18A illustrates a single demultiplexer 839 connected to the "kth" output terminal 840 ("OUT[k]") of the source driver 4. The demultiplexer 839 is operated according to a control signal 825 from the controller 2 to sequentially couple the OUT[k] line 840 to the three data lines 840*a*, 840*b*, and 840*c* one at a time. The data lines 840*a-c* can correspond to, for example, red, green, and blue subpixels for a single pixel position in an RGB display, or can be three other pixels in a common row of a display array. Furthermore, the demultiplexer 839 can sequentially couple the OUT[k] line 840 to less than three or more than three data lines, such as two data lines, four data lines, etc.

However, display systems incorporating a demultiplexer can encounter problems during programming when some data lines are selected for programming before the programming voltage for the current row is applied to the data line via the demultiplexer. These problems will be described next in connection with FIG. 18B, which is a timing diagram for a display array utilizing a demultiplexer. As shown in the timing diagram of FIG. 18B, during a programming cycle 850, the select line 834 (labeled as "SEL[i]") is set low. The data lines 840*a* ("DL[j]"), 840*b* ("DL[j+1]"), and 840*c* ("DL[j+2]") are then sequentially selected by the demultiplexer 839 according to the control line 825. During the first programming subcycle 851, OUT[k] 840 is set to VP[j], which is the programming voltage for the "jth" column of the pixel array. The demultiplexer 839 conveys the voltage VP[j] to the data line for the jth column, DL[j] 840*a*. During the second programming subcycle 852, OUT[k] 840 is adjusted to VP[j+1] by the source driver 4, and the demultiplexer 839 conveys the voltage VP[j+1] to DL[j+1] 840*b*. Similarly, during the third programming subcycle 853, OUT[k] 840 is adjusted to VP[j+2] by the source driver 4, and the demultiplexer 839 conveys the voltage VP[j+2] to DL[j+2] 840*c*.

However, problems in programming the display can occur, in part due to the relatively large parasitic capacitances 841*a-c* of the data lines 840*a-c*. In particular, the parasitic capacitances 841*a-c* of the data lines 840*a-c* are each substantially larger than the storage capacitances (e.g., the storage capacitor 816) of the respective pixel circuits 810*a-c*. As a result of the parasitic capacitance 841*a-c* of the data lines 840*a-c*, the programming voltages of the previously programmed rows are retained on the parasitic capacitances of the data lines until the rows are programmed again. When the row is selected (e.g., at the start of the first programming subcycle 851), DL[j+1] 840*b* and DL[j+2] 840*c* are each charged with the programming voltage for the previously programmed row, which is being maintained on their respective parasitic capacitances 841*b*, 841*c*. The parasitic capacitances 841*b*, 841*c* act like a voltage source to the respective selected pixel circuits 810*b* and 810*c*, which become programmed with the programming voltages for the previously programmed rows. Once the proper programming voltage VP[j+1] for the pixel[i,j+1] 810*b* is applied to DL[j+1] 840*b* during the second programming subcycle 852, the pixel[i,j+1] 810*b* may not be updated with the new programming voltage, (i.e., the pixel[i,j+1] 810*b* may be unable to change its state). Problems may arise when the pixel circuit is "programmed" by the previous row's value retained in the parasitic capacitance of the data line. For example, once the pixel [i,j+1] 810*b* has been programmed with the previous row's programming voltage (during the first programming subcycle 856), subsequently applying the current row's programming voltage (e.g., during the second programming subcycle 852) will not influence the state of the pixel circuit 810*b* due to the relatively large line capacitance of the.

Similarly, the pixel[i,j+2] 810*c* may not be updated with the programming voltage for the current row during the third programming subcycle 853 because the pixel[i j+2] may be set, during the first programming subcycle 851, by the programming voltage for the previous row stored on the parasitic capacitance 841*c* of DL[j+2] 840*c*. Once programming is complete, the emission cycle 854 ("driving cycle") follows during which the emission control line 836 is set low. Setting the emission control line low turns on the emission transistor 818 to allow current to flow to the light emitting device 814 through the drive transistor 812 according to programming information stored on the storage capacitor 816. As shown in FIG. 18A, the emission control line 836 can initiate the emission cycle 854 for more than one pixel circuit (e.g., the pixel circuits 810*a-c*) and can initiate the emission cycle 854 for all the pixels in the pixel array of the display system 800 simultaneously. In display systems where pixel circuits are not properly programmed with the programming information for the correct rows, the resulting image displayed during the emission cycle 854 suffers from distortions.

Figure 18B:
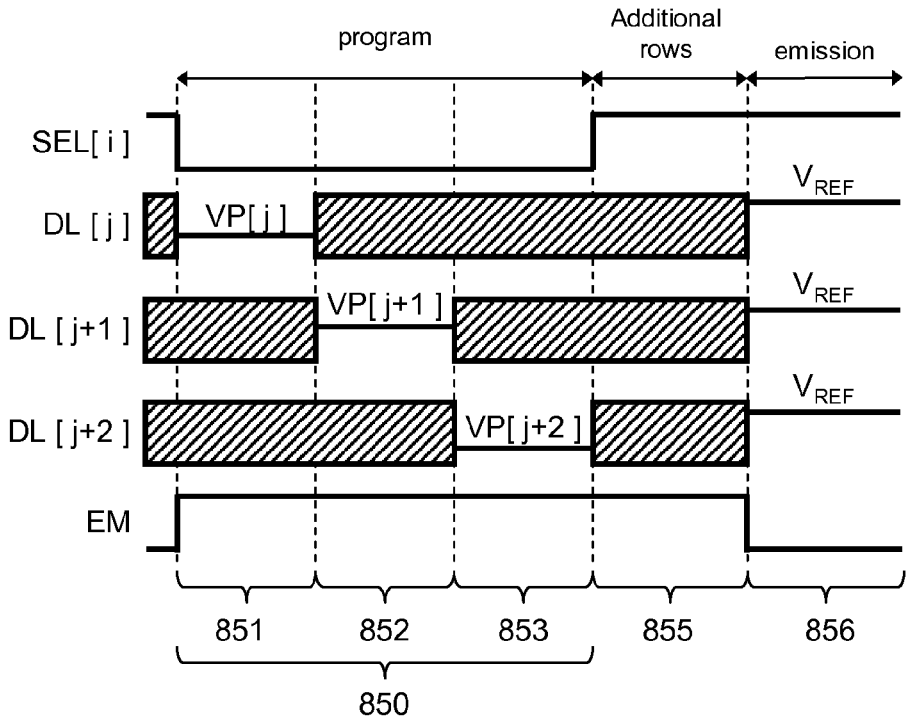
FIG. 18B is a timing diagram for the display array shown in FIG. 18A illustrating problems in setting pixels to new data values.
Figure 18C:
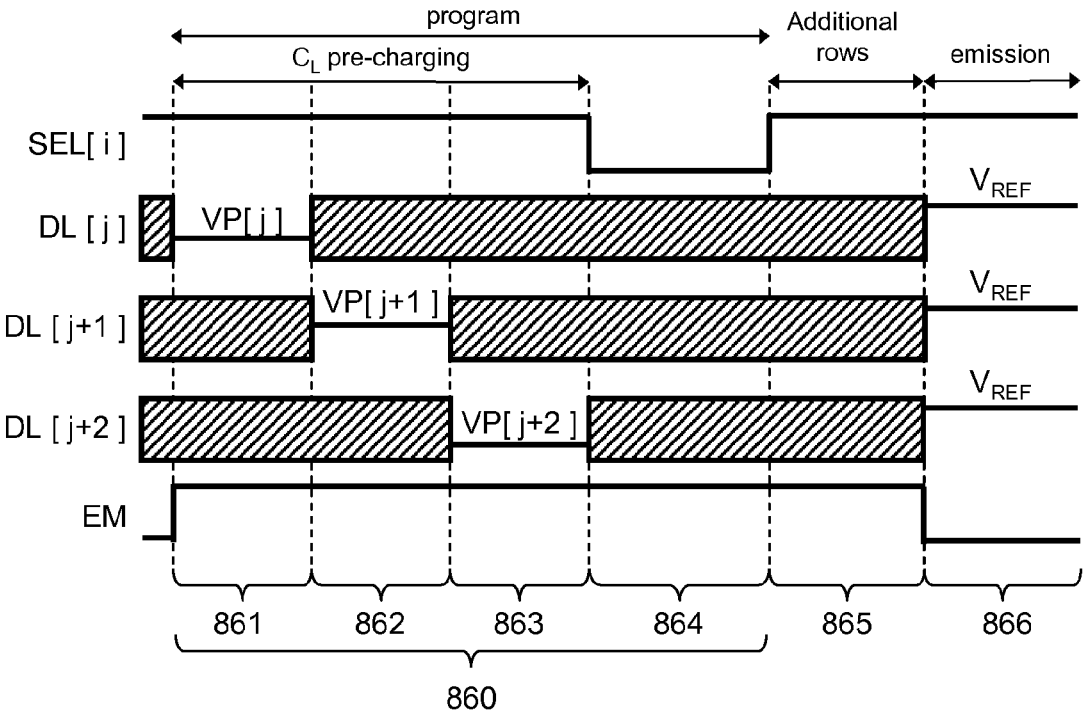
FIG. 18C is a timing diagram for operation of the display system shown in FIG. 18A, which pre-charges data line capacitances before selecting rows for programming.

However, the above-described problems with improperly programming pixel circuits can be addressed by adjusting the programming scheme as shown in the timing diagram in FIG. 18C. FIG. 18C is a timing diagram illustrating the operation of the source driver 4, the demultiplexer 839, and the address driver 8 to pre-charge the parasitic capacitances 841*a-c* of each data line 840*a-c* prior to selecting the pixels 810*a-c* for programming. As shown in FIG. 18C, a first precharging cycle 861 is carried out to charge a programming voltage VP[j] on the parasitic capacitance 841*a* of DL[j] 840*a* while the select line 834 remains high. A second precharging cycle 862 is carried out to charge a programming voltage VP[j+1] on the parasitic capacitance 841*b* of DL[j+1] 840*b*, and a third precharging cycle 863 is carried out to charge a programming voltage VP[j+2] on the parasitic capacitance 841*c* of DL[j+2] 740*c*.

Following the precharging cycles 861, 862, 863, a programming select cycle 864 is carried out. During the programming select cycle 864, the select line 834 ("SEL[i]") is set low to select the pixels 810*a-c*, which are then programmed by the programming voltages stored on the respective parasitic capacitances 841*a-c* of the respective data lines 840*a-c*. Because the parasitic capacitances 841*a-c* are much greater than the capacitances of the storage capacitors in the pixel circuits 810*a-c*, the parasitic capacitances 841*a-c* act as voltage sources to force the pixel circuits 810*a-c* to update to the programming voltages for the current row. An emission cycle 866 follows the programming select cycle 864. The duration of the programming select cycle 864 can be equal to the duration of one of the individual precharging cycles (e.g., the first precharging cycle 861) or can be equal to the cumulative duration of all the precharging cycles 861, 862, 863. Generally, the duration of the programming select cycle 864 is chosen to provide adequate time for the pixel circuits 810*a-c* to be updated with the programming voltage stored on the respective parasitic capacitances 841*a-c*.

It is specifically noted that other options are available to address updating the programming voltage for the current row. For example, the number of address lines ("select lines") can be increased by a factor of the number of outputs of the demultiplexer 839, and pixels in the same row can be separately selected sequentially to align each selection according to the order of the demultiplexer 839 in providing programming voltages to the respective data lines 840*a-c*. Implementing the solution of additional select lines in the display system 800 can be accomplished, for example, by providing select lines SEL[i,1], SEL[i,2], and SEL[i,3], which are selected during the first, second, and third programming subcycles of the "ith" row, respectively. However, increasing the number of select lines in such a manner undesirably decreases pixel pitch ("pixel density").

The programming select cycle 864 is illustrated as following the parasitic capacitance precharging cycles 861, 862, 863 in FIG. 18C, however, the programming select cycle 864 can coincide with, or at least partially overlap with, the final one of the precharging cycles (e.g., the third precharging cycle 863). For example, the programming select cycle 864 can occur at the same time and have the same duration as the third precharging cycle 863. Alternatively, the programming select cycle 864 can commence during the third precharging cycle 863 and have a duration that extends beyond the end of the third precharging cycle 863.

Aspects of the present disclosure also provide systems and methods for driving a display with enhanced programming settling time to increase the refresh rate of the display and thereby decrease, or even eliminate, the perception of flickering from the display. This disclosure describes multiple techniques of achieving flicker free operation using the example pixels and panel architecture already described above.

Flicker free panel driving schemes are illustrated graphically, but are not limited to particular pixel circuits or display architectures. The origins of image flicker and solutions to eliminate the perception of image flicker will be discussed. below As described above, some pixel circuits may incorporate $V_{DD}$ toggling during programming to prevent emission from an OLED in the pixel circuit during the programming cycle and other non-emission cycles. This method is effective in ensuring a good contrast ratio, however it may introduce a source of possible image flicker in operation. In addition, the flicker free panel operation schemes and architectures specifically disclosed herein can be generalized to other panel operating schemes where the emission cycle does not persist for an entire frame-time.

Figure 19A:
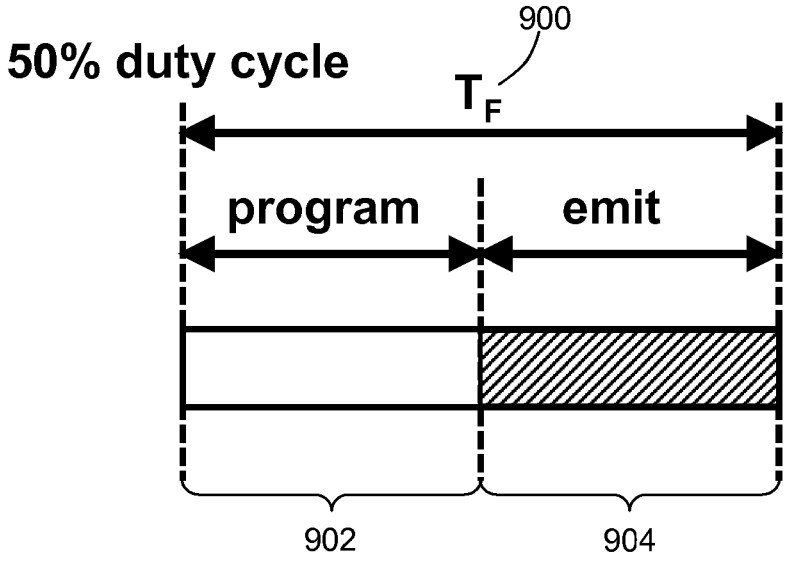
FIG. 19A pictorially illustrates a programming and emission sequence for displaying a single frame with a 50% duty cycle.

FIG. 19A pictorially illustrates a programming and emission sequence for displaying a single frame with a 50% duty cycle. The regular programming scheme is pictorially illustrated in FIG. 19A. Here, half of the frame time 900 ("$T_F$") is used to program the panel sequentially. For example, in an implementation where the frame time is 16 ms, the display panel is programmed in 8 ms. During the panel programming time 902, the supply voltage line (e.g., the voltage line 26*i*) is set to a low voltage to prevent the pixels from emitting light. The voltage supply and is only toggled high to $V_{DD}$ during the emission time 904. A perception of image flicker originates from the frequency of the emission time 904 between frames which are separated by the programming time 902.

As shown in FIG. 19A, the frame time 900 (e.g., 16 ms) includes a programming time 902 having a duration of, for example, 8 ms, during which the display is dark while the pixels receive programming and/or compensation operations. The frequency of the emission period 904 can be at 60 Hz, but the effective frequency can be slightly under 60 Hz due to lag in toggling the supply voltages. Hence it is possible for the displayed image to exhibit a moderate level of flicker especially at an angle of peripheral version for the viewer. Nevertheless, it is possible to alter the programming and emission sequence to increase the frequency of the emission period 804 without changing the total duty cycle. Several methods of achieving no-flicker programming are described below in connection with FIGS. 19B to 23B.

Figure 19B:
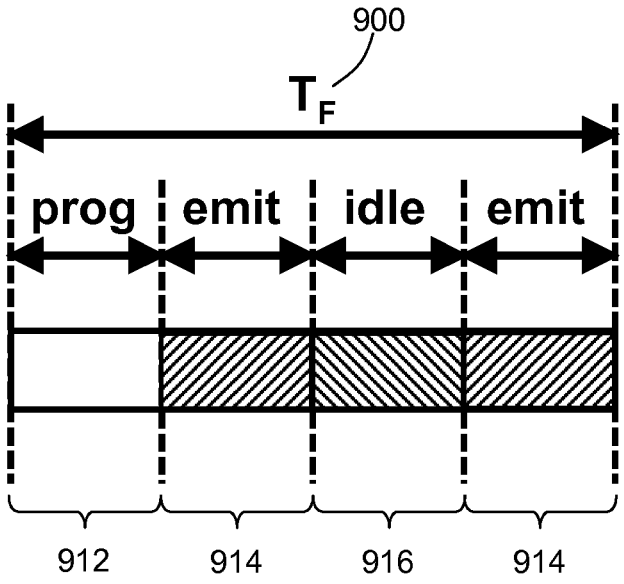
FIG. 19B pictorially illustrates an example programming and emission sequence for displaying a single frame with a 50% duty cycle, which is adapted to decrease flickering associated with the display.

FIG. 19B pictorially illustrates an example programming and emission sequence for displaying a single frame with a 50% duty cycle, which is adapted to decrease flickering associated with the display. To alleviate the image flicker issue, a series of driving mechanism as illustrated in FIG. 19B can be employed. The basis of this driving mechanism is to divide the emission phase into sub-periods 914 and insert an idle period 916 in between. This shortens the time between the individual emission periods 914, thereby increasing the display frequency of the emission period 914 higher than in the example of FIG. 19A. As illustrated in FIG. 19B, the total emission time is divided into two sections 914 (sub-periods) separated by an idle period. In an implementation where the refresh frequency of the display is 60 Hz, the duration of the programming period 912, the idle period 916, and the two emission sub-periods 914 can each be 4 ms, such that the total frame time 800 is 16 ms.

During the idle period 916, the panel's supply voltages are changed into those of the programming phase to turn off the display by preventing the light emitting devices in the respective pixels from emitting light, but the pixels are also not being programmed. The idle period 916 can be implemented by stopping the gate driver 8 from addressing any of the rows. The pixel data values programmed in the pixels during the programming period 912 are thus maintained in the storage elements of each pixel and the pixels remain ready to display light according to the same programming information during the next emission period 914 following the idle period 916. During the idle period 916 the pixels in the display are maintained without emission. The total emission duty cycle can be maintained at 50% (or at some other level by adjusting the durations of the respective periods 912, 914, 916) and can thus be similar to the operating scheme, but the frequency is increased to 120 Hz. This aids in removing perceived image flicker from the human eye.

Figure 20A:
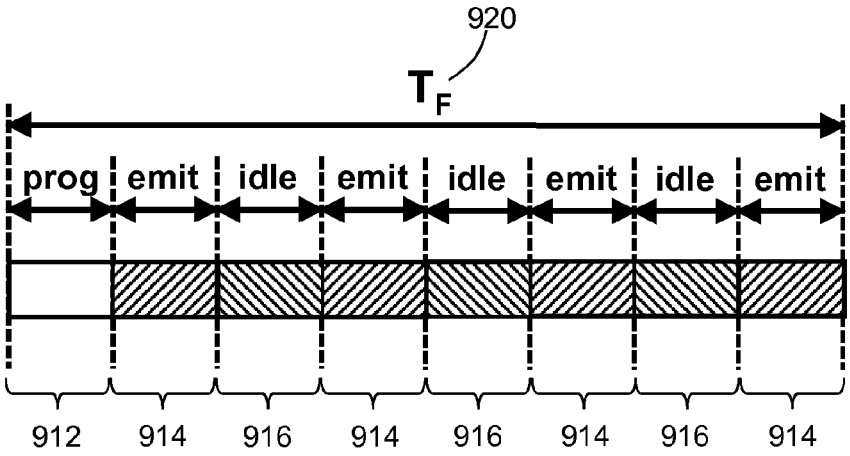
FIG. 20A pictorially illustrates another example programming and emission sequence for displaying a single frame with a 50% duty cycle similar to FIG. 19B, but with a frame time two times as long as the frame time illustrated by FIG. 19B.
Figure 20B:
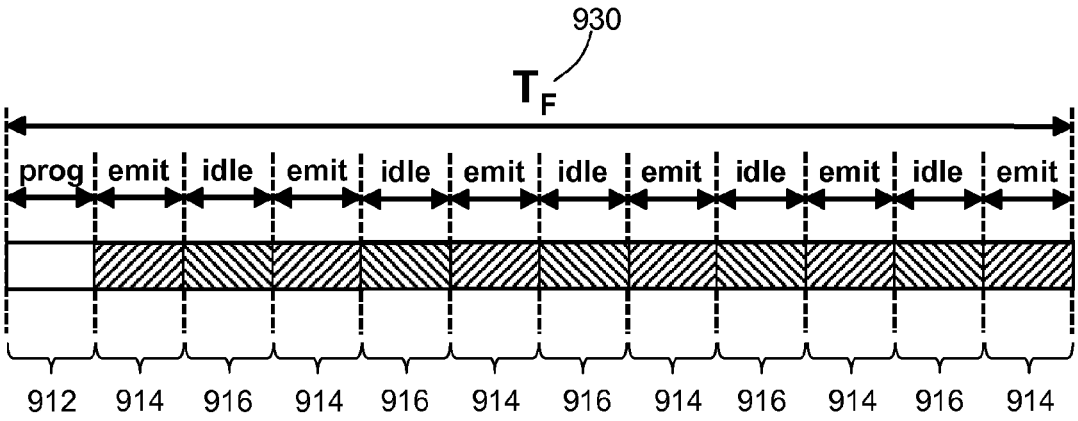
FIG. 20B pictorially illustrates yet another example programming and emission sequence for displaying a single frame with a 50% duty cycle similar to FIG. 19B, but with a frame time three times as long as the frame time illustrated by FIG. 19B.

This method of operation can be extended to lower frame-rate operation, as illustrated in FIG. 20A and FIG. 20B, which illustrate implementations where the emission period 914 and idle period 916 are alternated following the initial programming period 912. FIG. 20A pictorially illustrates another example programming and emission sequence for displaying a single frame with a 50% duty cycle similar to FIG. 19B, but with a frame time 920 twice as long as the frame time 900 illustrated by FIG. 16B. FIG. 18B pictorially illustrates yet another example programming and emission sequence for displaying a single frame with a 50% duty cycle similar to FIG. 19B, but with a frame time 930 three times as long as the frame time 900 illustrated by FIG. 19B.

For example, the scheme illustrated in FIG. 20A can correspond to a display operating at a refresh frequency of 30 Hz. In such an implementation, the frame time 920 has a duration of 32 ms, and each of the periods 912, 914, 916 have durations of approximately 4 ms. In the example operating scheme shown in FIG. 20A, the programming period 912 is followed by the emission period 914, which is then alternated with three idle periods 916 before the next programming period (not shown). Each of the periods 912, 914, 916 can be considered sub-periods of the frame time 920. As shown by FIG. 20A, the first four sub-periods of the operation scheme shown in FIG. 20A are identical to the scheme illustrated by FIG. 19B. However, following the first four sub-periods, instead of programming a next frame (according to the scheme shown in FIG. 19B) the scheme of FIG. 20A alternates the idle period 816 and the emission period 914 twice more each before programming a next frame.

Similarly, the scheme illustrated in FIG. 20B can correspond to a display operating at refresh frequency of 20 Hz. In such an implementation, the frame time 930 has a duration of 48 ms. The first four sub-periods of the operation scheme of FIG. 20B are unchanged relative to the scheme illustrated in FIG. 20A. In addition, four more sub-periods consisting of alternating idle periods 916 and emission periods 914 are appended to the end of the operating scheme of FIG. 20A. The operating schemes in these extended modes (shown in FIGS. 20A and 20B) are similar to the version shown in FIG. 19B, by simply replacing the subsequent programming periods 912 by additional idle periods 916. The display refresh rate is determined by the frequency of the programming period 912, because the display is not reprogrammed in any of the idle periods 916. However, even at the relatively low display refresh frequencies enabled by the schemes of FIGS. 20A and 20B, the display can still be free of perceived flickering effects, because the frequency of the emission period 914 is increased by a factor of four (FIG. 20A) or six (FIG. 20B).

This method of driving is effective in removing flicker because the frequency of the emission phase 914 is increased beyond display refresh frequency. However, the idle phase 916 consumes a portion of the frame time 900, 920, 930, thereby reducing the time available for programming the display. For example, the programming time 902 in the operating scheme of FIG. 19A is twice as long as the programming time 912 in FIG. 19B. For a frame time 900 of 16 ms, the panel is programmed in 4 ms. In addition, the idle period 916 can lead to programming voltage signal loss due to TFT leakages. Any signal stored in the pixels might experience a loss during the idle period 916, resulting in subsequent emission periods 914 providing slightly different luminance values than the initial emission period 914 immediately following the programming period 912. This issue is more pronounced in lower display refresh frequency implementations such as in FIGS. 20A and 20B.

Figure 21A:
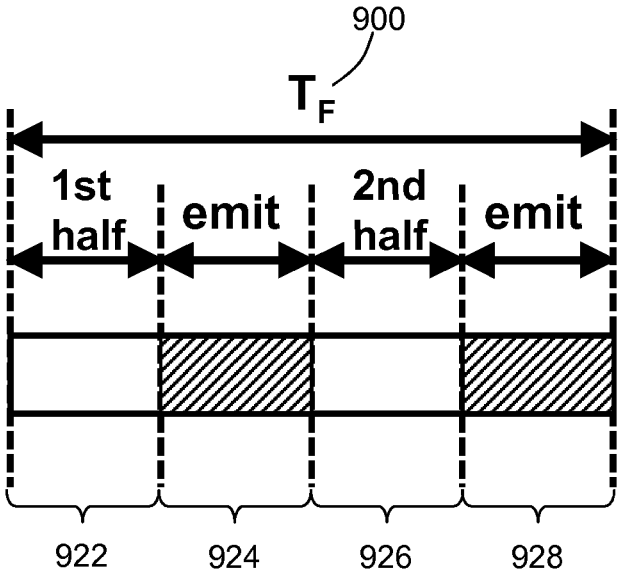
FIG. 21A pictorially illustrates another example programming and emission sequence for displaying a single frame while separately programming portions of the display during distinct program phases.

FIG. 21A pictorially illustrates another example programming and emission sequence for displaying a single frame while separately programming portions of the display during distinct programming periods 922, 926. The aforementioned programming schemes described in connection with FIGS. 19B, 20A, and 20B required all the rows in the display to be programmed during the single programming period 912, which can be implemented as a period of only 4 ms. However, the idle period 916 can be better utilized by programming only a portion of the panel in a first programming periods 922, and then programming the rest of the panel during a second programming period 926. Thus, both programming and emission are temporally divided in half as pictorially shown in FIG. 21A. The flicker suppression algorithm is the same as the previous method, by increasing the frequency of the emission periods 924, 928. The performance is similar to the method described in connection with FIG. 19B, while alleviating the limitation on the duration of the programming duration, because only half of the display is programmed during each programming period 922, 926.

The lower frame-rate operation (e.g., such as for 30 Hz and 20 Hz display refresh frequencies) is still possible in this method by inserting idle periods in subsequent frames after the whole panel is programmed. This mode also offers advantages due to its relative ease of implementation in either integrated or externally connected gate drivers. Panel programming is only required to be paused during the emission period 924 and then resumed for the second half of the panel during the second programming period 926.

However, depending on how the two separately programmed portions of the display are chosen the leakage of programming information between subsequent emission periods (e.g., 924 and 928) can lead to image abnormalities. For example, in an implementation where the first programming period 922 programs the top half of a display panel, and the second programming period 926 programs the bottom half of the display panel, the two emission periods 924, 928 will be more/less bright on the top/bottom depending on which was most recently programmed. In other words, the portion of the panel that is already programmed experiences a longer duration of leakage time compared to the second half during the emission period 928. This may result in a perceptible brightness difference between the two halves that contributes to an image artifact.

Figure 21B:
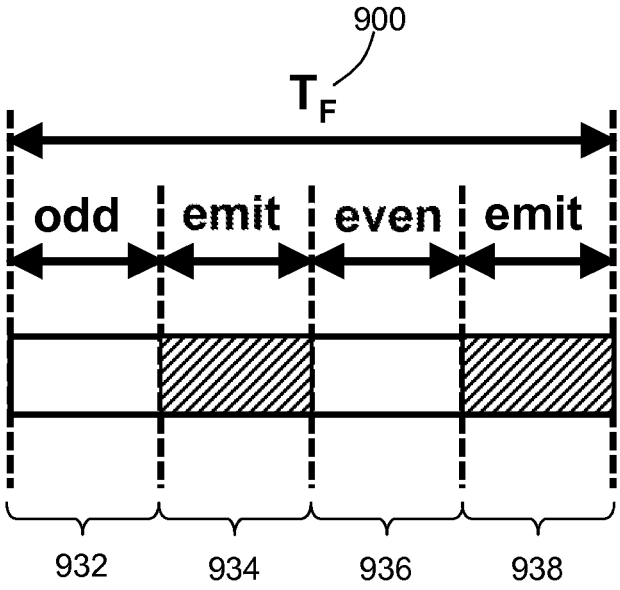
FIG. 21B pictorially illustrates another example programming and emission sequence for displaying a single frame while separately programming interlaced portions of the display during distinct program phases.

FIG. 21B pictorially illustrates another example programming and emission sequence for displaying a single frame while separately programming interlaced portions of the display during distinct program phases 932, 936. Here, the first programming period 932 is used to program all the odd rows of the display panel, while the second programming period 936 is used for even rows. The sequence of odd and even programming phases is interchangeable, and the data programmed to adjacent rows are not over-written in adjacent programming phases. This implies that the panel will display all odd rows' data in the first emission period 934, while the even rows are still holding data from previous frame. The even rows' data are refreshed in the second programming period 936, and the whole frame's image is displayed in the second emission period 938. This retention of image programming information between the emission periods 934, 938 is a difference with conventional interlacing programming on CRT displays where adjacent rows are programmed black during sub-frame programming of odd or even rows.

This operating scheme can greatly reduce image flicker, due to the aliasing method. This operating scheme can be extended to lower frame-rate operation by replacing the subsequent frame's programming phase by idle frames, similar to the schemes shown in FIGS. 20A and 20B. In addition, this operation scheme improves upon the previous methods in maintaining a seamless transition between adjacent sub-frames.

Figure 21C:
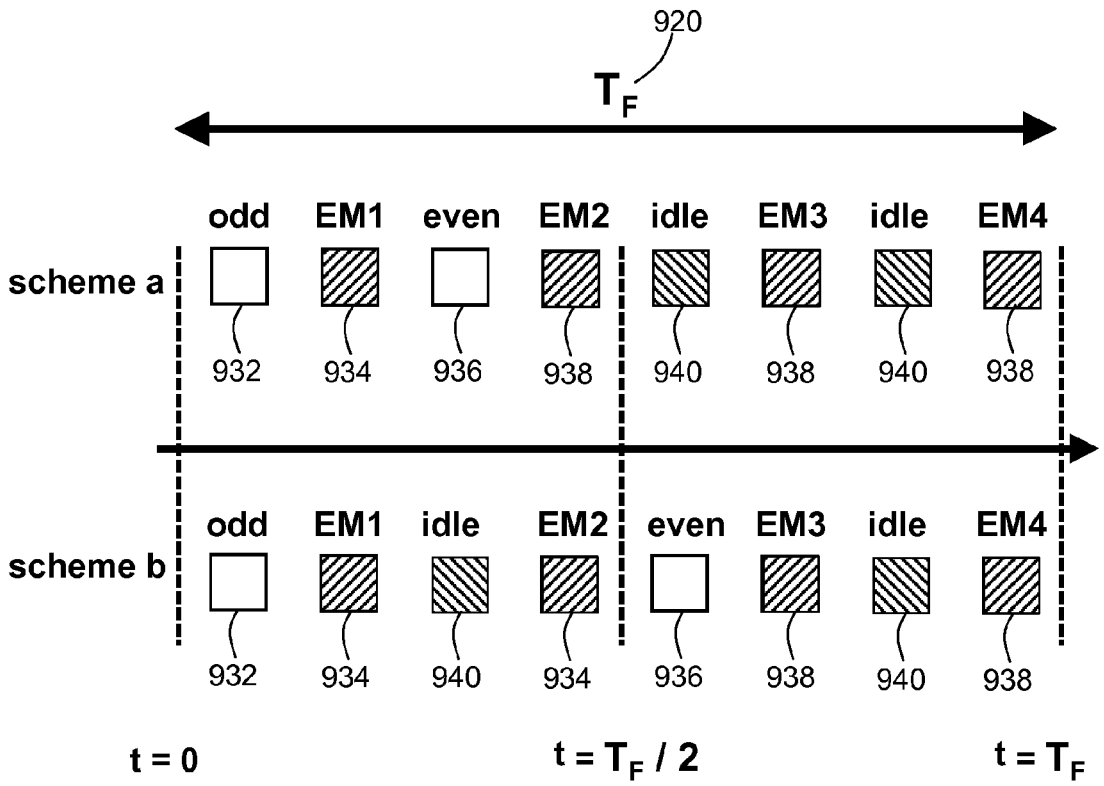
FIG. 21C pictorially illustrates example programming and emission sequences for displaying a single frame where the sequence illustrated in FIG. 21B is followed by additional emission and idle phases or where the sequence illustrated in FIG. 21B is interrupted by additional programming and idle phases.

FIG. 21C provides two options in implementing the interlacing mode with slower frame-rate (i.e., longer frame time). In the example shown in FIG. 21C, the frame time 920 can be twice as long as the frame time 900 of FIG. 21B.

FIG. 21C pictorially illustrates example programming and emission sequences for displaying a single frame during a frame time that is divided into eight sub-periods. In the first scheme (labeled as scheme a), the sequence illustrated in FIG. 21B is followed by additional alternating emission periods 940 and idle periods 938. The second scheme (scheme b) illustrates adding an idle period 940 after the first emission period 934, then programming the even rows during the second programming period 936 following a second emission period 934. In either scheme a or b, during the first emission periods 934, only the odd rows emit light according to programming data for a currently displayed frame. During the second emission periods 940, all the rows in the display emit light according to the programming data for the currently displayed frame. In scheme a, in an implementation where the frame time 920 is 32 ms, the first 16 ms is divided into four parts. The odd rows are first programmed (first programming period 932), followed by an emission period 934 ("EM1"), and then the even rows are programmed (second programming period 936) similarly. The first 16 ms of this scheme is identical to the driving mode in FIG. 21B. The first emission period 934 displays only the odd rows, while the second emission period 938 ("EM2") will fill in the even rows without re-writing the data stored in the odd rows. Afterwards, the second half of the frame time 920 frame is inserted to lengthen the frame-rate down to 30 Hz. Here, the second half of the frame time 920 is also divided into four equal parts, but the programming sub-frames are replaced by idle frames 940 where the rows are not being programmed. The result of this operation results in the two emission sub-frames 838 ("EM3" and "EM4") to display the same image as EM2 938.

In scheme b, an idle frame 940 is inserted between the programming sub-frames for odd and even rows 934, 936. This results in the emission periods EM1 934 and EM2 934 sections only displaying the odd rows, while emission periods EM3 938 and EM4 938 will display the full image according to the currently programmed frame. Both schemes contain the same duty cycle period, with the difference in the arrangements of the programming and emission frames.

As comparison, scheme a exhibits better odd and even rows matching, because the two sub-frames 932, 934 are programmed right after each other. However, the entire image is retained for the rest of the idle frames 940, which can be prone to signal leakage in the pixels. The reduction in signal stored in the pixel will lead to shift in image brightness, which can cause flickering if the frame-rate is low. On the contrary, scheme b allows even rows to be programmed in the programming period 936 and only emits the full image during EM3 938 and EM4 938. The aforementioned overall signal loss is decreased, at an expense of possible brightness difference between adjacent rows. Thus, scheme b will result in less image flickering, but may suffer from "stripes" in flat view images. The two schemes can be naturally extended by virtue of appending idle and emission frames to accommodate still lower display refresh frequencies.

Figure 21D:
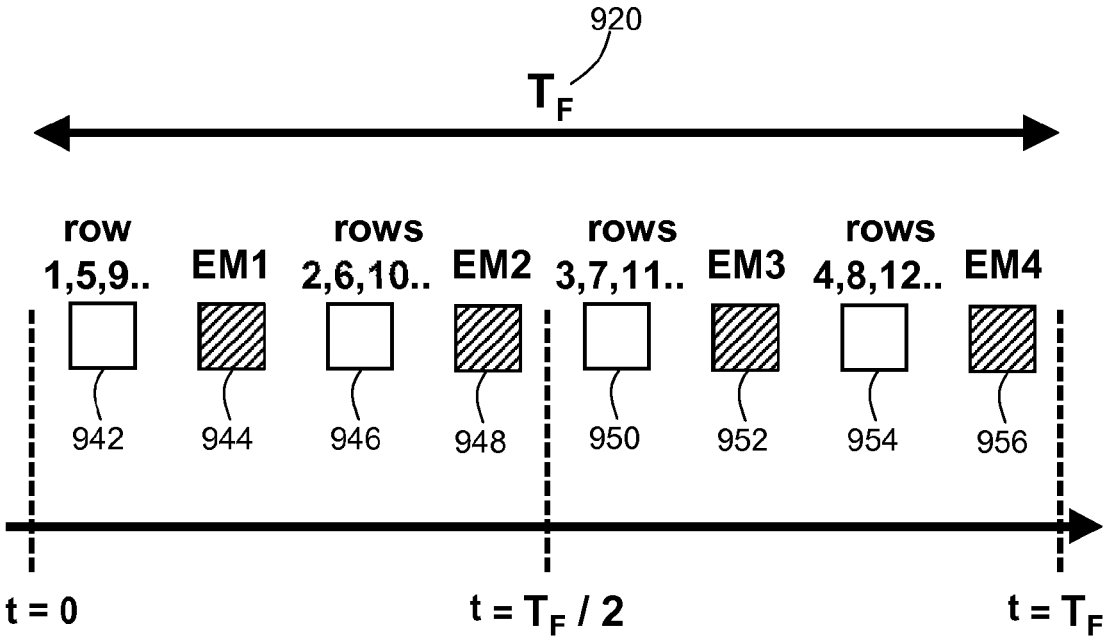
FIG. 21D pictorially illustrates still another example programming and emission sequence for displaying a single frame where portions of the display are sorted into four interlaced groupings according to row numbers and each portion is separately programmed.

FIG. 21D pictorially illustrates still another example programming and emission sequence for displaying a single frame where portions of the display are sorted into four interlaced groupings according to row numbers and each portion is separately programmed. This scheme advantageously further decreases the demands on the programming time by spreading programming across four different sub-groups of the display. The different sub-groups can be, for example, groups of interlaced rows of the display. Instead of limiting row interlacing to two adjacent rows, four or higher number of row interlacing can be utilized. FIG. 21D illustrates the sequence of performing four row interlacing.

The frame time 920 includes eight sub-periods, including four emission periods 944, 948, 952, 956, and four programming periods 942, 946, 950, 954. Programming period 942 writes data to every other four rows, such as the rows numbered 1, 5, 9, 13, etc. Following the first programming period 942, the first emission period 944 displays light according to the recently programmed pixels in rows 1, 5, 9, etc., while other pixels are driven according to the programming information they retained from their most recent programming event (which occurred during a previous frame time). Next, the second programming period 946 programs pixels in rows 2, 6, 10, etc., and the pixels are driven with their most recently programmed values during the second emission period 948. Next, the third programming period 950 programs pixels in rows 3, 7, 11, etc., and the pixels are driven with their most recently programmed values during the third emission period 952. The fourth programmed period 854 programs pixels in rows 4, 8, 12, etc., and the pixels are driven with their most recently programmed values during the fourth emission period 956. In the example described in connection with FIG. 21D, the fourth emission period 956 is the only one of the emission sub-periods 944, 948, 952, 956, where the display is driven according to programming data for the same frame all at once. The other emission periods 944, 948, 952 each include at least some pixels driven according to programming data from a previous frame.

The operating scheme shown in FIG. 21D benefits from the partial turning ON of the panel during sub-frame programming, which can reduce power consumption. However, this mode is most suitable for static image or slow moving image scenes. This is because the higher level of interlacing will result in image ghosting due to the programming sequence especially in low frame-rate operation.

Figure 22A:
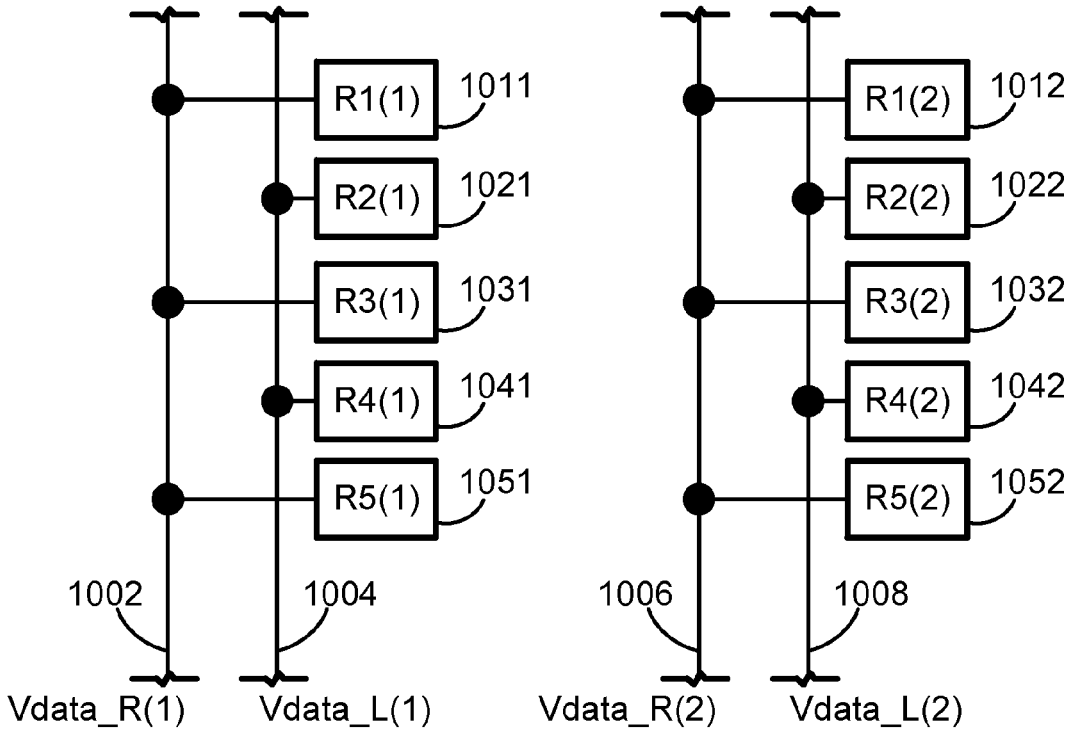
FIG. 22A is a block diagram of a circuit layout for connecting alternating rows of a display panel to distinct data lines.

FIG. 22A is a block diagram of a circuit layout for connecting alternating rows of a display panel to distinct data lines 1002, 1004, 1006, 1008. Such a configuration is usefully employed where alternating rows of a display array are programmed in distinct programming cycles. For convenience, one subset of data can be referred to as "right," while the other is referred to as "left." In the configuration shown in FIG. 22A, the pixel circuit in the first row and first column is identified as R1(1) 1011. The pixel circuit in the second row and first column is identified as R2(1) 1021. The pixel circuits in the third, fourth, and fifth rows in the first column are identified as R3(1) 1031, R4(1) 1041, and R5(1) 1051. Similarly, the pixel circuits in the first five rows of the second column are identified as R1(2) 1012, R2(2) 1022, R3(2) 1032, R4(2) 1042, and R5(2) 1052. The display array is arranged with each column having two parallel data lines, one for the "right" data (e.g., the data lines Vdata_R(1) 1002 and Vdata_R(2) 906), and one for the "left" data (e.g., the data lines Vdata_L(1) 1004 and Vdata_R(2) 1008). The pixels in the odd rows are connected to the "right" data on the data lines Vdata_R(1) 1002, Vdata_R(2) 1006, etc. for each column across the array. The pixels in the even rows are connected to the "left" data on the data lines Vdata_L(1) 1004, Vdata_L(2) 1008, etc. for each column across the array. For example, the pixels R1(1) 1011 and R1(2) 1012 in the first row are connected to "right" data lines Vdata_R(1) 1002 and Vdata_R(2)

1006, respectively. The pixels R2(1) 1021 and R2(2) 1022 in the second row are connected to "left" data lines Vdata_L(1) 1004 and Vdata_L(2) 1008, respectively. Such a display array configuration can be employed in connection with the driving scheme illustrated and described in connection with the two driving schemes shown in FIG. 21C, and which will be described below in FIG. 23B.

Figure 22B:
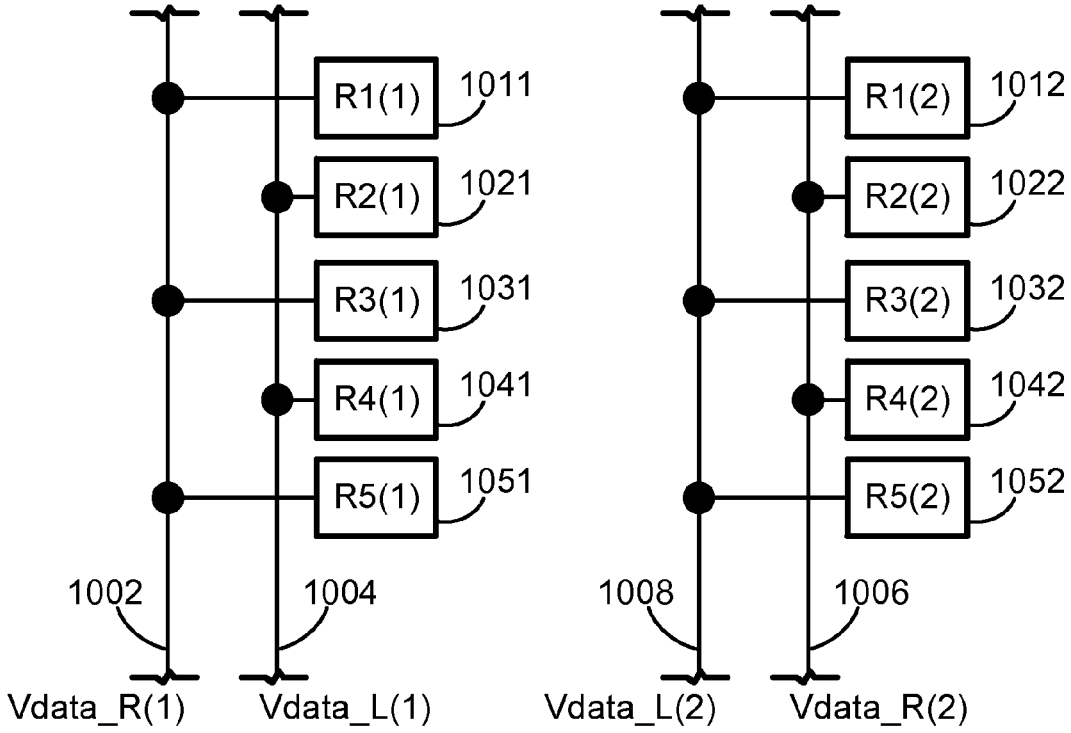
FIG. 22B is a block diagram of a circuit layout for connecting interlaced pixels of a display panel to distinct data lines.

FIG. 22B is a block diagram of a circuit layout for connecting interlaced pixels of a display panel to distinct data lines 1002, 1004, 1006, 1008. The two columns of pixels shown in FIG. 22B are similar to the pixels in FIG. 22A, except that the second column of pixels is now connected to the opposite data line, relative to the pixels in FIG. 22A. Thus, in the arrangement of FIG. 22B, pixels in odd rows and odd columns, and pixels in even rows and even columns are connected to "right" data. Pixels in odd rows and even columns, and pixels in even rows and odd columns are connected to "left" data. For example, the pixels R1(1) 1011 and R2(2) 1022 in the first row, first column, and second row, second column, respectively, are connected to "right" data lines Vdata_R(1) 1002 and Vdata_R(2) 1006, respectively. The pixels R2(1) 1021 and R1(2) 1012 in the second row, first column, and first row, second column, respectively, are connected to "left" data lines Vdata_L(1) 1004 and Vdata_L(2) 1008, respectively. The "right" and "left" data lines are arranged to be connected to interlaced pixels in a checkerboard configuration across the display array.

The arrangement of the "left" and "right" data lines correspond to regions which are simultaneously programmed by the display array by the "right" and "left" data sets, which can be arbitrarily arranged to divide the display into one or more regions that are programmed by the respective sets of data lines during distinct programming intervals. Of course, a display array can also be divided into "left" and "right" portions providing separate data lines for the distinct portions, such that the distinct portions still share common data lines, but are addressed to receive programming during distinct intervals. An exemplary timing diagram corresponding to a display panel with distinct portions that share data lines is provided in FIG. 23A. An exemplary timing diagram corresponding to a display panel with distinct data lines for distinct portions is provided in FIG. 23B.

Figures 23A, 23B:
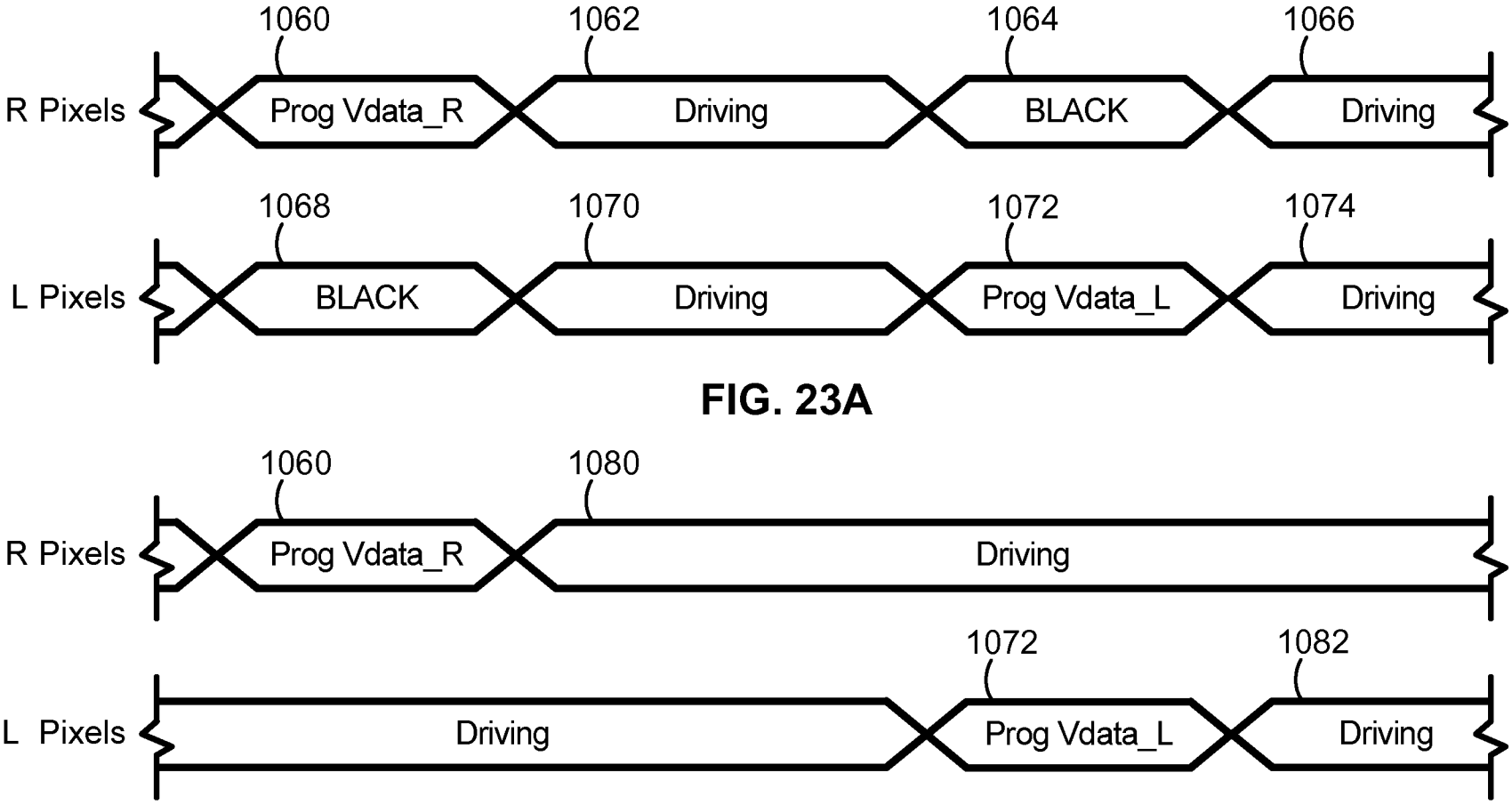
FIG. 23A is a timing diagram for a display panel with distinct portions that are programmed in distinct intervals and which share data lines.
FIG. 23B is a timing diagram for a display panel with distinct portions that are programmed in distinct intervals and which do not share data lines.

FIGS. 23A and 23B are timing diagrams for displays which are divided into "left" and "right" data lines. The timing diagrams in FIGS. 23A and 23B correspond to a pixel circuit such as the ones described in FIGS. 4 through 8, where the data line is set at a reference value, during the driving interval to reference the storage capacitor to the reference voltage and thereby prevent the storage capacitor from floating during the driving interval. Because the pixel circuits in FIGS. 4 through 8 are not isolated from the data line during the driving interval, variations on the data line influence the driving transistor, and as a result pixels cannot be simultaneously driven to emit light, in a first row of the display, while pixels in a second row of the display sharing the same data line are programmed, since the programming on the second row will influence the driving on the first row via the same data line.

Several of the flicker-free operating schemes described above are described with roughly 50% duty cycles, however it is specifically noted that other duty cycles can be achieved according to the present disclosure. The timing diagram in FIG. 23A demonstrates a 60% duty cycle because the duration of programming (e.g., the programming periods 1060, 1072), are roughly two-thirds the length of the driving intervals (e.g., the driving periods 1062, 1070). Thus, each pixel in the display driven according the timing diagram of FIG. 23A is driven to emit light roughly 60% of the time. It is specifically noted that aspects of the present disclosure apply to other duty cycles as well, and the duty cycle is generally determined by the refresh rate of the video content and the duration required for programming the display, which is influenced by the timing resolution of the drivers, switching speed of the transistors, charging times for the storage capacitors within each pixel, etc.

As shown in FIG. 23A, during the first interval, the "right" pixels are programmed in sequence (1060) via the "right" data lines while the "left pixels" are maintained black (1068). Keeping the "left" pixels black can be carried out by adjusting one or more of the the supply voltages to voltages sufficient to keep the light emitting devices turned off. While the "left" pixels are kept black (1068), the programming voltages stored in the pixels is retained within the storage capacitors, which float until the data line is returned to an appropriate reference voltage during the driving periods 1062, 1070. Thus, during the driving 1062, 1070, the "right" pixels are driven according to the programming provided in the interval 1060 while the "left" pixels are driven according to programming provided during a previous interval (not shown) prior to the black interval 1068.

After the driving 1062, 1070, the "right pixels" are maintained black (1064) while the "left" pixels are programmed in sequence (1072) via the "left" data lines. The programming interval 1072 and the black interval 1072 is followed by driving intervals 1066, 1072 where the "left" pixels are driven according to the programming provided during the programming interval 1072 and the "right" pixels are driven according to the programming provided during the programming interval 1060. Data for a single frame is provided to the display across the two programming intervals 1060, 1072. A frame time for displaying a single frame includes programming the "right" pixels while the "left" pixels are maintained black (1060, 1072), driving the pixels at the values they are programmed with (1062, 1070), programming the "left" pixels while the "right" pixels are maintained black (1062, 1064), and driving the pixels again (1066, 1074).

FIG. 23B provides a driving scheme for a display panel with distinct portions (e.g., the "right" and "left" portions described herein) programmed during distinct intervals, where the distinct portions also have distinct data lines (e.g., Vdata_R, Vdata_L described in connection with FIGS. 22A and 22B). In the driving scheme of FIG. 23B, the "right" pixels are programmed (1060) via the "right" data lines which are generally connected only to the "right" pixels (e.g., Vdata_R in FIGS. 22A-22B). During the programming of the "right" pixels (1060), the "left" pixels continue to be driven according to programming provided in a previous interval (not shown). Because the "right" and "left" pixels do not share data lines, the programming of the "right" pixels (1060) does not influence the driving of the "left" pixels. For example, the data lines for the "left" pixels can be fixed at a reference voltage during the programming interval 1060 such that the storage capacitors within the "left" pixels remain referenced to the reference voltage and the driving of the "left" pixels is not influenced. Following the programming interval 1060, the "right" pixels are driven (1080) according to the programming provided during the programming interval 1060. During a time while the "right" pixels continue to be driven, the "left" pixels are programmed via the "left" data lines which are generally connected only to the "left" pixels (e.g., Vdata_L in FIGS. 22A-22B).

For a display system with similar programming durations and display refresh rates to the display described in connection with FIG. 23A, the programming intervals 1060, 1072 are substantially the same length in both driving schemes.

However, in the driving scheme of FIG. 23B, the pixels are not set to black to avoid cross-talk interference between pixels in distinct portions of the display sharing common data lines. As a result, the duty cycle of pixels in the display system driven according to FIG. 23B is generally greater than in a system driven according to FIG. 23A. In comparison to FIG. 23A, the duty cycle for the driving scheme in FIG. 23B is roughly 80%, because pixels are turned off only during the programming intervals 1060, 1072 for their respective "left" or "right" portions, and the programming intervals last roughly 20% of the frame time. Each programming interval 1060, 1072 is followed by a driving interval 1080, 1082 for the respective portion that lasts roughly 80% of the frame time.

Figure 24:
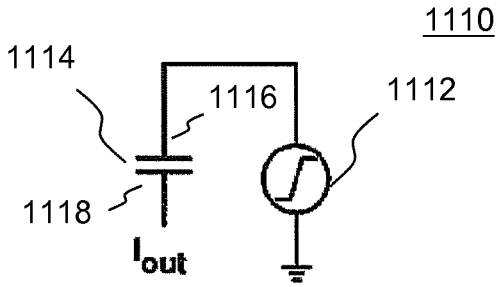
FIG. 24 illustrates a bidirectional current source in accordance with an embodiment of the disclosure.

A current driving technique using a differentiator/convertor to convert a time-variant voltage to a current is described. In the description, a capacitor is used to convert a ramp voltage to a current (e.g., a DC current). Referring to FIG. 24, there is illustrated a current source developed based on a capacitance. The current source 1110 of FIG. 24 is a bidirectional current source that can provide positive and negative currents. The current source 1110 includes a voltage generator 1112 for generating a time-variant voltage and a driving capacitor 1114. The voltage generator 1112 is coupled to one end terminal 1116 of the driving capacitor 1114. A node "Iout" is coupled to the other end terminal 1118 of the driving capacitor 1114. In this example, a ramp voltage is generated by the voltage generator 1112. In the embodiments, the terms "capacitive current source", "capacitive current source driver", "capacitive driver" and "current source" may be used interchangeably. In the embodiments, the terms "voltage generator" and "ramp voltage generator" may be used interchangeably. In FIG. 24, the current source 1110 includes the ramp voltage generator 1112, however, the current source 1110 may be formed by the driving capacitor 1114 that receives the ramp voltage.

It is assumed that the node "Iout" is a virtual ground. A ramp voltage is applied to the terminal 1116 of the driving capacitor 1114, resulting in a fixed current passing the driving capacitor 1114 and going to Iout. $i(t)=C\ dVR(t)/dt$ (C: Capacitance, VR(t): ramp voltage). Amplitude and sign of the ramp's slope are controllable (changeable), which can change the value and direction of the output current. Also, the amount of the driving capacitor 14 can change the current value. As a result, a digitized capacitance based on the capacitive current source 1110 can be used to develop a simple and effective current mode analog-to-digital convertor (ADC) resulting in small and low power driver. Also it provides a simple source driver that can be easily integrated on the panel, independent of fabrication technology, resulting in improving the yield and simplicity of the display and reducing the system cost significantly.

In one example, the capacitive current source 1110 can be used to provide a programming current to a current programmed pixel (e.g., OLED pixels). In another example, the capacitive current source 1110 can be used to provide a bias current for accelerating the programming of a pixel, such as in the pixels 210, 310, 410, 610 disclosed herein. In a further example, the capacitive current source 1110 can be used to drive a pixel. The capacitive driving technique with the capacitive current source 1110 improves the settling time of the programming/driving, which is suitable for larger and higher resolution displays, and thus a low-power high resolution emissive display can be realized with the capacitive current source 1110, as described below. The capacitive driving technique with the capacitive current source 10 compensates for TFT aging (e.g., threshold voltage variations), and thus can improve the uniformity and lifetime of the display, as described below.

In a further example, the capacitive current source 1110 may be used with a current mode analog-to-digital convertor (ADC), for example, to provide a reference current to the current mode ADC where input current is converted to digital signals. In a further example, the capacitive driving may be used for a digital to analog convertor (DAC) where current is generated based on the ramp voltage and the capacitor.

Figure 25:
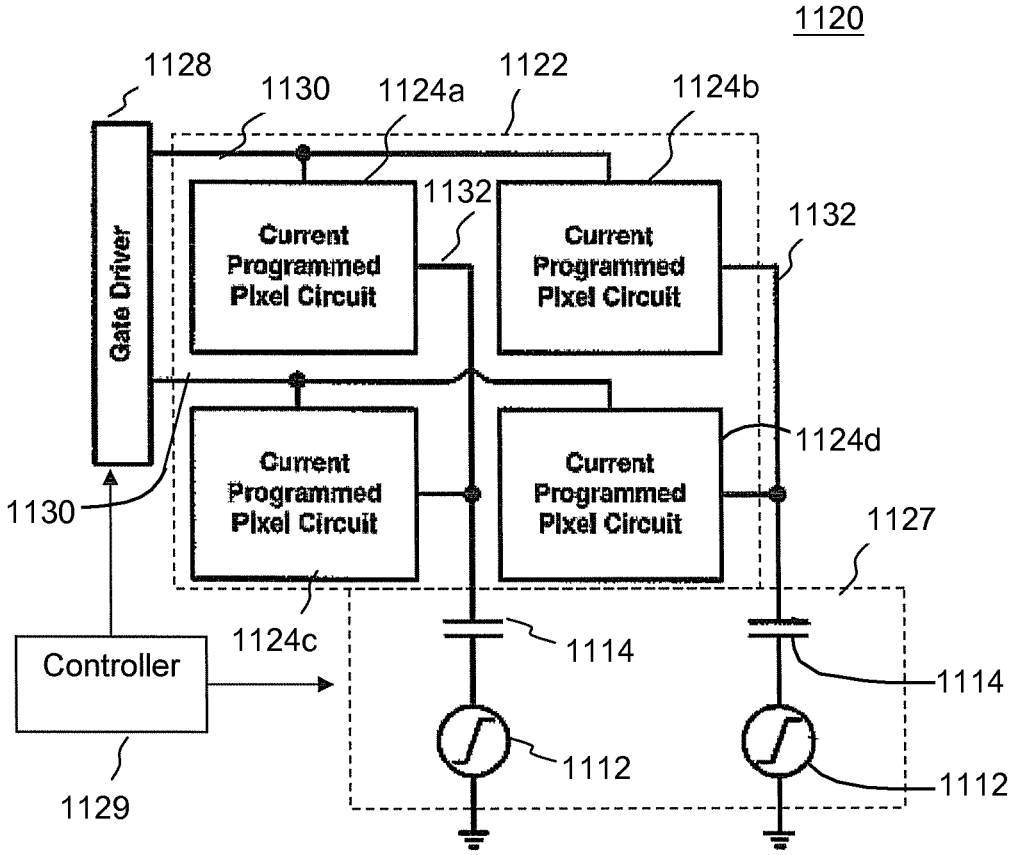
FIG. 25 illustrates an example of a display system with the bidirectional current source of FIG. 24.

Referring to FIG. 25, there is illustrated an example of an integrated display system with the capacitive driver 1110. The integrated display system 1120 of FIG. 25 includes a pixel array 1122 having a plurality of pixels 1124*a*-1124*d* arranged in columns and rows, a gate driver 1128 for selecting a pixel, and a source driver 1127 for providing programming current to the selected pixel.

The pixels 1124*a*-1124*d* are current programmed pixel circuits. Each pixel includes, for example, a storage capacitor, a driving transistor, a switch transistor (or a driving and switching transistor), and a light emitting device. In FIG. 25, four pixels are shown; however, it would be appreciated by one of ordinary skill in the art that the number of the pixels in the pixel array 1122 is not limited to four and may vary. The pixel array 1122 may include a current biased voltage programmed (CBVP) pixel or a voltage biased voltage programmed (VBCP) pixel where the pixel is operated based on current and voltage. The CBVP driving technique and the VBCP driving technique are suitable for the use in AMOLED displays where they enhance the settling time of the pixels.

Each pixel is coupled to an address line 1130 and a data line 1132. Each address line 1130 is shared among the pixels in a row. Each data line 1132 is, shared among the pixels in a column. The gate driver 1128 drives a gate terminal of the switch transistor in the pixel via the address line 1130. The source driver 1127 includes the capacitive driver 1110 for each column. The capacitive driver 1110 is coupled to the data line 1132 in the corresponding column. The capacitive driver 1110 drives the data line 1132. A controller 1129 is provided to control and schedule programming, calibration, driving and other operations for the display array 22. The controller 1129 controls the operation of the source driver 1127 and the gate driver 28. Each ramp voltage generator 1112 may be calibrated. In the display system 1120, the driving capacitor 1114 is implemented, for example, on the edge of the display.

At the beginning of providing a ramp voltage, the capacitance (driving capacitor 1114) acts as a voltage source and adjusting the voltage of the data line 1132. After the voltage of the data line 1132 reaches a certain proper voltage, the data line 1132 acts as a virtual ground ("Iout" of FIG. 24). Thus, the capacitance will act as a current source for providing a constant current, after this point. This duality results in a fast settling programming.

In FIG. 25, the driving capacitor 1114 and the storage capacitor of the pixel are separately allocated. However, the driving capacitor 1114 may be shared with the storage capacitor of the pixel as shown in FIG. 26.

Figure 26:
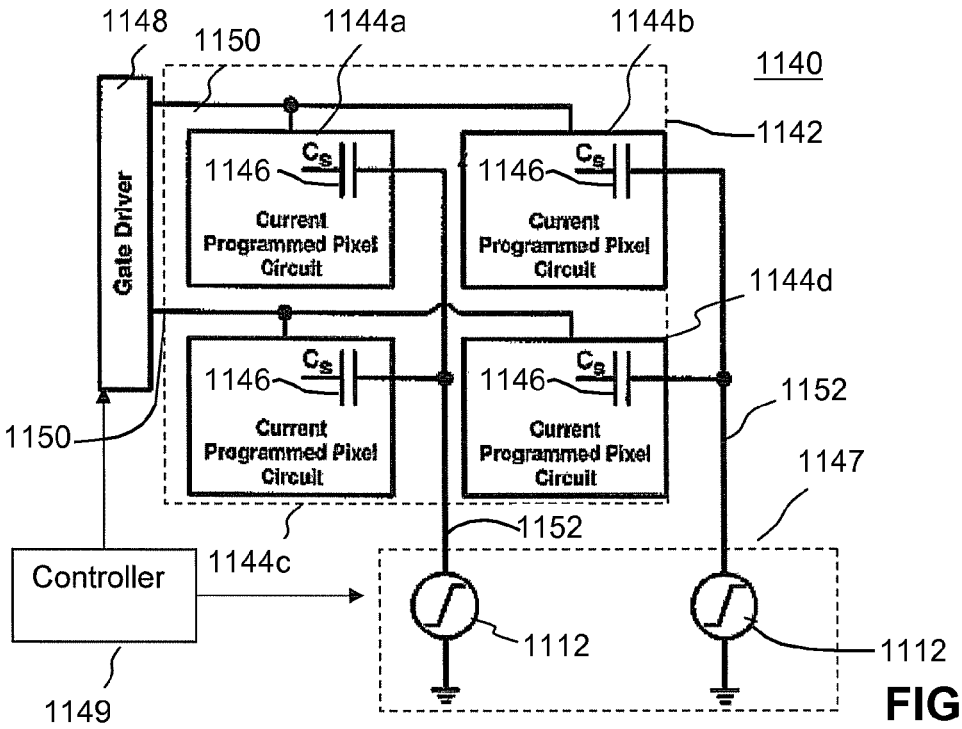
FIG. 26 illustrates a further example of a display system with the bidirectional current source of FIG. 24.

Referring to FIG. 26, there is illustrated another example of an integrated display system with the capacitive driver 1110 of FIG. 24. The integrated display system 1140 of FIG. 26 includes a pixel array 1142 having a plurality of pixels 1144*a*-1144*d* arranged in columns and rows. The pixels 1144*a*-1144*d* are current programmed pixel circuits, and may be same as the pixels 1124*a*-1124*d* of FIG. 25. In FIG. 26, four pixels are shown; however, it would be appreciated by one of ordinary skill in the art that the number of the pixels in the pixel array 1142 is not limited to four and may vary. Each pixel includes, for example, a storage capacitor, a driving transistor, a switch transistor (or a driving and switching transistor), and a light emitting device. For example, the pixel array 1142 may include the pixel of FIG. 29A where the pixel is operated based on programming voltage and current bias.

Each pixel is coupled to the address line 1150 and the data line 1152. Each address line 1150 is shared among the pixels in a row. A gate driver 1148 drives a gate terminal of the switch transistor in the pixel via the address line 1150. Each data line 1152 is shared among the pixels in a column, and is coupled to a capacitor 1146 in each pixel in the column. The capacitor 1146 in each pixel in the column is coupled to the ramp voltage generator 1112 via the data line 1152. A source driver 1147 includes the ramp voltage generator 1112. The ramp voltage generator 1112 is allocated to each column. A controller 1149 is provided to control and schedule programming, calibration, driving and other operations for the display array 1142. The controller 1149 controls the gate driver 1148 and the source driver 1147 having the ramp voltage generator 1112. In the display system 1140, the capacitor 1146 in the pixel acts as a storage capacitor for the pixel and also acts as driving capacitance (capacitor 1114 of FIG. 24).

Figure 27:
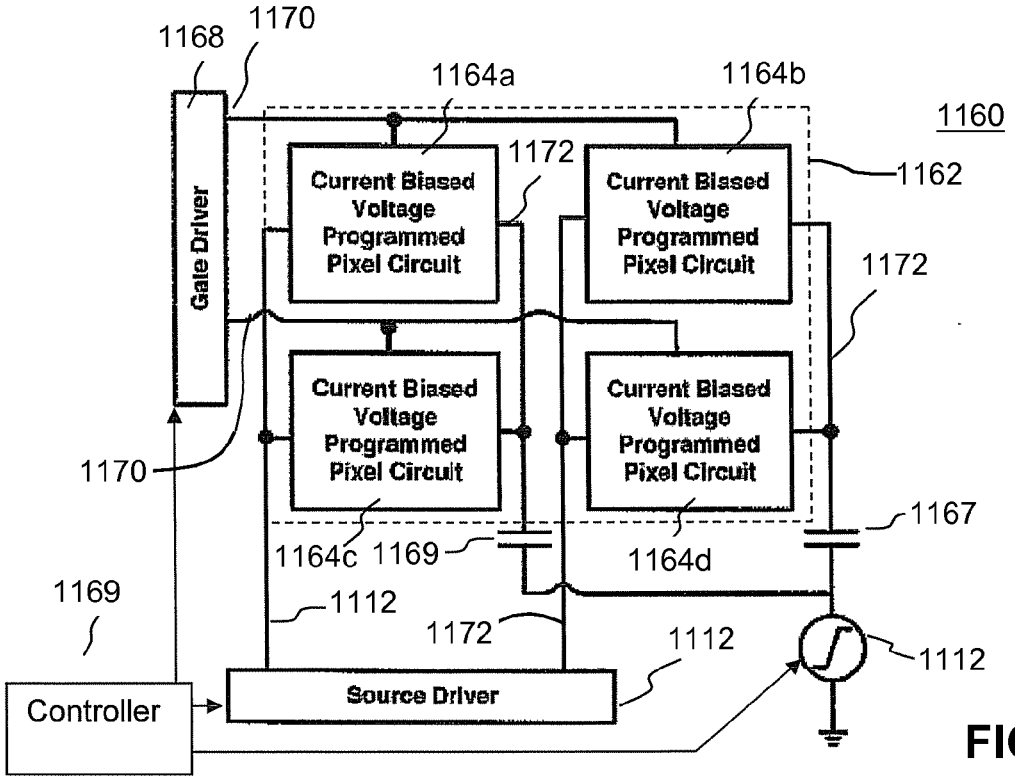
FIG. 27 illustrates a further example of a display system with the bidirectional current source of FIG. 24.

Referring to FIG. 27, there is illustrated a further example of an integrated display system with the capacitive driver 1110 of FIG. 24. The integrated display system 1160 of FIG. 27 includes a pixel array 1162 having a plurality of pixels 1164*a*-1164*d* arranged in columns and rows. In FIG. 27, four pixels are shown; however, it would be appreciated by one of ordinary skill in the art that the number of the pixels in the pixel array 1162 is not limited to four and may vary. The pixels 1164*a*-1164*d* are CBVP pixel circuits, each coupling to an address line 1170, a data line 1172, and a current bias line 1174.

Each address line 1170 is shared among the pixels in a row. A gate driver 1168 drives a gate terminal of a switch transistor in the pixel via the address line 1170. Each data line 1172 is shared among the pixels in a column, and is coupled to a source driver 1167 for providing programming data. The source driver 1167 may further provide bias voltage (e.g., Vdd of FIG. 29). Each bias line 1174 is shared among the pixels in a column. The driving capacitor 1114 is allocated to each column and is coupled to the bias line 1174 and the ramp voltage generator 1112. The ramp voltage generator 1112 is shared by more than one column. A controller 1169 is provided to control and schedule programming, calibration, driving and other operations for the display array 1162. The controller 1169 controls the source driver 1167, the gate driver 1168, and the ramp voltage generator 1112. In the display system 1160, the capacitive current sources are easily put on the peripheral of the panel, resulting in reducing the implementation cost. In FIG. 27, the ramp voltage generator 1112 is illustrated separately from the source driver 1167. However, the source driver 1167 may provide the ramp voltage.

A display system having a CBVP pixel circuit uses voltage to provide for different gray scales (voltage programming), and uses a bias to accelerate the programming and compensate for the time dependent parameters of a pixel, such as a threshold voltage shift and OLED voltage shift. A driver for driving a display array having the CBVP pixel circuit converts pixel luminance data into voltage. According to the CBVP driving scheme, the overdrive voltage is generated and provided to the driving transistor, which is independent from its threshold voltage and the OLED voltage. The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits. Since the settling time of the pixel circuits is much smaller than conventional pixel circuits, it is suitable for large-area display such as high definition TV, but it also does not preclude smaller display areas either. The capacitive driving technique is applicable to the CBVP display to further improve the settling time suitable for larger and higher resolution displays.

Figure 28:
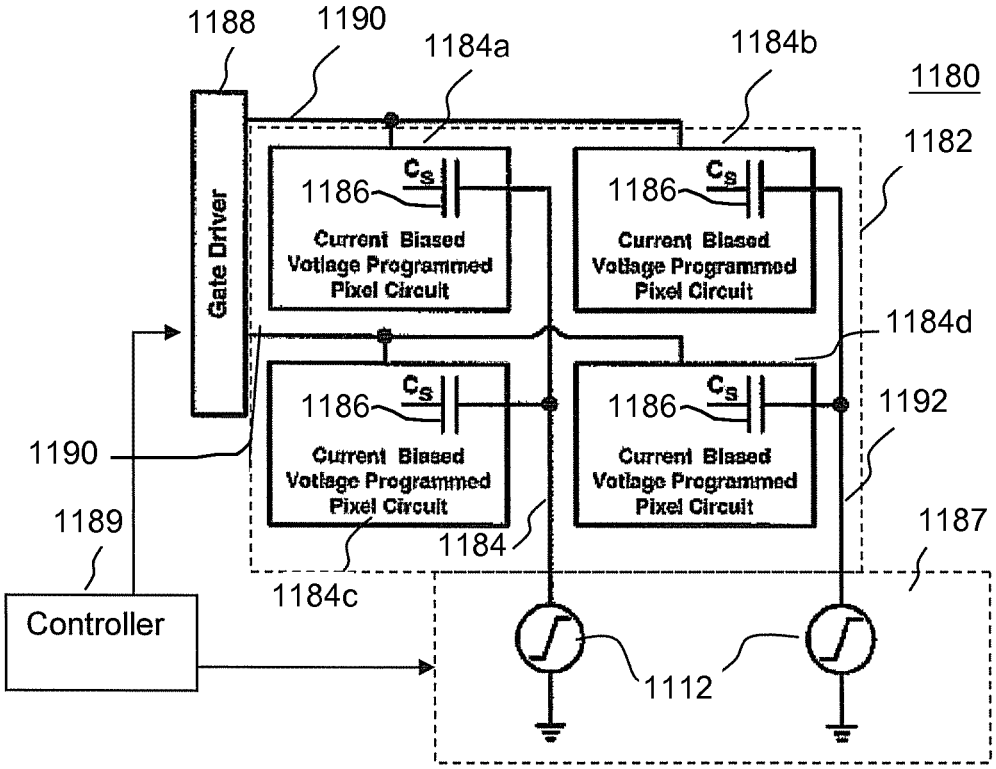
FIG. 28 illustrates a further example of a display system with the bidirectional current source of FIG. 24.

The capacitive driving technique provides a unique opportunity to share the current bias line and voltage data line in CBVP displays. Referring to FIG. 28 there is illustrated a further example of an integrated display system with the capacitive driver 1110 of FIG. 24. The integrated display system 1180 of FIG. 28 includes a pixel array 1182 having a plurality of pixels 1184*a*-1184*d* arranged in columns and rows. The pixels 1184*a*-1184*d* are CBVP pixel circuits, and may be same as the pixels 1164*a*-1164*d* of FIG. 23. In FIG. 24, four pixels are shown; however, it would be appreciated by one of ordinary skill in the art that the number of the pixels in the pixel array 1182 is not limited to four and may vary. Each pixel is coupled to the address line 1190 and the voltage data/current bias line 1192.

Each address line 1190 is shared among the pixels in a row. A gate driver 1188 drives a gate terminal of the switch transistor in the pixel via the address line 1190. Each voltage data/current bias line 1192 is shared among the pixels in a column, and is coupled to a capacitor 1186 in each pixel in the column. The capacitor 1186 in each pixel in the column is coupled to the ramp voltage generator 1112 via the voltage data/current bias line 1192. A source driver 1187 has the ramp voltage generator 1112. The ramp voltage generator 1112 is allocated to each column. A controller 1189 is provided to control and schedule programming, calibration, driving and other operations for the display array 1182. The controller 1189 controls the gate driver 1188 and the source driver 1187 having the ramp voltage generator 1112. The data voltage and the biasing current are carried over through the voltage data/current bias line 1192. In the display system 1180, the capacitor 1186 in the pixel acts as a storage capacitor for the pixel and also acts as driving capacitance (capacitor 1114 of FIG. 24).

Figure 29A:
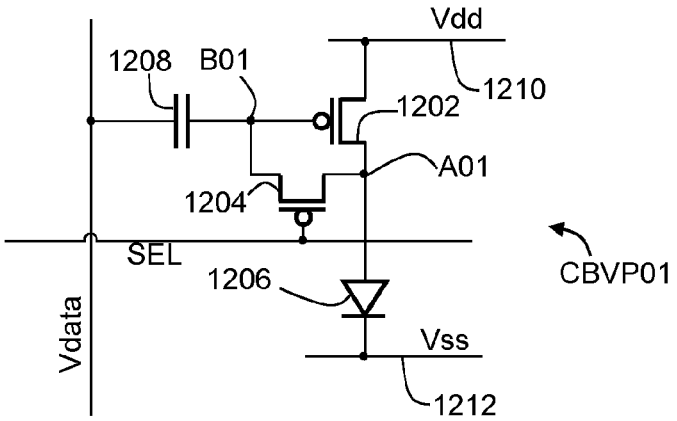
FIG. 29A illustrates an example of a current biased voltage programmed pixel circuit applicable to the display system of FIG. 28.

Referring to FIG. 29A, there is illustrated an example of a CBVP pixel circuit which is applicable to the pixel of FIG. 28. The pixel circuit CBVP01 of FIG. 29 includes a driving transistor 1202, a switch transistor 1204, a light emitting device 1206, and a capacitor 1208. In FIG. 29A, the transistors 1202 and 1204 are p-type transistors; however, one of ordinary skill in the art would appreciate that a CBVP pixel having n-type transistors is also applicable as the pixel of FIG. 28.

The gate terminal of the driving transistor 1202 is coupled to the capacitor 1208 at B01. One of the first and second terminals of the driving transistor 1202 is coupled a power supply (Vdd) 1210 and the other is coupled to the light emitting device 1206 at node A01. The light emitting device 1206 is coupled to a power supply (Vss) 1212. The gate terminal of the switch transistor 1204 is coupled to an address line SEL. One of the first and second terminals of the switch transistor 1204 is coupled to the gate of the driving transistor 1202 and the other is coupled to the light emitting device 1206 and the driving transistor 1202 at A01. The capacitor 1208 is coupled between a data line Vdata and the gate terminal of the driving transistor 1202. The capacitor 1208 acts as a storage capacitor and a capacitive current source (1114 of FIG. 24) as a driver element.

The capacitor 1208 corresponds to the capacitor 1186 of FIG. 28. The address line SEL corresponds to the address line 1190 of FIG. 28. The data line Vdata corresponds to the voltage data/current bias line 1192 of FIG. 28, and is coupled to the ramp voltage generator (1112 of FIG. 24). The source driver 1187 of FIG. 28 operates on the data line Vdata to provide a bias signal and programming data (Vp) to the pixel.

Figure 29B:
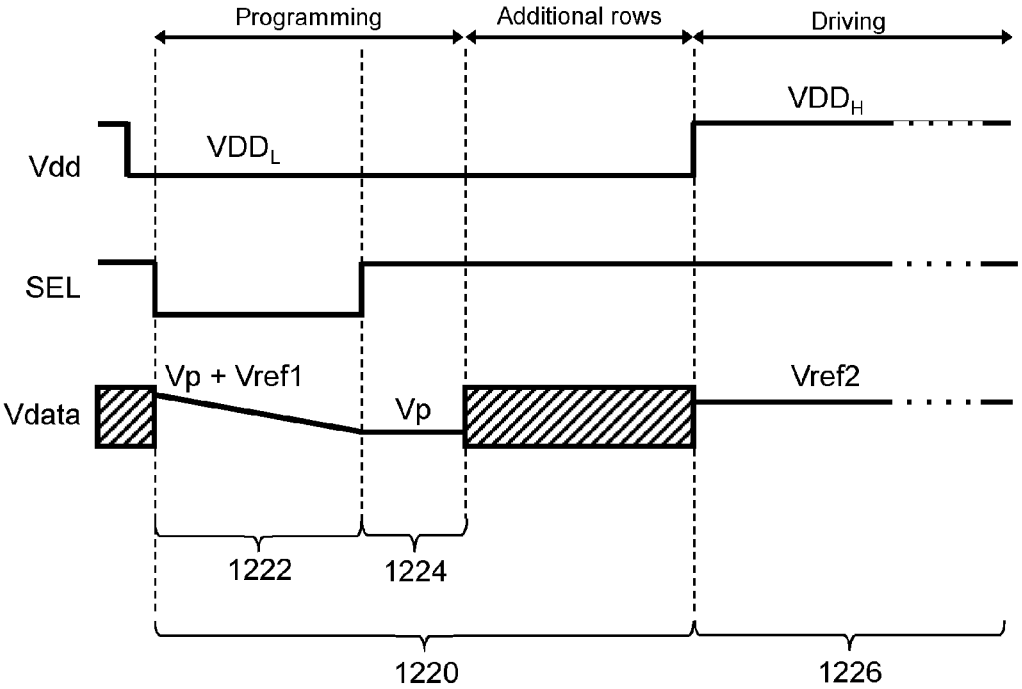
FIG. 29B illustrates an example of a timing diagram for the pixel circuit of FIG. 29A.

In FIG. 29A, the ramp voltage is used to carry the bias current while the initial voltage of the ramp (Vp+Vref1) is used to send the programming voltage to the pixel circuit CBVP01, as shown in FIG. 29B.

Referring to FIGS. 29A and 29B, the operation cycles of the pixel circuit CBVP01 includes a programming cycle 1220 and a driving cycle 1226. The power supply Vdd coupled to the driving transistor 1202 is low during the programming cycle 1220. In the initial stage 1222 of the programming cycle 1220, a ramp voltage is provided to the data line Vdata. The voltage of the Vdata goes from (Vp+Vref1) to Vp where Vp is a programming voltage for programming the pixel and Vref1 is a reference voltage. During the initial stage 1222, the address line SEL is set to a low voltage so that the switch transistor 1204 is on. During the initial stage 1222, the capacitor 1208 acts as a current source. The voltage of node A01 goes to $VB_{T1}$ where VB is a function of T1's characteristics (T1: the driving transistor 1202) and the voltage of node B01 goes to $VB_{T1}+Vr_{T2}$ where $Vr_{T2}$ is the voltage drop across T2 (T2: the switch transistor 1204).

At the next stage 1224 after the initial stage 1222, the voltage of Vdata remains Vp, and the address line SEL goes high to render the switch transistor 1204 off. During the stage 1224, the capacitor 1208 acts as a storage element. During the driving cycle 1226, the data line Vdata goes to Vref2 and stay at Vref2 for the rest of the frame.

Vref1 defines the level of bias current Ibias and it is determined, for example, based on TFT, OLED, and display characteristics and specifications. Vref2 is a function of Vref1 and pixel characteristics.

Figure 30A:
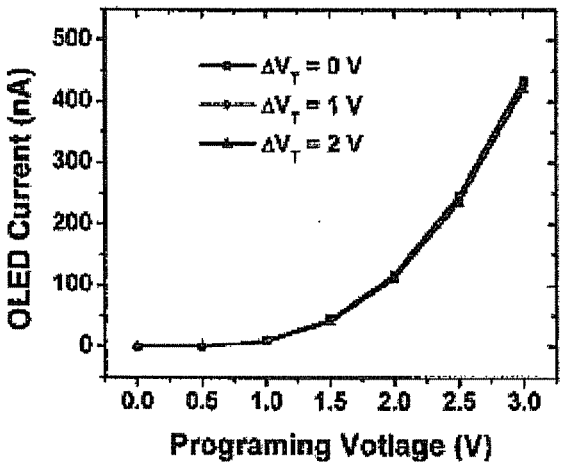
FIG. 30A illustrates simulation results for the pixel circuit of FIG. 29A.
Figure 30B:
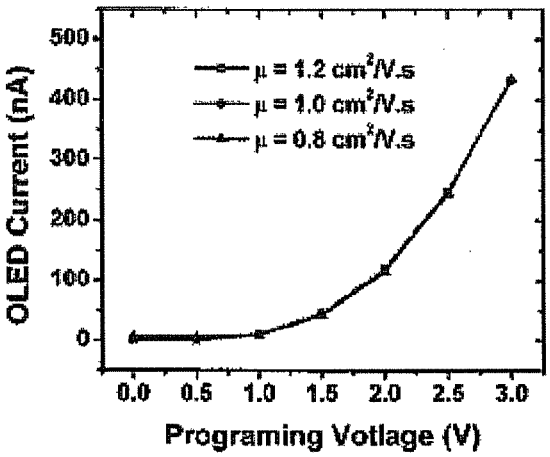
FIG. 30B illustrates further simulation results for the pixel circuit of FIG. 29A.

Referring to FIGS. 30A-30B, there are illustrated graphs showing simulation results for the pixel circuit of FIG. 29A using the operation of FIG. 29B. In FIG. 30A, "ΔVT" represents variation of driving transistor threshold $V_T$, and "μ" represents mobility ($cm^2Ns$). As shown in FIGS. 30A-30B, despite variation in the driving transistor threshold $V_T$ and mobility, the pixel current is stable for all gray scales.

Circuits disclosed herein generally refer to circuit components being connected or coupled to one another. In many instances, the connections referred to are made via direct connections, i.e., with no circuit elements between the connection points other than conductive lines. Although not always explicitly mentioned, such connections can be made by conductive channels defined on substrates of a display panel such as by conductive transparent oxides deposited between the various connection points. Indium tin oxide is one such conductive transparent oxide. In some instances, the components that are coupled and/or connected may be coupled via capacitive coupling between the points of connection, such that the points of connection are connected in series through a capacitive element. While not directly connected, such capacitively coupled connections still allow the points of connection to influence one another via changes in voltage which are reflected at the other point of connection via the capacitive coupling effects and without a DC bias.

Furthermore, in some instances, the various connections and couplings described herein can be achieved through non-direct connections, with another circuit element between the two points of connection. Generally, the one or more circuit element disposed between the points of connection can be a diode, a resistor, a transistor, a switch, etc. Where connections are non-direct, the voltage and/or current between the two points of connection are sufficiently related, via the connecting circuit elements, to be related such that the two points of connection can influence each another (via voltage changes, current changes, etc.) while still achieving substantially the same functions as described herein. In some examples, voltages and/or current levels may be adjusted to account for additional circuit elements providing non-direct connections, as can be appreciated by individuals skilled in the art of circuit design.

Any of the circuits disclosed herein can be fabricated according to many different fabrication technologies, including for example, poly-silicon, amorphous silicon, organic semiconductor, metal oxide, and conventional CMOS. Any of the circuits disclosed herein can be modified by their complementary circuit architecture counterpart (e.g., n-type transistors can be converted to p-type transistors and vice versa).

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the scope of the invention as defined in the appended claims.

What is claimed is:

1. A pixel circuit comprising:

a driving transistor for conveying a driving current through a light emitting device during an emission cycle, the driving current being conveyed according to programming information;

a capacitor coupled in series between a gate terminal of the driving transistor and a line conveying compensation signals; and a switching transistor coupled between the gate terminal of the driving transistor and a terminal of the driving transistor other than the gate terminal, wherein the capacitor and the driving transistor are coupled via the switching transistor such that while the switching transistor is turned on, a compensation current is conveyed through the driving transistor, the switching transistor, and across the storage capacitor while the gate terminal of the driving transistor adjusts according to the compensation current.

2. The pixel circuit according to claim 1, wherein the line conveying compensation signals is a line providing a changing voltage having a substantially constant time derivative such that the compensation current generated across the capacitor has a substantially constant value.

3. The pixel circuit according to claim 1, further comprising:

a second switching transistor connected in series between the gate terminal of the drive transistor and the capacitor such that the gate terminal of the driving transistor is selectively connected to the capacitor, and a second capacitor coupled to the gate terminal of the driving transistor for being charged according to the programming information during a programming cycle preceding the emission cycle, such that the driving transistor conveys the driving current according to a charge on the second capacitor.

4. The pixel circuit according to claim 3, wherein the switching transistor is coupled to the gate terminal of the driving transistor through the second switching transistor, the switching transistor being directly connected to the capacitor.

5. The pixel circuit according to claim 4, wherein the pixel circuit is further configured to reset the capacitor by discharging voltage on the capacitor, via the switching transistor, while the second switching transistor is turned off to thereby isolate the gate terminal of the driving transistor from the capacitor during the reset.

6. The pixel circuit according to claim 5, wherein the second switching transistor is coupled to a capacitance associated with the light emitting device during the reset, and the discharge of the capacitor is carried out by discharging the capacitor to the capacitance associated with the light emitting device.

7. The pixel circuit according to claim 3, further comprising a third switching transistor connected in series with the switching transistor and operated according to select line that also operates the switching transistor such that the switching transistor is coupled to the gate terminal of the driving transistor through the third switching transistor, thereby isolating the gate terminal of the driving transistor from the current path through the light emitting device by both the switching transistor and the third switching transistor.

8. The pixel circuit according to claim 3, wherein the line conveying compensation signals is a data line providing a programming voltage according to the programming information during the programming cycle, and wherein the second switching transistor is operated by a second select line and the switching transistor is operated by a first select line such that the switching transistor and the second switching transistor are both turned on while the compensation current is conveyed through the driving transistor and such that the second switching transistor is turned on and the switching transistor is turned off while the programming voltage is applied to the data line to set the voltage of the gate terminal of the driving transistor based on the programming voltage.

9. The pixel circuit according to claim 8, further comprising an emission transistor operated according to an emission select line for selectively coupling the driving transistor to the light emitting device during the emission cycle, the emission transistor being configured to prevent the light emitting device from emitting light during the programming cycle or while the gate terminal of the driving transistor adjusts according to the compensation current.

10. The pixel circuit according to claim 1, wherein the capacitor is a storage capacitor for being charged according to programming information during a programming cycle preceding the emission cycle, such that the driving transistor conveys the driving current according to a charge on the storage capacitor.

11. The pixel circuit according to claim 1, wherein the calibration current is drained through the capacitor to a current source drawing a reference current, the reference current including the compensation current and a data line discharge current.

12. The pixel circuit according to claim 1, wherein the line conveying compensation signals is a data line configured to provide:

a programming voltage to charge the capacitor according to the programming information, and a reference current to simultaneously drain the compensation current through the capacitor and discharge the data line.

13. The pixel circuit according to claim 12, wherein the data line is further configured to apply a reference voltage during the emission cycle to thereby reference the capacitor to the reference voltage.

14. The pixel circuit according to claim 1, wherein the line conveying compensation signals is configured to provide a reference current to the capacitor and a terminal of the driving transistor not connected to the switching transistor is connected to a data line configured to provide a programming voltage simultaneously with the reference current such that the programming voltage is conveyed through the drive transistor and the switching transistor to the capacitor simultaneously with the reference current being conveyed through the driving transistor and the switching transistor and across the capacitor.

15. The pixel circuit according to claim 1, further comprising an emission transistor operated according to an emission select line for selectively coupling the driving transistor to the light emitting device during the emission cycle, the emission transistor being configured to prevent the light emitting device from emitting light during a programming cycle.

16. The pixel circuit according to claim 1, wherein a first terminal of the capacitor, a first terminal of the switching transistor, and a gate terminal of the driving transistor are connected at a node, the node being charged, during a precharge cycle, while the switching transistor is turned on, with a voltage given by the difference of a supply line voltage and a threshold voltage of the driving transistor.

17. The pixel circuit according to claim 1, wherein the light emitting device is an organic light emitting diode, and wherein the driving transistor is a p-type thin film transistor.

18. A system for driving a display, the system comprising:

a pixel circuit including:

a driving transistor for driving a light emitting device to emit light according to programming information during an emission cycle;

a capacitor coupled in series between a gate terminal of the driving transistor and a line conveying compensation signals; and a switching transistor coupled between the gate terminal of the driving transistor and a terminal of the driving transistor other than the gate terminal; and a data driver for applying a programming voltage to the pixel circuit via a data line during a programming cycle, the data line being coupled to the pixel circuit, the programming voltage being provided according to the programming information; and a current source or voltage ramp generator for generating a reference current or a voltage with a substantially constant rate of change on the data line or another line coupled to the pixel circuit, to thereby convey a compensation current through the driving transistor and the switching transistor and across the storage capacitor while the gate terminal of the driving transistor adjusts according to the compensation current.

19. The system according to claim 18, wherein a capacitance of the data line combines with the capacitor to form a current divider such that the reference current applied to the data line is divided between the compensation current conveyed through the capacitor and a discharge current for discharging the capacitance of the data line.

20. The system according to claim 18, wherein the pixel circuit further comprises:

a second switching transistor connected in series between a gate terminal of the driving transistor and the capacitor such that the gate terminal of the driving transistor is selectively connected to the capacitor to thereby capacitively couple the gate terminal of the driving transistor with the line conveying compensation signals, and a second capacitor coupled to the gate terminal of the driving transistor for being charged according to the programming information during a programming cycle preceding the emission cycle, such that the driving transistor conveys the driving current according to a charge on the second capacitor.

21. The system according to claim 20, wherein the switching transistor is coupled to the gate terminal of the driving transistor through the second switching transistor, the switching transistor being directly connected to the capacitor.

22. The system according to claim 21, wherein the pixel circuit is further configured to reset the capacitor by discharging voltage on the capacitor, via the switching transistor, while the second switching transistor is turned off to thereby isolate the gate terminal of the driving transistor from the capacitor during the reset.

23. The system according to claim 22, wherein the second switching transistor is coupled to a capacitance associated with the light emitting device during the reset, and the discharge of the capacitor is carried out by discharging the capacitor to the capacitance associated with the light emitting device.

24. The system according to claim 20, further comprising a third switching transistor connected in series with the switching transistor and operated according to select line that also operates the switching transistor such that the switching transistor is coupled to the gate terminal of the driving transistor through the third switching transistor, thereby isolating the gate terminal of the driving transistor from the current path through the light emitting device by both the switching transistor and the third switching transistor.

25. The system according to claim 18, wherein the line conveying compensation signals is a data line providing a programming voltage according to the programming information during a programming cycle, and wherein the second switching transistor is operated by a second select line and the switching transistor is operated by a first select line such that the switching transistor and the second switching transistor are both turned on while the compensation current is conveyed through the driving transistor and such that the second switching transistor is turned on and the switching transistor is turned off while the programming voltage is applied to the data line to set the voltage of the gate terminal of the driving transistor based on the programming voltage.

26. The system according to claim 18, wherein the data driver includes a cyclic digital to analog converter and the voltage ramp generator includes a ramp value signal source that is selectively connected to the cyclic digital to analog converter to generate a ramp voltage on the data line via the cyclic digital to analog converter.

27. The system according to claim 18, wherein the data driver includes a resistive digital to analog converter and the voltage ramp generator is selectively connected to the data line via one or more switches while the compensation current is conveyed through the driving transistor.

28. The system according to claim 18, further comprising an address driver for controlling a select line coupled to the switching transistor, the switching transistor being operated according to the select line to selectively turn on the switching transistor during the programming cycle.

29. The system according to claim 18, further comprising a reference voltage generator for providing a reference voltage on the data line, during the emission cycle, thereby referencing the storage capacitor to the reference voltage.

30. The system according to claim 18, wherein the pixel circuit further includes an emission control transistor for selectively coupling the driving transistor to the light emitting device during the emission cycle, the emission control transistor being operated according to an emission select line so as to prevent leakage currents from driving the light emitting device during periods other than the emission cycle.

31. A display system comprising a plurality of pixel circuits arranged in rows and columns in a display array, each pixel circuit including:

a driving transistor for driving a light emitting device to emit light according to programming information during an emission cycle;

a storage capacitor coupled to the gate terminal of the driving transistor and arranged to be charged according to the programming information during a programming cycle;

a first switching transistor operated according to first select line and connected between the gate terminal of the driving transistor and a terminal of the driving transistor other than the gate terminal;

a second switching transistor operated according to a second select line and connected to the gate terminal of the driving transistor; and wherein the gate terminal of each driving transistor being connected, through the second switching transistor, to a programming capacitor connected in series between the second switching transistor and a data line, a data driver for applying a programming voltage to the plurality of pixel circuits via respective data lines during a programming cycle, the programming voltage being provided according to the programming information for each pixel circuit; and a current source or voltage ramp generator for generating a reference current or a voltage with a substantially constant rate of change on the data line or another line coupled to at least one of the plurality of pixel circuits, to thereby convey a compensation current through the driving transistor and the switching transistor and across the storage capacitor while the gate terminal of the driving transistor adjusts according to the compensation current.

32. The display system according to claim 31, wherein the display array is segmented into a plurality of segments, each of the plurality of segments comprising a plurality of the plurality of pixel circuits, and wherein, within each of the plurality of segments, the programming capacitor is shared by more than one pixel circuit connected to a common data line.

33. The display system according to claim 32, wherein the first switching transistors within pixel circuits in each segment are operated according to a common segmented control line to simultaneously operate the first switching transistors in the pixel circuits in each of the plurality of segments, respectively.

34. The display system according to claim 33, wherein the segmented control lines for each segment are operated to simultaneously convey the compensation current through the pixel circuits in a segment, via the respective first switching transistors, to allow the respective driving transistors in the segment to adjust according to the compensation current, during a compensation cycle.

35. The display system according to claim 31, wherein each pixel circuit further comprises an emission control transistor operated according to an emission control line to selectively connect the driving transistor to the light emitting device, the emission control line being operated to prevent the light emitting device from emitting light while the compensation current is conveyed through the driving transistor.

36. The display system according to claim 31, wherein each pixel circuit is configured with the first switching transistor coupled to the gate terminal of the driving transistor through the second switching transistor, the first switching transistor being directly connected to the programming capacitor.

37. The display system according to claim 36, wherein each pixel circuit is further configured to reset the programming capacitor by discharging voltage on the programming capacitor, via the first switching transistor, while the second switching transistor is turned off to isolate the gate terminal of the driving transistor from the programming capacitor during the reset.

38. The display system according to claim 37, wherein each pixel circuit is configured with the second switching transistor coupled to a capacitance associated with the light emitting device during the reset, and the discharge of the capacitor is carried out by discharging the programming capacitor to the capacitance associated with the light emitting device.

39. The display system according to claim 31, wherein each pixel circuit further includes a third switching transistor connected in series with the first switching transistor and operated according to the first select line such that the first switching transistor is coupled to the gate terminal of the driving transistor through the third switching transistor, thereby isolating the gate terminal of the driving transistor from the current path through the light emitting device by both the switching transistor and the third switching transistor.

40. The display system according to claim 31, wherein the light emitting device is an organic light emitting diode and the driving transistor is a p-type thin film transistor.

41. A method of driving a display comprising:

a pixel circuit including:

a driving transistor for conveying a driving current through a light emitting device according to programming information;

a capacitor for being charged according to the programming information, the capacitor having a first terminal coupled to a first conductive line and a second terminal coupled to a gate terminal of the driving transistor, and a switching transistor coupled between the gate terminal of the driving transistor and another terminal of the driving transistor, and wherein the method comprises:

charging the first or second terminal of the capacitor with a programming voltage during a programming cycle while the switching transistor is selected;

applying a reference current to the first conductive line during the programming cycle such that a compensation current is drained across the capacitor and through the switching transistor and the driving transistor.

42. The method according to claim 41, wherein the compensation current adjusts a gate-source voltage of the driving transistor so as to calibrate the pixel circuit to account for a degradation of the pixel circuit.

43. The method according to claim 41, further comprising setting the first conductive line to a reference voltage level during an emission cycle that follows the program cycle such that the storage capacitor is referenced to the reference voltage.

44. The method according to claim 41, further comprising:

pre-charging the first conductive line with a programming voltage, during a pre-charging cycle included in the program cycle; and providing a voltage with a substantially constant rate of change on the first conductive line, during a compensation cycle included in the program cycle, the voltage on the first conductive line being constantly changed due to application of the reference current simultaneously draining a discharge current to thereby simultaneously discharge a parasitic capacitance of the first conductive line and provide the compensation current across the capacitor.

45. A display system comprising:

a pixel circuit including:

a driving transistor for driving a light emitting device during an emission cycle, and a capacitor for being charged with a proper voltage to cause the driving transistor to drive the light emitting device according to programming information;

a data driver for applying a programming voltage to the pixel circuit via a data line during a programming cycle, the data line being coupled to the pixel circuit, the programming voltage being provided according to the programming information; and a current source for applying a reference current to a bias line during the programming cycle and thereby draining a compensation current through the driving transistor and across the capacitor while simultaneously discharging the data line.

46. The display system according to claim 45, wherein the pixel circuit further comprises an emission control transistor configured to selectively allow current to flow through the light emitting device and wherein the data line is coupled to a first terminal of the driving transistor, a second terminal of the driving transistor being coupled to the light emitting device via the emission control transistor, the pixel circuit further including a switching transistor providing a current path for the compensation current to flow through the drive transistor and across the capacitor.

47. The display system according to claim 45, wherein the capacitor and the capacitance of the data line are arranged to divide the reference current such that a first portion discharges the capacitance associated with the data line while a second portion calibrates the pixel circuit by providing the compensation current.

48. The display system according to claim 47, wherein the reference current is divided according to the capacitance of the data line and the capacitance of the capacitor.

49. A method of operating a display having a pixel circuit for driving a light emitting device, the method comprising:

pre-charging the pixel circuit, during a pre-charge cycle, by turning on a switching transistor such that a voltage given by a difference between a supply line voltage and a threshold voltage of a driving transistor is charged on a node of the pixel circuit coupled to both a capacitor and the gate terminal of the driving transistor;

conveying a compensation current through the driving transistor, the switching transistor, and across the capacitor, during a compensation cycle, to allow the driving transistor to adjust the voltage of the node to allow the compensation current to be conveyed; and applying a reference voltage to a terminal of the capacitor other than a terminal of the capacitor coupled to the node, during an emission cycle during which the pixel circuit is driven to emit light according to programming information.

50. The method according to claim 49, wherein the compensation current adjusts a gate-source voltage of the driving transistor so as to calibrate the pixel circuit to account for a degradation of the pixel circuit.

51. The method according to claim 49, further comprising setting the terminal of the capacitor other than the terminal of the capacitor coupled to the node at a programming voltage during the pre-charge cycle.

* * * * *